US012422149B2

(12) United States Patent
Seo et al.

(10) Patent No.: US 12,422,149 B2
(45) Date of Patent: Sep. 23, 2025

(54) AIR CONDITIONER

(71) Applicant: SAMSUNG ELECTRONICS CO., LTD., Suwon-si (KR)

(72) Inventors: Yongho Seo, Suwon-si (KR); Doyoung Kim, Suwon-si (KR); Wooseog Song, Suwon-si (KR); Wonhee Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 203 days.

(21) Appl. No.: 17/981,952

(22) Filed: Nov. 7, 2022

(65) Prior Publication Data

US 2023/0213213 A1 Jul. 6, 2023

Related U.S. Application Data

(63) Continuation of application No. PCT/KR2022/014914, filed on Oct. 4, 2022.

(30) Foreign Application Priority Data

Jan. 6, 2022 (KR) ..... 10-2022-0002361

(51) Int. Cl.
*F24F 1/0059* (2019.01)
*F24F 1/0022* (2019.01)
(Continued)

(52) U.S. Cl.
CPC ..... *F24F 1/0059* (2013.01); *F24F 1/0022* (2013.01); *F24F 13/02* (2013.01); *F24F 1/0018* (2013.01); *F24F 13/08* (2013.01)

(58) Field of Classification Search
CPC ..... F24F 1/0059; F24F 1/0022; F24F 1/0018; F24F 13/02; F24F 13/08; F24F 13/081
(Continued)

(56) References Cited

U.S. PATENT DOCUMENTS 6,338,676 B1 * 1/2002 Kondou ..... F24F 1/0011 454/319
7,687,036 B2 3/2010 Ohtsuka et al.
(Continued)

FOREIGN PATENT DOCUMENTS

CN 106369670 A 2/2017
CN 111425938 A1 7/2020
(Continued)

OTHER PUBLICATIONS

International Search Report, PCT/ISA/210, dated Jan. 31, 2023, in PCTKR2022/014914.
(Continued)

*Primary Examiner* — Joel M Attey
(74) *Attorney, Agent, or Firm* — STAAS & HALSEY LLP

(57) ABSTRACT

An air conditioner includes a heat exchanger, a fan and a fan case in which the fan is accommodated. The fan case includes an inlet opening through which air sucked by the fan enters the fan and an outlet opening through which the air that entered the fan is blown by the fan to be discharged from the fan case. An air guide is spaced from a lower end portion of the outlet opening to form a gap through which the air flows to guide the air to a down direction. The air guide includes an inclined portion inclined downward toward an outer side in a lateral direction to guide air to the lateral direction.

15 Claims, 63 Drawing Sheets

(51) Int. Cl.
*F24F 13/02* (2006.01)
*F24F 1/0018* (2019.01)
*F24F 13/08* (2006.01)

(58) Field of Classification Search
USPC ..... 165/120
See application file for complete search history.

(56) References Cited

U.S. PATENT DOCUMENTS

| | | | | |
|---|---|---|---|---|
| 10,245,919 | B2 | 4/2019 | Yamanaka et al. | |
| 11,262,098 | B2 * | 3/2022 | Teramoto | F04D 29/44 |
| 11,319,961 | B2 | 5/2022 | Kono et al. | |
| 2007/0130980 | A1 | 6/2007 | Han et al. | |
| 2010/0074743 | A1 * | 3/2010 | Jairazbhoy | F03D 9/32 415/208.1 |
| 2016/0305452 | A1 * | 10/2016 | Nakagawa | F04D 29/325 |
| 2018/0209687 | A1 | 7/2018 | Chun et al. | |
| 2020/0348031 | A1 * | 11/2020 | Nagai | F24F 13/30 |

FOREIGN PATENT DOCUMENTS

| | | | |
|---|---|---|---|
| EP | 1 806 541 | A1 | 7/2007 |
| EP | 2 096 365 | B1 | 10/2017 |
| EP | 3 534 076 | A1 | 9/2019 |
| JP | 2526852 | | 8/1996 |
| JP | 10-220858 | | 8/1998 |
| JP | 2000-121089 | | 4/2000 |
| JP | 2002-276974 | | 9/2002 |
| JP | 2005-319874 | | 11/2005 |
| JP | 2006-226595 | | 8/2006 |
| JP | 4659389 | | 1/2011 |
| JP | 2011-27330 | | 2/2011 |
| JP | 4663750 | | 4/2011 |
| JP | 4760411 | | 8/2011 |
| JP | 5029577 | | 9/2012 |
| JP | 2016-160780 | | 9/2016 |
| JP | 6671469 | | 3/2020 |
| JP | 7025682 | | 2/2022 |
| KR | 10-2000-0061212 | | 10/2000 |
| KR | 10-0535376 | | 12/2005 |
| KR | 10-2302324 | | 9/2021 |

OTHER PUBLICATIONS

Written Opinion, PCT/ISA/237, dated Jan. 31, 2023, in PCTKR2022/014914.

European Search Report dated Sep. 24, 2024. in European Application No. EP 22 91 8976.

* cited by examiner

AIR CONDITIONER

CROSS-REFERENCE TO RELATED APPLICATION

This application is a continuation application, filed under 35 USC 111(a), of International Application PCT/KR2022/014914, filed Oct. 4, 2022, and is based on and claims priority under 35 U.S.C. § 119 to Korean Patent Applications No. 10-2022-0002361, filed on Jan. 6, 2022 in the Korean Intellectual Property Office, the disclosure of which is incorporated by reference herein in its entirety.

BACKGROUND

1. Field

The disclosure relates to an air conditioner having an improved structure.

2. Description of the Related Art

In general, an air conditioner is an apparatus for creating appropriate temperature, humidity, air current, etc. for human activities using a cooling cycle, while removing dust, impurities, etc. from the air.

The air conditioner includes an outdoor unit and an indoor unit. The outdoor unit includes a compressor, an outdoor heat exchanger, an expander, etc., and the indoor unit includes an indoor heat exchanger, a blow fan, etc. The expander may also be provided in the indoor unit.

The air conditioner includes a fan case accommodating the blow fan to improve the static pressure performance of the blow fan and reduce the noise of the blow fan. Air discharged from the blow fan is guided by the fan case and thus flows to the heat exchanger.

Below the outlet of the fan case, a vortex may be formed due to flow resistance. Due to the vortex, flow loss occurs which causes a reduction of an air volume and generation of blow noise. Also, the flow of air is concentrated onto some areas of the heat exchanger, resulting in performance deterioration of the heat exchanger.

SUMMARY

Therefore, it is an aspect of the disclosure to provide an air conditioner having improved air-conditioning performance.

It is another aspect of the disclosure to provide an air conditioner having improved blowing ability.

It is another aspect of the disclosure to provide an air conditioner capable of preventing or reducing generation of vortex.

Additional aspects of the disclosure will be set forth in part in the description which follows and, in part, will be obvious from the description, or may be learned by practice of the disclosure.

An air conditioner according to an embodiment of the disclosure includes: a heat exchanger; a fan; a fan case in which the fan is accommodated, and including an inlet opening through which air sucked by the fan enters the fan and an outlet opening through which the air that entered the fan is blown by the fan to be discharged from the fan case; and an air guide spaced from a lower end portion of the outlet opening in a flow direction of the air blown through the outlet opening to form a gap through which the air flows to guide the air to a down direction, and including an inclined portion inclined downward toward an outer side in a lateral direction to guide air to the lateral direction.

The air conditioner may further include a guide duct including the air guide and configured to guide the flow of air blown through the outlet opening to the heat exchanger.

The air guide may include: a first guide surface positioned to face the heat exchanger; and a second guide surface being opposite to the first guide surface and configured to guide air that flows through the gap.

The first guide surface and the second guide surface may be curved to be inclined downward toward the heat exchanger.

The air guide may be rotatable with respect to the guide duct to control a flow direction of the flow of air blown through the outlet opening.

The air conditioner may further include: a guide driver configured to rotate the air guide; and a controller configured to control the guide driver, and change a rotation angle of the air guide with respect to the outlet opening.

A cross section of the air guide may include a streamlined shape.

The air guide may be a first air guide, the gap may be a first gap, the air conditioner may further include a second air guide arranged with the first air guide along the flow direction of air discharged through the outlet opening, and the second air guide may be spaced from the first air guide in the flow direction of air discharged through the outlet opening to form a second gap between the first air guide and the second air guide through which the air blown through the outlet opening flows.

The second air guide may protrude lower than the first air guide.

The gap may be a lower gap. The air conditioner may further include a side air guide extending in vertical direction to correspond to a side end of the outlet opening. The side air guide may be spaced from the side end of the outlet opening in the flow direction of air to form a side gap through which air flows. The air guide is lower than the side air guide.

The side air guide may be curved outward from the side end of the outlet opening, and configured to guide air passed through the side gap to the lateral direction.

A first side in the lateral direction of the air guide may be lower than a second side of the air guide that is opposite to the first side such that the air guide induces air to flow to the first side.

The air conditioner may also a housing that may include a first space in which an inlet is formed and in which the fan and the fan case are positioned; a second space in which an outlet is formed and in which the heat exchanger is positioned; and a partition configured to partition the first space from the second space excluding an area corresponding to the outlet opening, wherein the guide duct may be detachably installed on the partition to provide an airflow path to the outlet opening.

The guide duct may further include: an opening corresponding to the outlet opening; an upper cover portion covering an upper area of the opening and protruding toward the heat exchanger; a first side cover portion covering one side area of the opening and extending downward from a first side of the upper cover portion; and a second side cover portion being opposite to the first side cover portion, and covering an other side area of the opening and extending downward from a second side of the upper cover portion, wherein the air guide may be positioned between the first side cover portion and the second side cover portion.

The fan may be configured to suck air in an axial direction and discharge air in a radial direction.

An air conditioner according to an embodiment of the disclosure includes: a housing including a left wall and a right wall; a first fan assembly being adjacent to the left wall; a second fan assembly spaced from the first fan assembly in a left-right direction and being adjacent to the right wall; a heat exchanger configured to perform heat exchange with air discharged from the first fan assembly and the second fan assembly; a first air guide inclined downward toward the left wall and configured to guide air discharged from the first fan assembly to a left direction; and a second air guide inclined downward toward the right wall and configured to guide air discharged from the second fan assembly to a right direction.

The first air guide may be spaced from a lower end of an outlet side of the first fan assembly to form a first gap through which air flows to reduce vortex generated below the outlet side of the first fan assembly, and the second air guide may be spaced from a lower end of an outlet side of the second fan assembly to form a second gap through which air flows to reduce vortex generated below the outlet side of the second fan assembly.

The first air guide may further include a first curved portion configured to guide air passed through the first gap, and the second air guide may further include a second curved portion configured to guide air passed through the second gap.

The first air guide and the second air guide may be curved to be inclined downward toward the heat exchanger.

Each of cross sections of the first air guide and the second air guide may include a streamlined shape.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
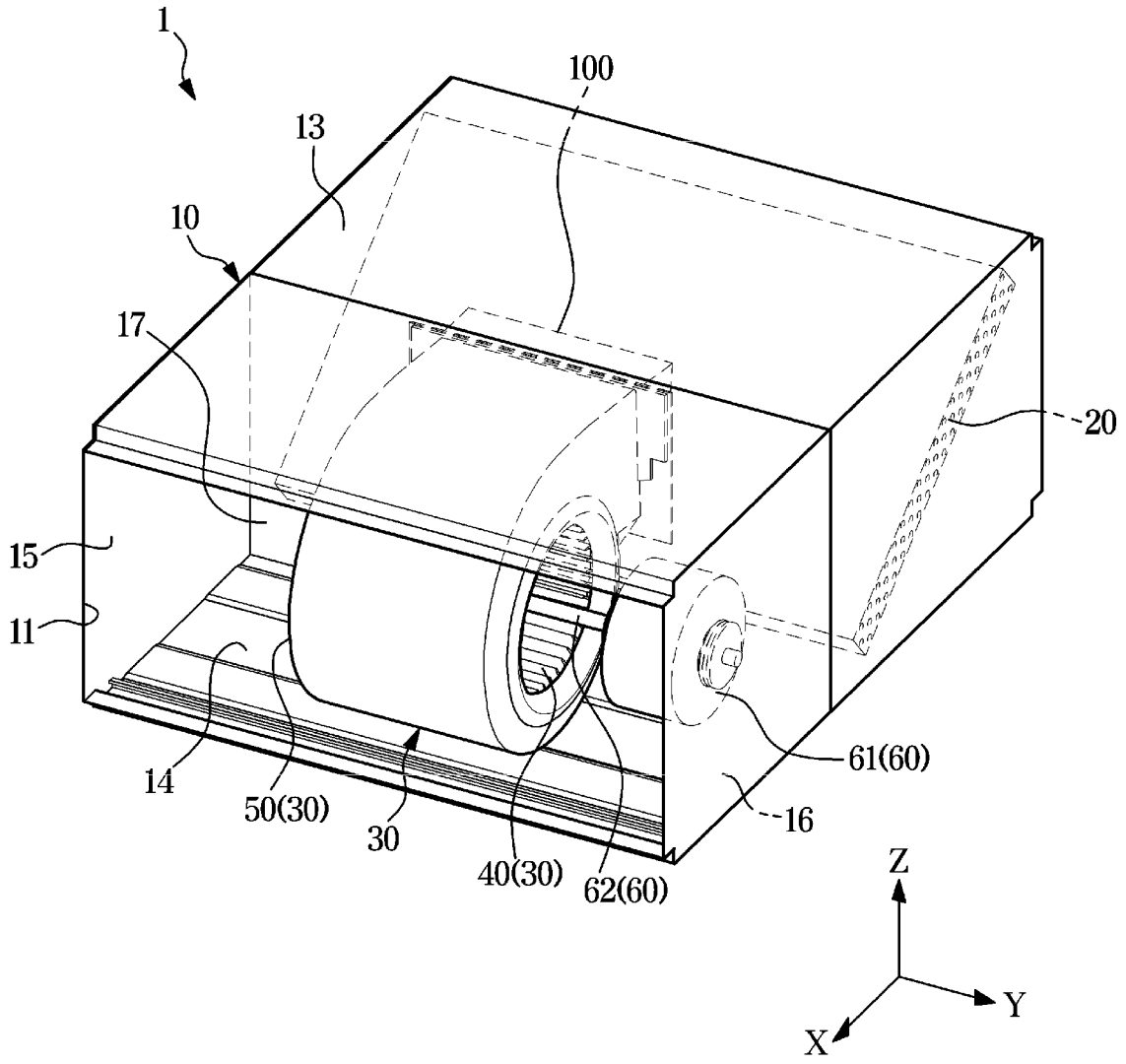
FIG. 1 is a perspective view showing an example of an air conditioner according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe embodiments, and are not intended to limit and/or restrict the disclosure. An expression used in the singular encompasses the expression of the plural, unless it has a clearly different meaning in the context. In the present specification, it is to be understood that the terms such as "comprising", "including" or "having", etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

Throughout this specification, it will be understood that when a certain part is referred to as being "connected" to another part, it can be directly or indirectly connected to the other part. Likewise, it will be understood that when a certain part is referred to as being "coupled" to another part, it can be directly or indirectly coupled to the other part.

In the entire specification, it will also be understood that when an element is referred to as being "on" or "over" another element, it can be directly on the other element or intervening elements may also be present.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

In the following description, the terms "let-right direction", "lateral direction", "up-down direction", "upper side", "right side", etc. are defined based on the drawings, and the shapes and positions of the components are not limited by the terms.

For example, referring to FIGS. 1 to 6, an X direction is defined as a front-rear direction, a Y direction is defined as a left-right direction (lateral direction), and a Z direction is defined as an up-down direction. Also, a −Y direction is defined as a left direction, and a +Y direction is defined as a right direction. However, the definitions are only examples based on the drawings for convenience of description.

Throughout the disclosure, the expression "at least one of a, b or c" indicates only a, only b, only c, both a and b, both a and c, both b and c, all of a, b, and c, or variations thereof.

A cooling cycle constituting an air conditioner may be configured with a compressor, a condenser, an expansion valve, and an evaporator. The cooling cycle may perform a series of processes of compression-condensation-expansion-evaporation so as to heat-exchange air with refrigerants and then supply the heat-exchanged air. Thereby, the air conditioner may adjust temperature of an indoor space.

An outdoor unit of the air conditioner may include a compressor and an outdoor heat exchanger. An indoor unit of the air conditioner may include an indoor heat exchanger. The expansion valve may be provided in any one of the indoor unit or the outdoor unit.

The indoor heat exchanger and the outdoor heat exchanger may function as a condenser or an evaporator. Upon use of the indoor heat exchanger as a condenser, the air conditioner may perform an indoor heating mode. Upon use of the indoor heat exchanger as an evaporator, the air conditioner may perform an indoor cooling mode.

Hereinafter, embodiments of the disclosure will be described in detail with reference to the accompanying drawings.

Figure 2:
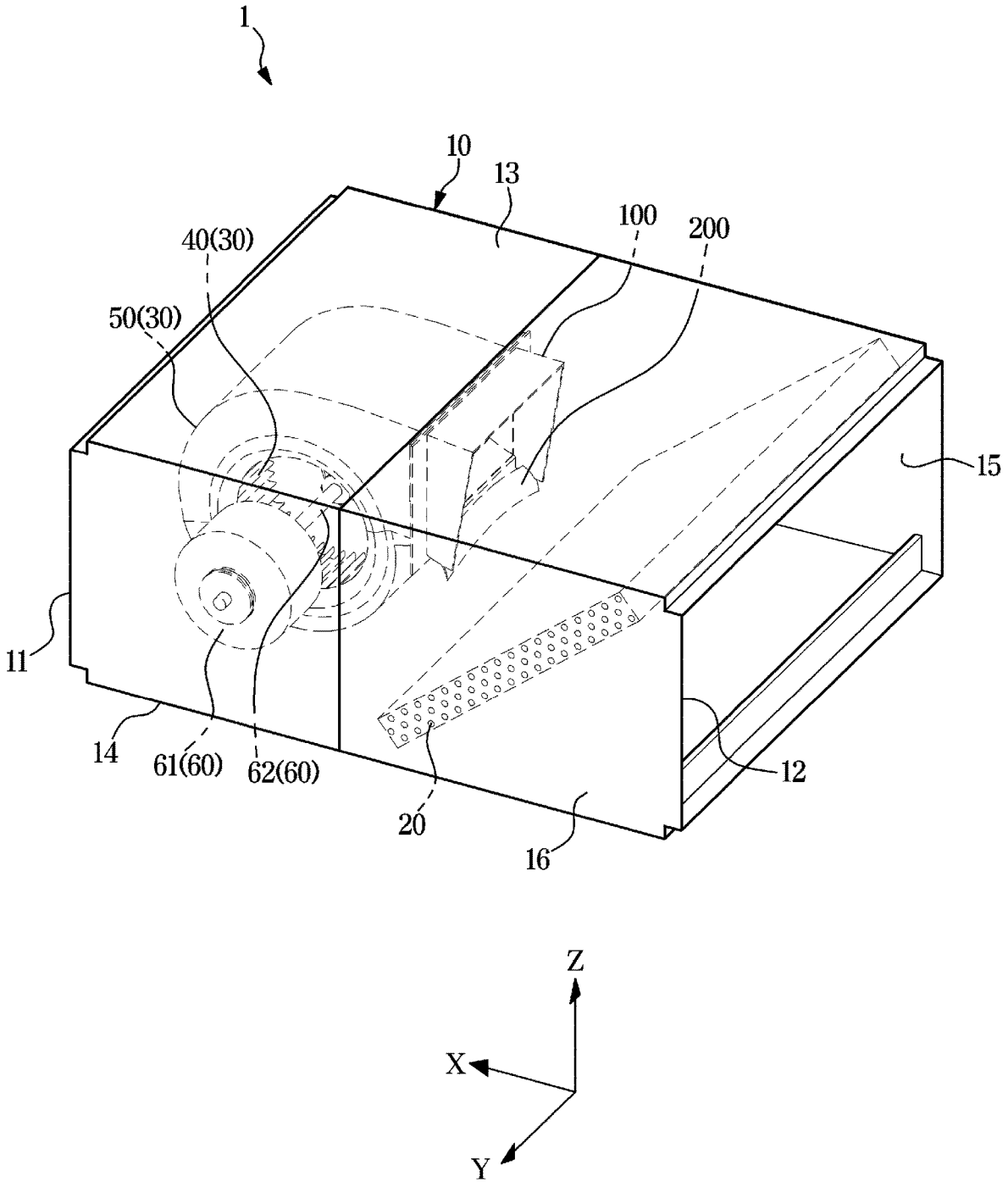
FIG. 2 is a rear perspective view of the air conditioner shown in FIG. 1.
Figure 3:
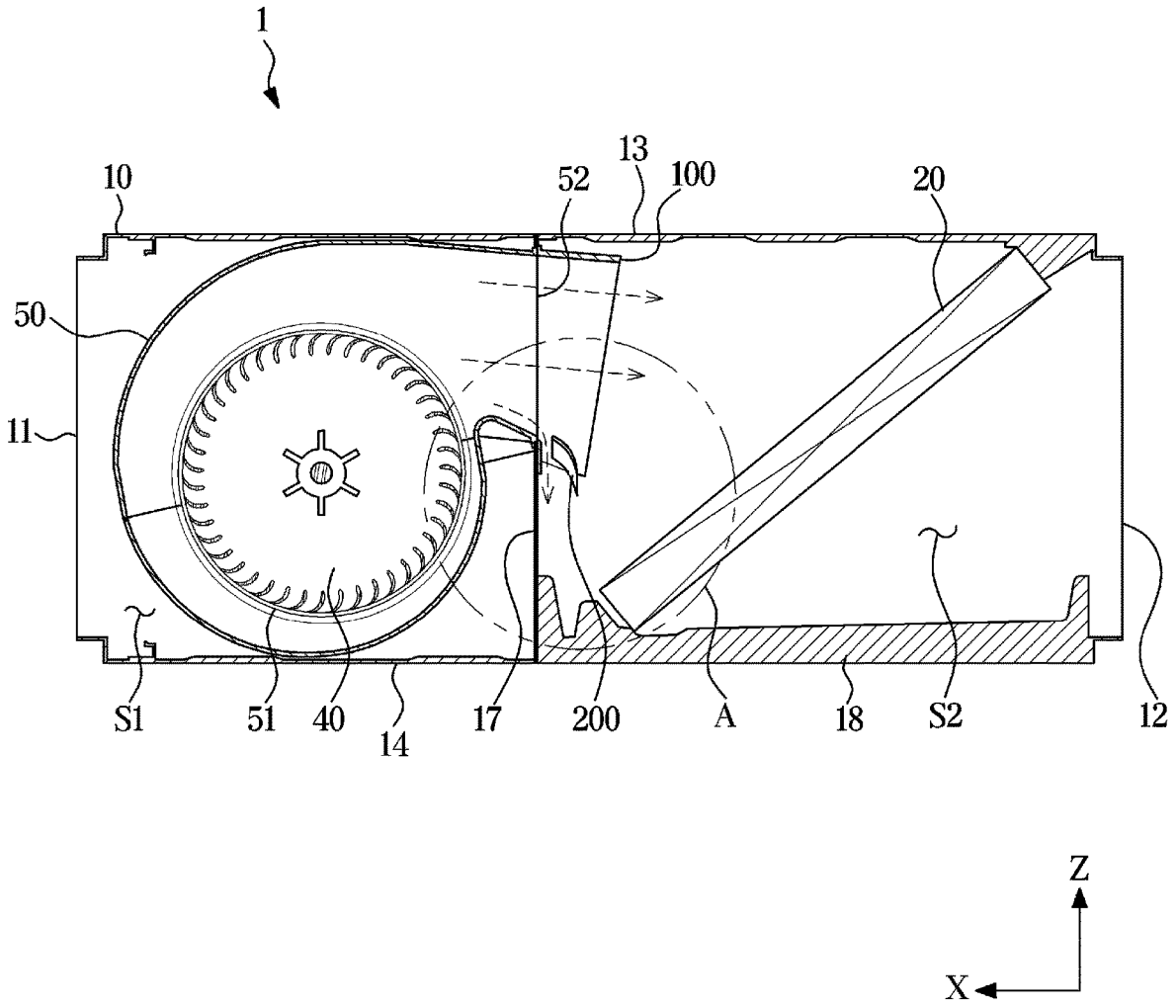
FIG. 3 is a cross-sectional view of the air conditioner shown in FIG. 1, taken along an X-Z plane.
Figure 4:
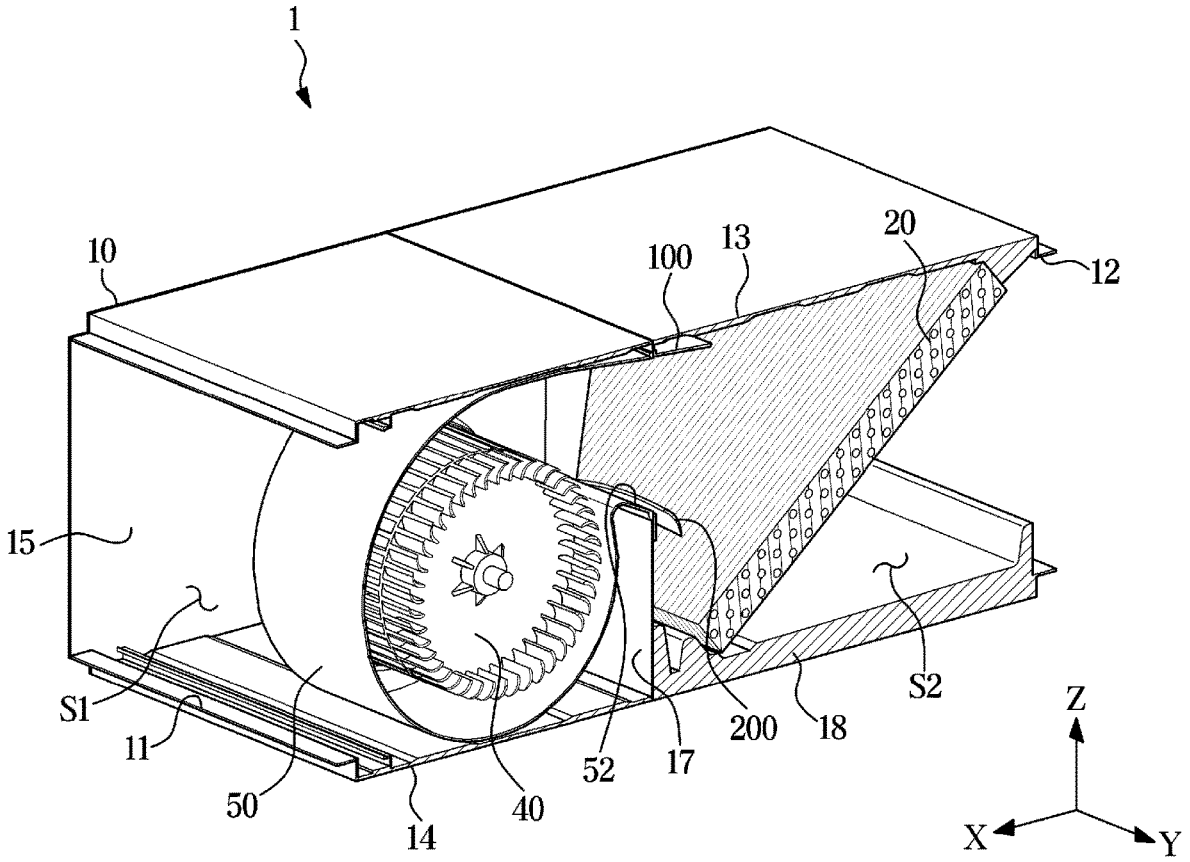
FIG. 4 is a perspective view of the air conditioner shown in FIG. 1, taken along the X-Z plane.
Figure 5:
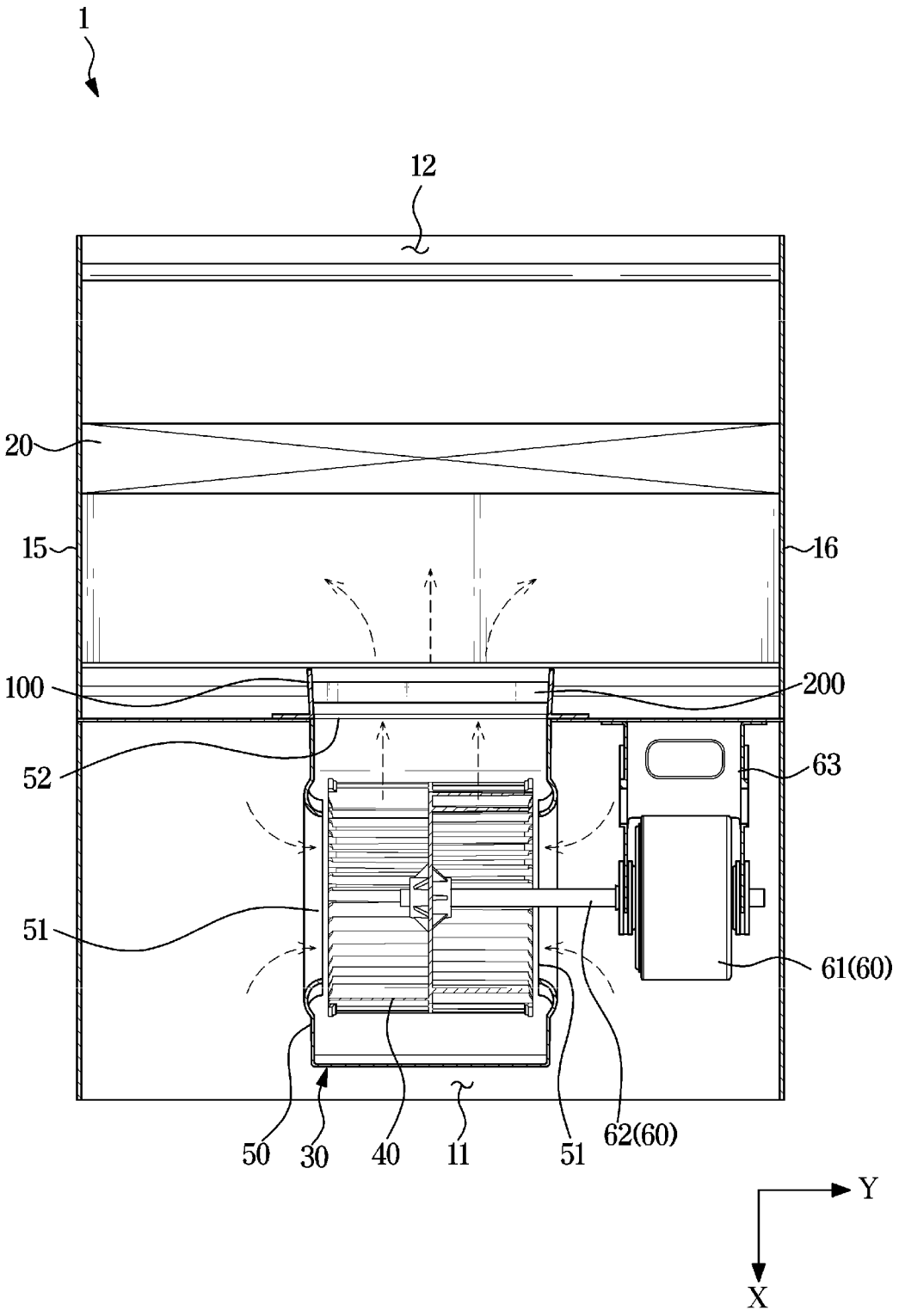
FIG. 5 is a cross-sectional view of the air conditioner shown in FIG. 1, taken along an X-Y plane.
Figure 6:
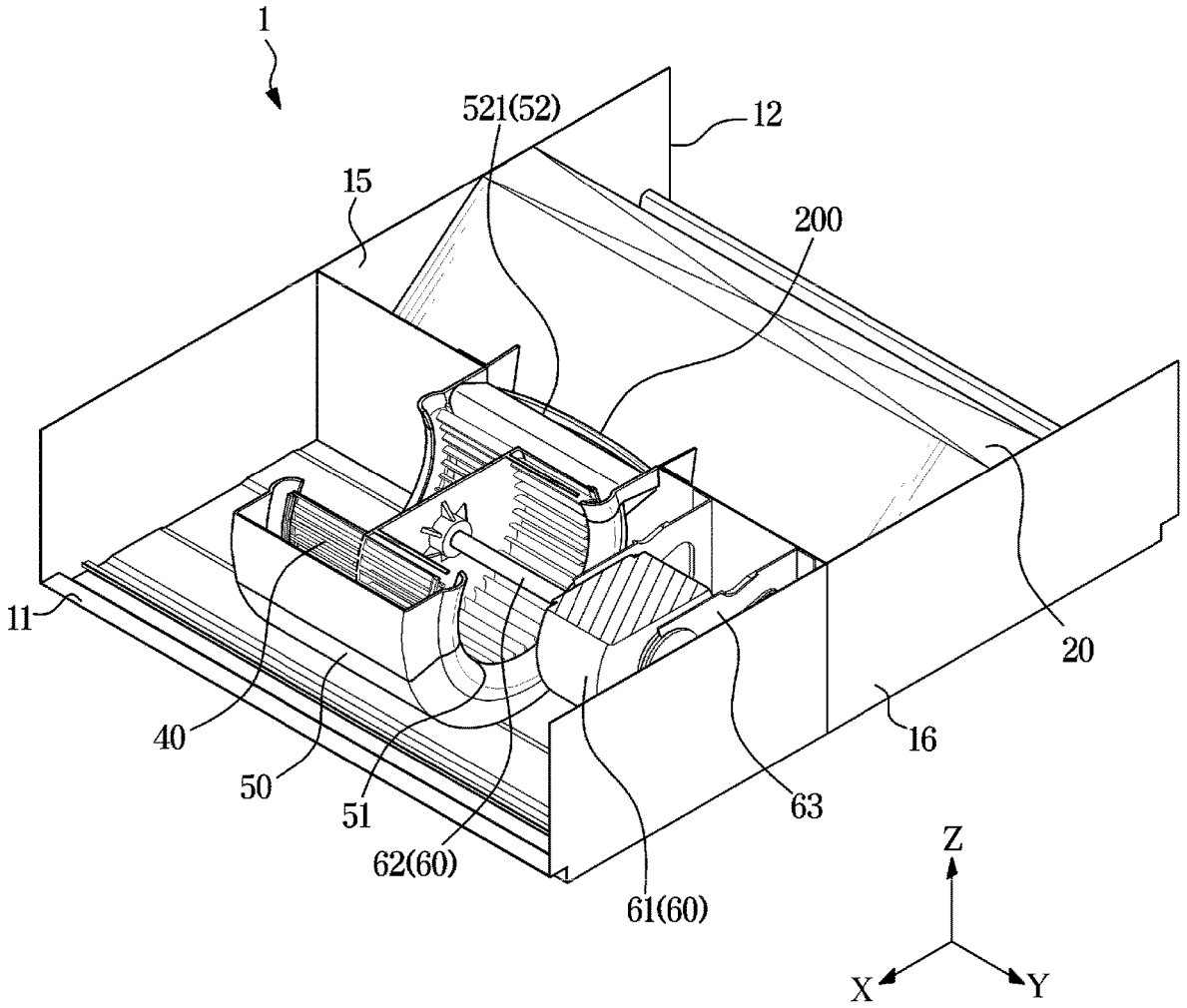
FIG. 6 is a perspective view of the air conditioner shown in FIG. 1, taken along the X-Y plane.

FIG. 1 is a perspective view showing an example of an air conditioner according to an embodiment of the disclosure. FIG. 2 is a rear perspective view of the air conditioner shown in FIG. 1. FIG. 3 is a cross-sectional view of the air conditioner shown in FIG. 1, taken along an X-Z plane. FIG. 4 is a perspective view of the air conditioner shown in FIG. 1, taken along the X-Z plane. FIG. 5 is a cross-sectional view of the air conditioner shown in FIG. 1, taken along an X-Y plane. FIG. 6 is a perspective view of the air conditioner shown in FIG. 1, taken along the X-Y plane.

Referring to FIGS. 1 to 6, an air conditioner 1 may include a housing 10. The housing 10 may form an outer appearance of the air conditioner 1. For example, the housing 10 may be substantially in a shape of a box.

The housing 10 may include an inlet 11 and an outlet 12. The inlet 11 may suck air into inside of the housing 10. The outlet 12 may discharge heat-exchanged air.

The inlet 11 may include a grill (not shown) and/or a filter member (not shown) for filtering dust included in air sucked into the inlet 11.

The outlet 12 may include a wind direction adjusting member (not shown) for changing a direction of air to be discharged.

For example, the inlet 11 may be provided in a first side of the housing 10, and the outlet 12 may be provided in a second side of the housing 10, the second side being opposite to the first side. For example, the first side may be a side toward a front direction, and the second side may be a side toward a rear direction. In this case, the inlet 11 may suck air in, or intake air in the front direction from the housing 10, and the outlet 12 may discharge air in the rear direction from the housing 10. However, the positions and shapes of the inlet 11 and the outlet 12 are only an example, and the positions and shapes of the inlet 11 and the outlet 12 are not limited to those shown in FIGS. 1 to 6.

For example, an inlet duct (not shown) may be connected with the inlet 11, and an outlet duct (not shown) may be connected with the outlet 12. The inlet duct may guide room air to inside of the air conditioner 1. The outlet duct may discharge air heat-exchanged inside the air conditioner 1 to an indoor space, although not limited thereto. However, the inlet 11 and the outlet 12 may communicate with the indoor space, without any duct.

The housing 10 may include a top plate 13, a bottom plate 14, and side walls 15 and 16. The side walls 15 and 16 may include a left wall 15 connecting a left side of the top plate 13 with a left side of the bottom plate 13, and a right wall 16 connecting a right side of the top plate 13 with a right side of the bottom plate 14.

The housing 10 may include a first space S1 and a second space S2.

The first space S1 may include the inlet 11. In the first space S1, a fan assembly 30 which will be described below may be positioned. In the first space S1, a fan 40 and a fan case 50, which will be described below, may be positioned.

The second space S2 may include the outlet 12. In the second space S2, a heat exchanger 20 which will be described below may be positioned. In the second space S2, a drain fan 18 which will be described below may be positioned.

The housing 10 may include a partition 17 for partitioning the first space S1 from the second space S2. The partition 17 may partition the first space S1 from the second space S2, except for an area corresponding to an outlet opening 52 (which will be described below) of the fan case 50.

A heat exchanger 20 may perform heat exchange with air sucked through the inlet 11. The heat exchanger 20 may be accommodated inside the housing 10. The heat exchanger 20 may be positioned in the second space S2. For example, the heat exchanger 20 may include a tube through which a refrigerant flows, and a heat-exchange fin which is in contact with the tube to widen a heating surface. For example, the heat exchanger 20 may be inclined to be substantially orthogonal to a flow direction of air.

Below the heat exchanger 20, a drain pan 18 for collecting condensed water generated from the heat exchanger 20 may be provided. Condensed water collected in the drain pan 18 may be drained to outside of the air conditioner 1 by a drain member (for example, a hose, etc.). The drain pan 18 may support the heat exchanger 20. The drain pan 18 may be positioned in the second space S2. The drain pan 18 may include an insulation for insulating heat-exchanged air.

The air conditioner 1 may include the fan assembly 30. The fan assembly 30 may be accommodated in the housing 10. The fan assembly 30 may be positioned in the first space S1. The fan assembly 30 may include the fan 40 and the fan case 50.

The air conditioner 1 may further include a fan driver 60 for driving the fan 40. The fan driver 60 may include a fan driving source 61 for generating power, and a shaft 62 for transferring power generated by the fan driving source 61 to the fan 40. For example, the fan driver 61 may include a fan motor that is rotatable in forward and reverse directions.

The fan driver 60 may be accommodated in the housing 10. The fan driver 60 may be positioned in the first space S1. The fan driver 60 may be fixed inside the housing 10. For example, the fan driver 60 may be stably installed inside the housing 10 by a fixing bracket 63.

Figure 7:
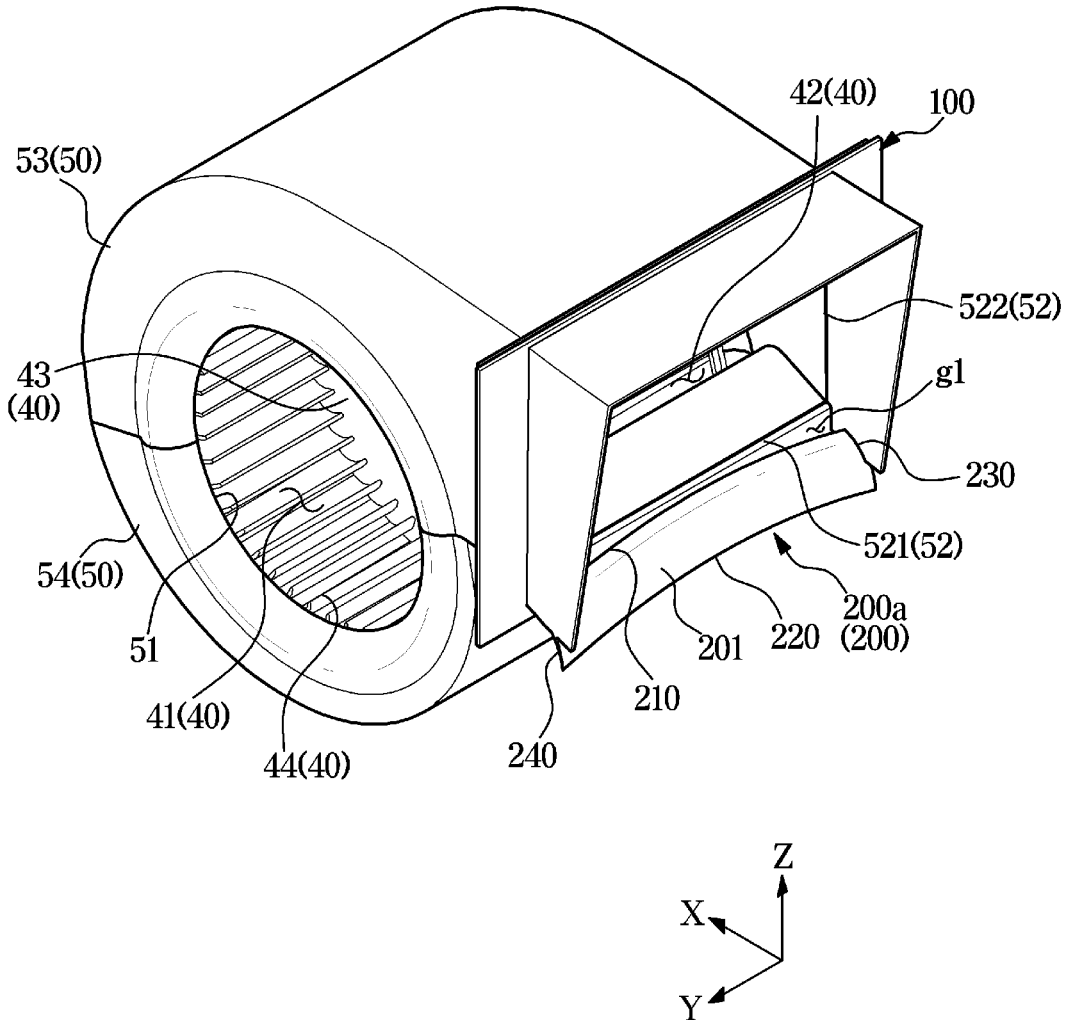
FIG. 7 is a perspective view showing an example of a blower of the air conditioner shown in FIG. 1.
Figure 8:
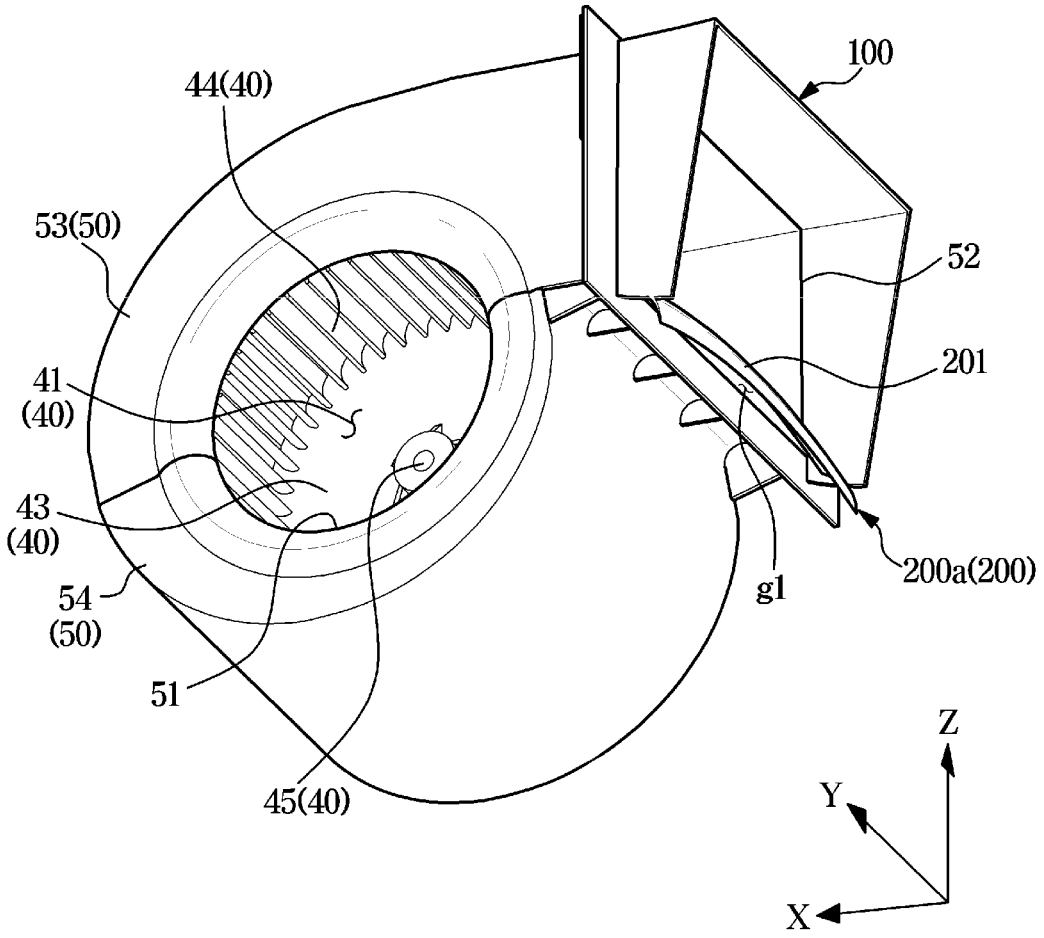
FIG. 8 is a perspective view of the blower shown in FIG. 7, seen in another direction.
Figure 9:
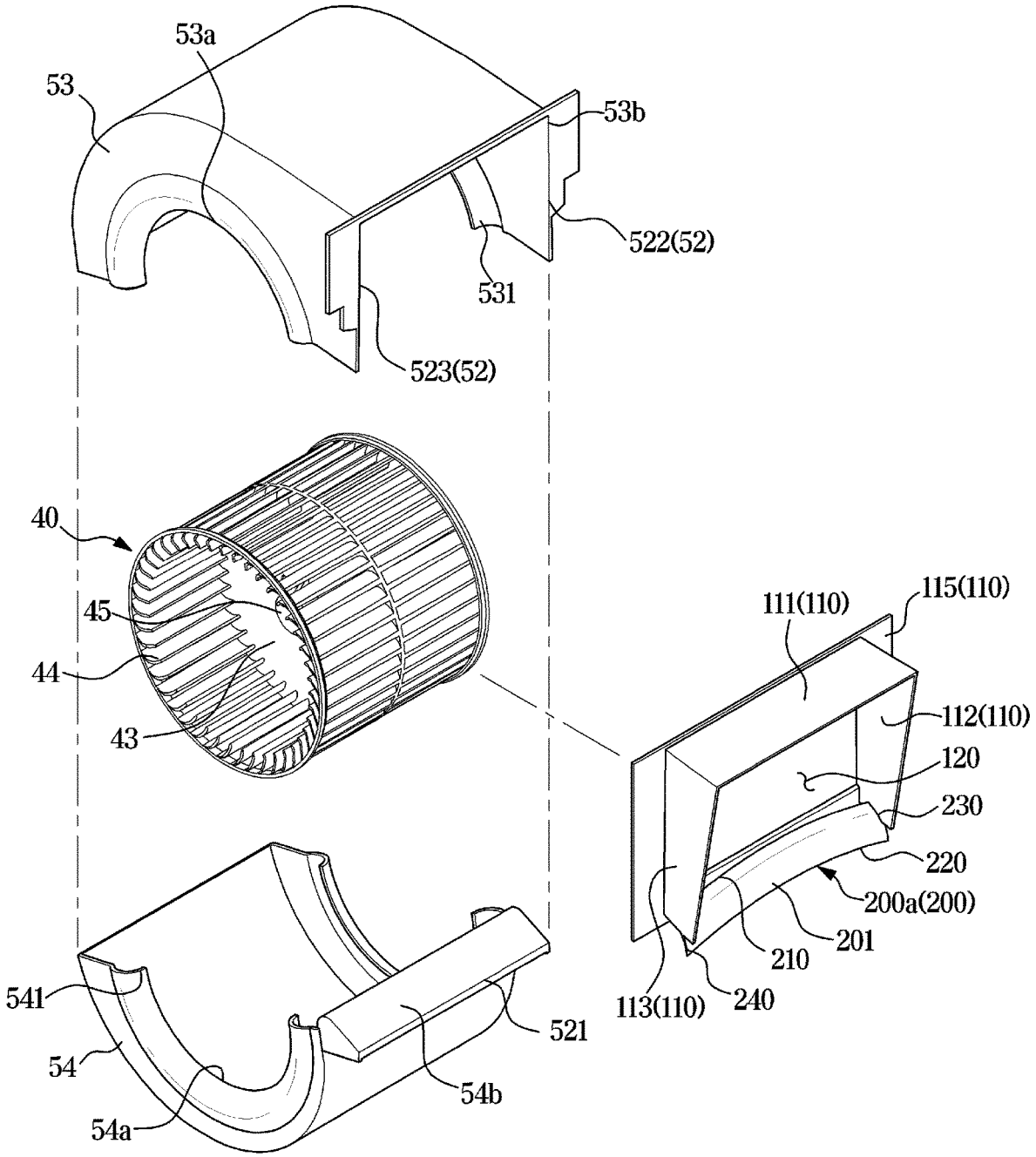
FIG. 9 is an exploded perspective view of the blower shown in FIG. 7.

FIG. 7 is a perspective view showing an example of a blower of the air conditioner shown in FIG. 1. FIG. 8 is a perspective view of the blower shown in FIG. 7, seen in another direction. FIG. 9 is an exploded perspective view of the blower shown in FIG. 7.

A blower may include a fan assembly 30 and an air guide 200.

The fan assembly 30 may include the fan 40 and the fan case 50.

The fan 40 may forcedly move air. The fan 40 may cause air to be sucked to the inside of the housing 10 through the inlet 11, or the fan 40 may cause heat-exchanged air to be discharged to the outside of the housing 10 through the outlet 12.

The fan 40 may blow air toward the heat exchanger 20. The fan 40 may discharge air sucked through the inlet 11 to the heat exchanger 20.

The fan 40 may include a hub body 43 and a blade 44. For example, a plurality of blades 44 may be provided, and the plurality of blades 44 may be arranged along a circumferential direction of the hub body 43.

A shaft coupler 45 may be positioned at a center of the hub body 43 of the fan 40. The shaft 62 of the fan driver 60 may be connected to the shaft coupler 45. The fan 40 may be driven by the fan driver 60. The fan 40 may rotate by the fan driver 60.

The fan 40 may include an inlet side 41 which air enters, and an outlet side 42 from which air is discharged.

For example, the fan 40 may be a centrifugal fan. In this case, the fan 40 may suck air in an axial direction, and discharge air in a radial direction. The inlet side 41 may be provided at both sides of the hub body 43, and the outlet side 42 may be provided at a circumferential side of the hub body 43 on which the plurality of blades 44 are arranged.

The fan case 50 may accommodate the fan 40. The fan case 50 may collect air discharged from the fan 40 and push the air to the outside of the fan 40. The fan case 50 may raise pressure of air discharged from the fan 40 to improve a blowing force of the fan 40. For example, the fan case 50 may include a curved shape surrounding the fan 40.

The fan case 50 may include an inlet opening 51 through which air enters the fan 40, and the outlet opening 52 through which air is discharged from the fan 40. The inlet opening 51 may correspond to the inlet side 41 of the fan 40, and the outlet opening 52 may correspond to the outlet side 42 of the fan 40.

For example, the outlet opening 52 may be substantially in a shape of a rectangle, although not limited thereto. However, the outlet opening 52 may have one of various shapes capable of discharging air.

For example, the fan case 50 may include a top case 53 and a bottom case 54. The top case 53 may cover the fan 40 from above, and the bottom case 54 may cover the fan 40 from below.

The top case 53 may be coupled with an upper portion of the bottom case 54. By coupling the top case 53 with the bottom case 54, the inlet opening 51 and the outlet opening 52 may be formed.

For example, referring to FIG. 9, the top case 53 may include an inlet forming portion 53*a* and an outlet forming portion 53*b*. The inlet forming portion 53*a* may include a semicircular groove shape. The inlet forming portion 53*a* may include a bell mouth forming portion 531 forming a bell mouth. The bell mouth forming portion 531 may be curved toward inside of the top case 53. The outlet forming portion 53*b* may form side ends 522 and 523 of the outlet opening 52. The outlet forming portion 53*b* may form a left side end 522 and a right side end 523 of the outlet opening 52, although not limited thereto. However, the outlet forming portion 53*b* may be coupled with an outlet forming portion 54*b* of the bottom case 54, which will be described below, to form the side ends 522 and 523 of the outlet opening 52 together with the outlet forming portion 54*b*.

For example, referring to FIG. 9, the bottom case 54 may include an inlet forming portion 54*a* and the outlet forming portion 54*b*. The inlet forming portion 54*a* may include a semicircular groove shape. The inlet forming portion 54*a* may include a bell mouth forming portion 541 for forming a bell mouth. The bell moth forming portion 541 may be curved toward inside of the bottom case 54. The outlet forming portion 54*b* may form a lower end 521 of the outlet opening 52. The outlet forming portion 54*b* may include a shape inclined downward to guide air downward. The outlet forming portion 54*b* is also referred to as a cut-off, although not limited thereto. The outlet forming portion 54*b* may be coupled with the outlet forming portion 53*b* of the top case 53 to form the lower end 521 of the outlet opening 52 together with the outlet forming portion 53*b*.

However, the fan case 50 is not limited to the example shown in FIG. 9. For example, the fan case 50 may be integrated into one body. Also, the fan case 50 may be configured with three components detachably coupled with each other.

An air guide 200 may control a flow of air discharged through the outlet opening 52 of the fan case 50. Details about this will be described below.

The blower may further include a guide duct 100. That is, the blower may include the fan assembly 30 and the air guide 200, or the blower may include the fan assembly 30, the air guide 200, and the guide duct 100.

The guide duct 100 may guide air discharged through the outlet opening 52 of the fan case 50. The guide duct 100 may guide air discharged through the outlet opening 52 to the heat exchanger 20.

The guide duct 100 may be positioned to correspond to the outlet opening 52.

The guide duct 100 may be accommodated in the housing 10. The guide duct 100 may be provided between the fan assembly 30 and the heat exchanger 20. The guide duct 100 may be provided between the outlet opening 52 of the fan case 50 and the heat exchanger 20. For example, the guide duct 100 may be positioned in the second space S2. The guide duct 100 may be detachably installed on the partition 17 to protrude to the second space S2.

For example, the guide duct 100 may include the air guide 200. The guide duct 100 and the air guide 200 may be integrated into one body, although not limited thereto. However, the guide duct 100 and the air guide 200 may be provided as separate components and then coupled with each other.

The guide duct 100 may include an opening 120 and a duct body 110.

The opening 120 may correspond to the outlet opening 52 of the fan case 50. The opening 120 may communicate with the outlet opening 52. Air discharged through the outlet opening 52 may pass through the opening 120 of the guide duct 100 to be guided to the heat exchanger 20.

The duct body 110 may extend from the outlet opening 52 toward the heat exchanger 20 to guide air discharged through the outlet opening 52.

The duct body 110 may cover the opening 120. The duct body 110 may define the opening 120. The duct body 110 may form the opening 120.

For example, the duct body 110 may include an upper cover portion 111 protruding toward the heat exchanger 20 to cover an upper area of the opening 120. The duct body 110 may include side cover portions 112 and 113 extending downward from the upper cover portion 111 to cover side areas of the opening 120. The side cover portions 112 and 113 may include a first side cover portion 112 extending from one side of the upper cover portion 111 to cover one side area of the opening 120, and a second side cover portion 113 being opposite to the first side cover portion 112 and extending from the other side of the upper cover portion 111 to cover the other side area of the opening 120. The first side cover portion 112 may cover the left side area of the opening 120. The second side cover portion 113 may cover the right side area of the opening 120. For example, the air guide 200 may be provided between the first side cover portion 112 and the second side cover portion 113.

The duct body 110 may further include a lower cover portion 114 covering a lower area of the opening 120. The lower cover portion 114 may extend in the lateral direction to connect a lower side of the first side cover portion 112 with a lower side of the second side cover portion 113. The lower cover portion 114 may be opposite to the upper cover portion 111.

The duct body 110 may include at least one of the first side cover portion 112, the second side cover portion 113, or the lower cover portion 114, in some cases. The duct body 110 may include none of the first side cover portion 112, the second side cover portion 113, and the lower cover portion 114, in some cases. Details about this will be described below.

For example, the duct body 110 may include a support frame 115. The support frame 115 may be detachably installed on the partition 17. The support frame 115 may be in a shape of a plate having the opening 120. The upper cover portion 111 and the side cover portions 112 and 113 may extend from the support frame 115 toward the heat exchanger 20.

The guide duct 100 and the air guide 200 are also referred to as a guide device.

Figure 10:
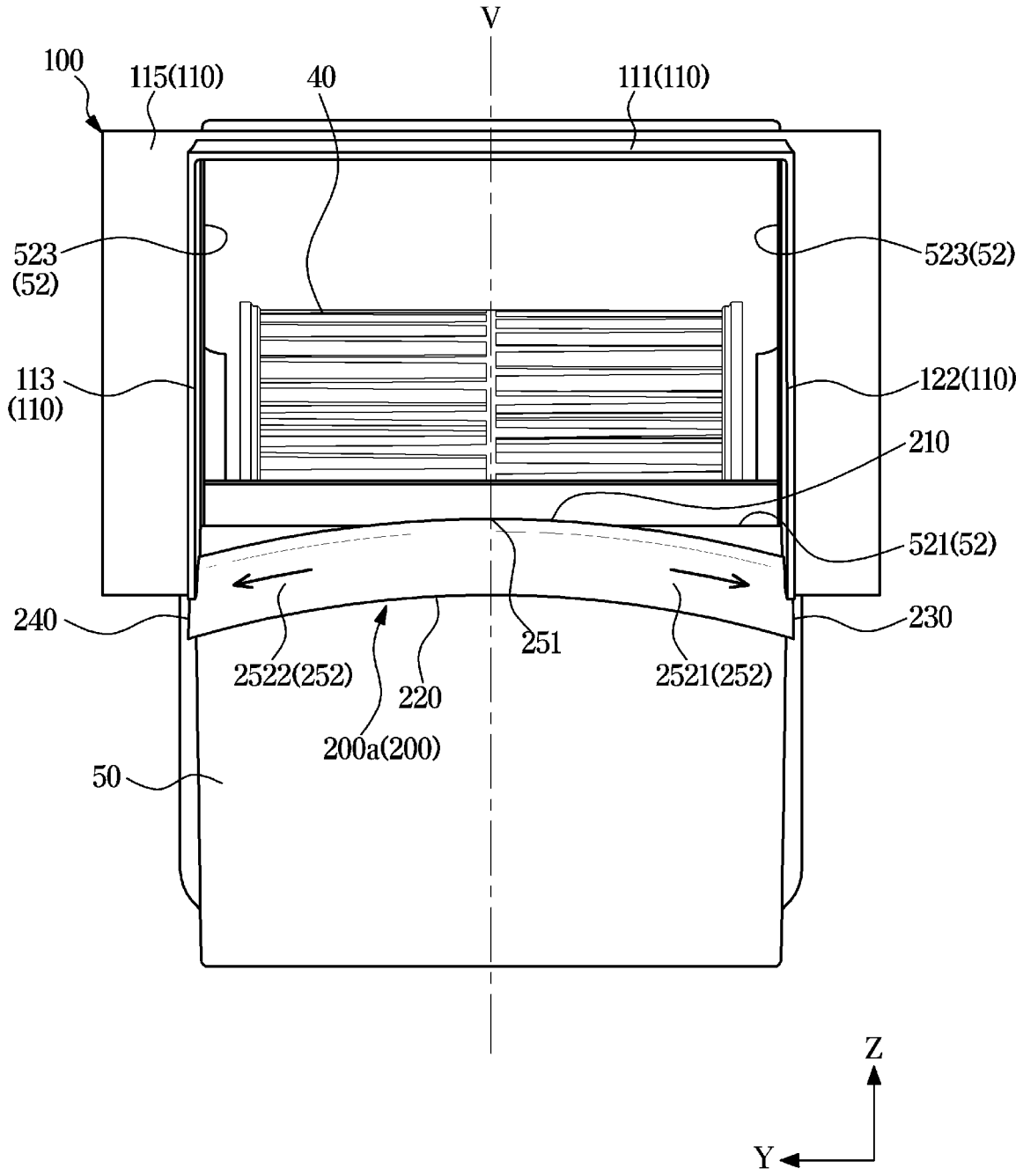
FIG. 10 is a side view of the blower shown in FIG. 7, seen in an X direction.
Figure 11:
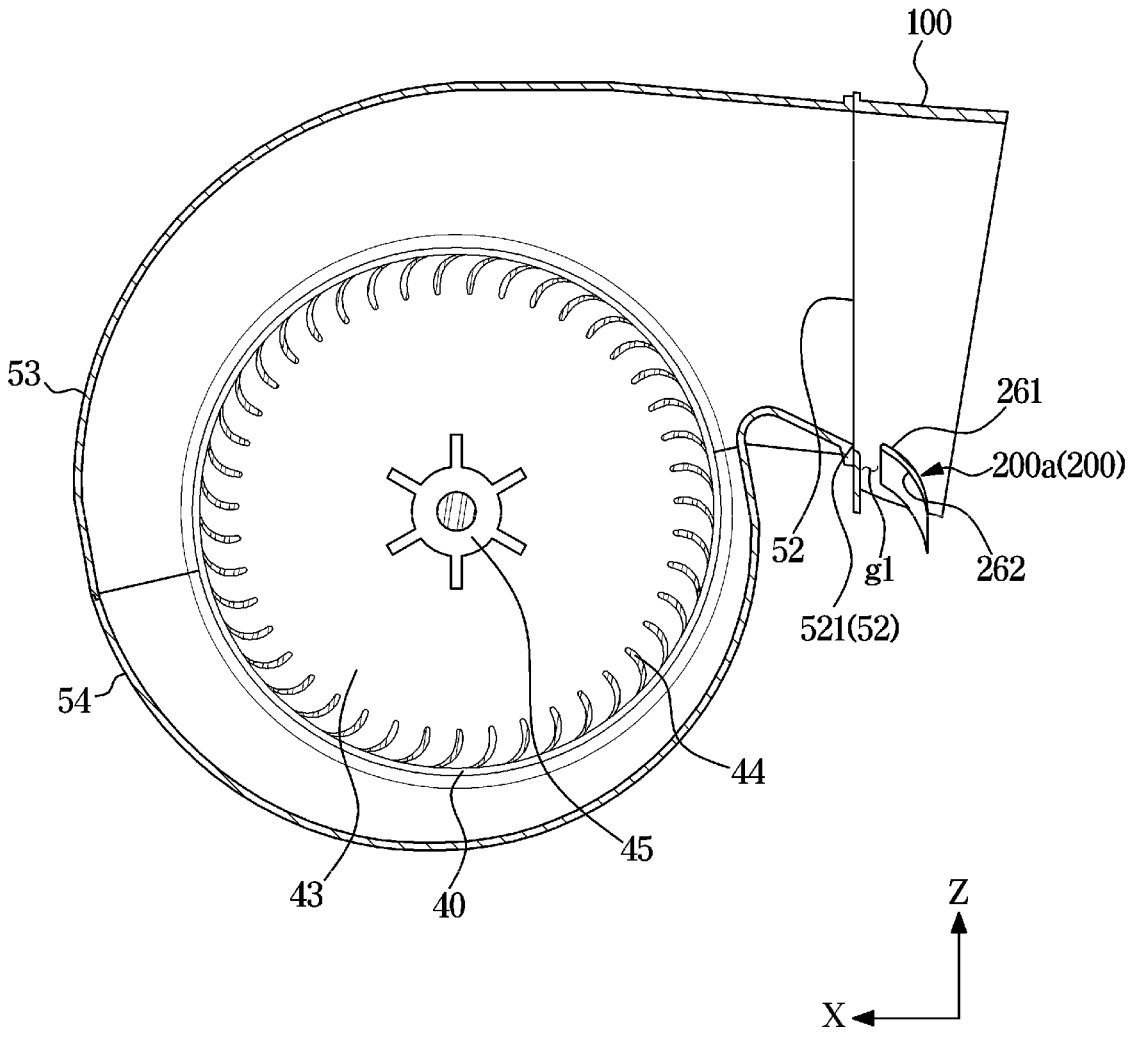
FIG. 11 is a cross-sectional view of the blower shown in FIG. 7, taken along the X-Z plane.
Figure 12:
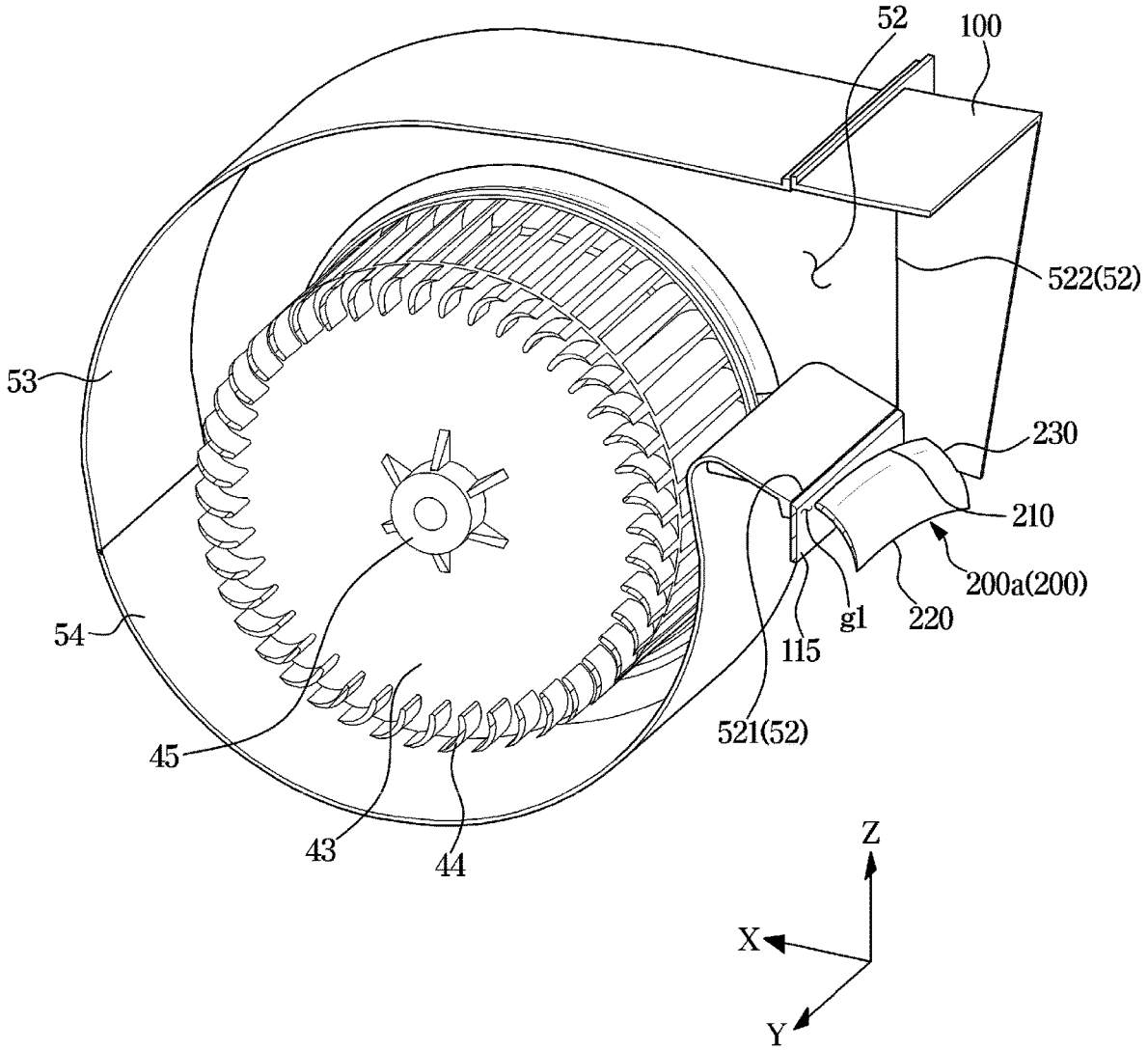
FIG. 12 is a perspective view of the blower shown in FIG. 7, taken along the X-Z plane.
Figure 13:
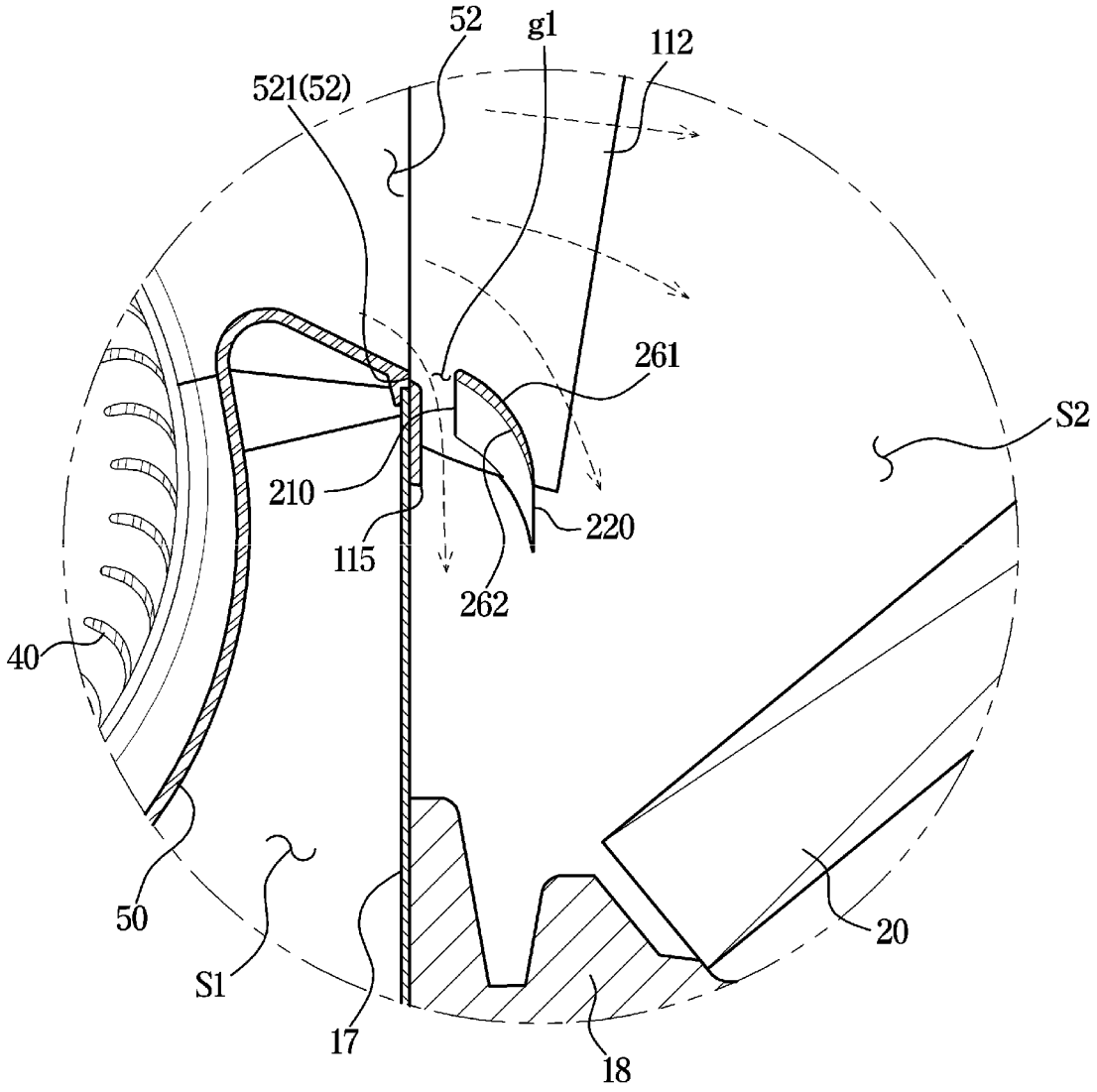
FIG. 13 is an enlarged view of an area A denoted in FIG. 3.

FIG. 10 is a side view of the blower shown in FIG. 7, seen in an X direction. FIG. 11 is a cross-sectional view of the blower shown in FIG. 7, taken along the X-Z plane. FIG. 12 is a perspective view of the blower shown in FIG. 7, taken along the X-Z plane. FIG. 13 is an enlarged view of an area A denoted in FIG. 3.

The air guide 200 may control a flow of air discharged from the outlet opening 52 of the fan case 50. In the blower including the guide duct 100, the air guide 200 may control a flow of air guided by the guide duct 100.

The air guide 200 may include a body 201 forming an outer appearance of the air guide 200. The body 201 may be substantially in a shape of a panel.

For example, the body 201 of the air guide 200 may extend in the lateral direction between the first side cover portion 112 and the second side cover portion 113 of the guide duct 100.

For example, the body 201 may include a first side portion 210 that is adjacent to the outlet opening 52 in the flow direction of air. The body 201 may include a second side portion 220 that is disposed away from the outlet opening 52 in the flow direction of air. The second side portion 220 may be opposite to the first side portion 210. The body 201 may include a third side portion 230 that is adjacent to the left wall 15 of the housing 10 in the lateral direction. The body 201 may include a fourth side portion 240 that is adjacent to the left wall 16 of the housing 10 in the lateral direction.

The air guide 200 may guide air discharged through the outlet opening 52 substantially in a down direction (−Z direction). The air guide 200 may be spaced from the lower end portion 521 of the outlet opening 52 in the flow direction of air. The air guide 200 may be spaced from the lower end portion 521 of the outlet opening 52 to form a first gap g1 through which air discharged through the outlet opening 52 flows.

For example, the first gap g1 may include a space formed between the lower end portion 521 of the outlet opening 52 and the air guide 200. The blower including the guide duct 100, the first gap g1 may include a space formed between the support frame 115 and the air guide 200.

Generally, in an air conditioner, during a process in which air flows upon blowing by a fan, the air may be concentrated onto some areas of a heat exchanger due to internal resistance (resistance of the heat exchanger) of the air conditioner. For example, the flow of air is concentrated onto an upper area of a heat exchanger, resulting in deterioration of heat-exchange performance at a lower area of the heat exchanger. That is, the entire heat-exchange performance of the heat exchanger may deteriorate. Also, vortex may be generated below an outlet opening of a fan case due to flow resistance. In this case, the generation of the vortex may cause a reduction of an air volume and an increase of blowing air noise due to flow loss of air.

To reduce the generation of vortex inside an air conditioner and uniformly blow air to the entire area of a heat exchanger, an outlet opening of a fan case has been designed to have a wide area, or a lower end portion (for example, a cut-off) of the outlet opening of the fan case has been designed to have a great angle of inclination. However, the wide outlet opening of the fan case deteriorates air-collecting performance of the fan case to lower blowing ability of the fan, although a flow rate distribution of air passing through the heat exchanger is improved. Also, although the great angle of inclination of the lower end portion of the outlet opening of the fan case induces air to flow downward to a certain degree to thus prevent a phenomenon in which the flow of air is concentrated onto some areas of a heat exchanger, it is difficult to unlimitedly increase the angle of inclination, and the lower end portion of the outlet opening causes a recirculation flow to generate more vortex.

The air guide 200 according to an embodiment of the disclosure may form the first gap g1 to guide air downward. The air guide 200 may induce air discharged through the outlet opening 52 to flow downward. The air guide 200 may guide a flow of air passed through the first gap g1 such that the air flows toward a lower area of the heat exchanger 20. The air guide 200 may prevent air discharged from the outlet opening 52 from flowing toward the fan assembly 30 without flowing toward the heat exchanger 20. That is, the air guide 200 may prevent air from circling at the lower end portion 521 of the outlet opening 52. Accordingly, generation of vortex at the lower end portion 521 of the outlet opening 52 of the fan case 50 may be prevented or reduced. As a result, because the generation of vortex is prevented or reduced, flow loss that is caused by such vortex may also deteriorate, which leads to an improvement of blowing ability of the fan and a reduction of blowing air noise. Also, the air guide 200 may prevent a flow of air from being concentrated onto some areas of the heat exchanger 20. As a result, the air guide 200 may guide air discharged from the outlet opening 52 to spread over the entire area of the heat exchanger 20. Thereby, the heat-exchange performance of the heat exchanger 20 may be improved.

The air guide 200 may include various shapes for inducing air discharged through the outlet opening 52 to flow in a preset direction. Hereinafter, an example 200*a* of the air guide 200 will be described with reference to FIG. 10. Various embodiments of the air guide 200 will be described below.

The air guide 200*a* may guide air discharged through the outlet opening 52 in the lateral direction. The air guide 200*a* may guide air discharged through the outlet opening 52 in a left-right direction (Y direction). The air guide 200*a* may diffuse air discharged through the outlet opening 52 in the lateral direction. The air guide 200*a* may extend in the lateral direction. The first gap g1 may extend along the lateral direction.

Referring to FIG. 10, the air guide 200*a* may include an inclined portion 252. The inclined portion 252 may be inclined downward toward an outer side in the lateral direction. For example, the air guide 200*a* may include a convex shape. The inclined portion 252 may include a shape curved downward toward the outer side in the lateral direction (see arrows of FIG. 10).

For example, the air guide 200*a* may include a center portion 251 and the inclined portion 252 inclined downward from the center portion 251 with respect to a center vertical line V. The inclined portion 252 may include a first inclined portion 2521 inclined downward in a left direction (−Y direction), and a second inclined portion 2522 inclined downward in a right direction (+X direction). However, this is only an example, and the inclined portion 252 may have any shape capable of guiding air in the lateral direction. For example, the inclined portion 252 may be not inclined with respect to the center portion 251, or one, three, or more inclined portions 252 may be provided. Also, although the inclined portion 252 is shown to have a symmetrical shape, the inclined portion 252 may have an asymmetrical shape.

Referring to FIG. 13, the air guide 200 may include a first guide surface 261 and a second guide surface 262.

The first guide surface 261 may be positioned toward the heat exchanger 20. The first guide surface 261 may guide air flowing toward the heat exchanger 20 by the guide duct 100. The first guide surface 261 may guide a main air current passing through the guide duct 100.

For example, the first guide surface 261 may be inclined downward toward the heat exchanger 20. The first guide surface 261 may be curved toward the heat exchanger 20. The first guide surface 261 may include a curved surface. The first guide surface 261 may include a curved shape.

For example, air discharged from the outlet opening 52 and moving through the guide duct 100 may flow while being in close contact with the first guide surface 261, by a Coanda effect.

The second guide surface 262 may be opposite to the first guide surface 261. The second guide surface 262 may guide air passed through the first gap g1. The second guide surface 262 may guide an auxiliary air current diverging from the main air current.

For example, air discharged from the outlet opening 52 and passed through the first gap g1 may flow while being in close contact with the second guide surface 262, by the Coanda effect.

For example, the second guide surface 262 may be inclined downward toward the heat exchanger 20. The second guide surface 262 may be curved toward the heat exchanger 20. The second guide surface 262 may include a curved surface. The second guide surface 262 may include a curved shape.

Referring to FIGS. 11 to 13, the air guide 200 may have a cross section of a streamlined shape.

For example, the first side portion 210 may include a round shape, and the second side portion 220 may include a sharp shape. The air guide 200 may be reduced in thickness from the first side portion 210 toward the second side portion 220. Therefore, the air guide 200 may reduce flow loss of air moving from the outlet opening 52 toward the heat exchanger 20. The air guide 200 may reduce flow loss of air flowing over the first guide surface 261 and the second guide surface 262.

FIGS. 14 to 33 show various embodiments of the air guide 200. The same components as those described above may be assigned the same reference numerals, and overlapping descriptions thereof will be omitted.

Figure 14:
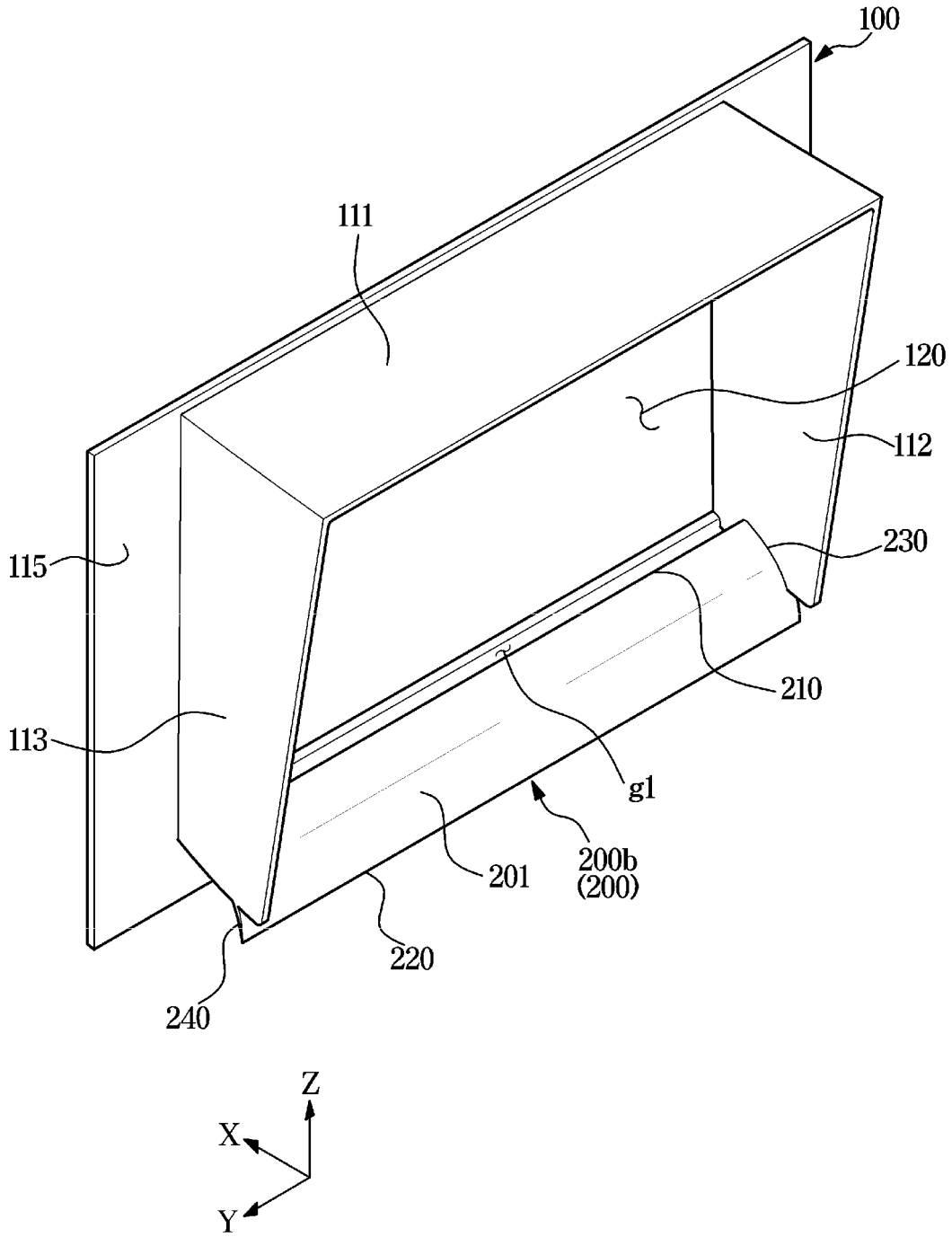
FIG. 14 is a perspective view showing an example of a guide device according to an embodiment of the disclosure.

Referring to FIG. 14, an air guide 200*b* may include a shape corresponding to the lateral direction. A first gap g1 may include a shape corresponding to the lateral direction. For example, compared to the air guide 200*a* described above, the air guide 200*b* may include no inclined portion 252.

Figure 15:
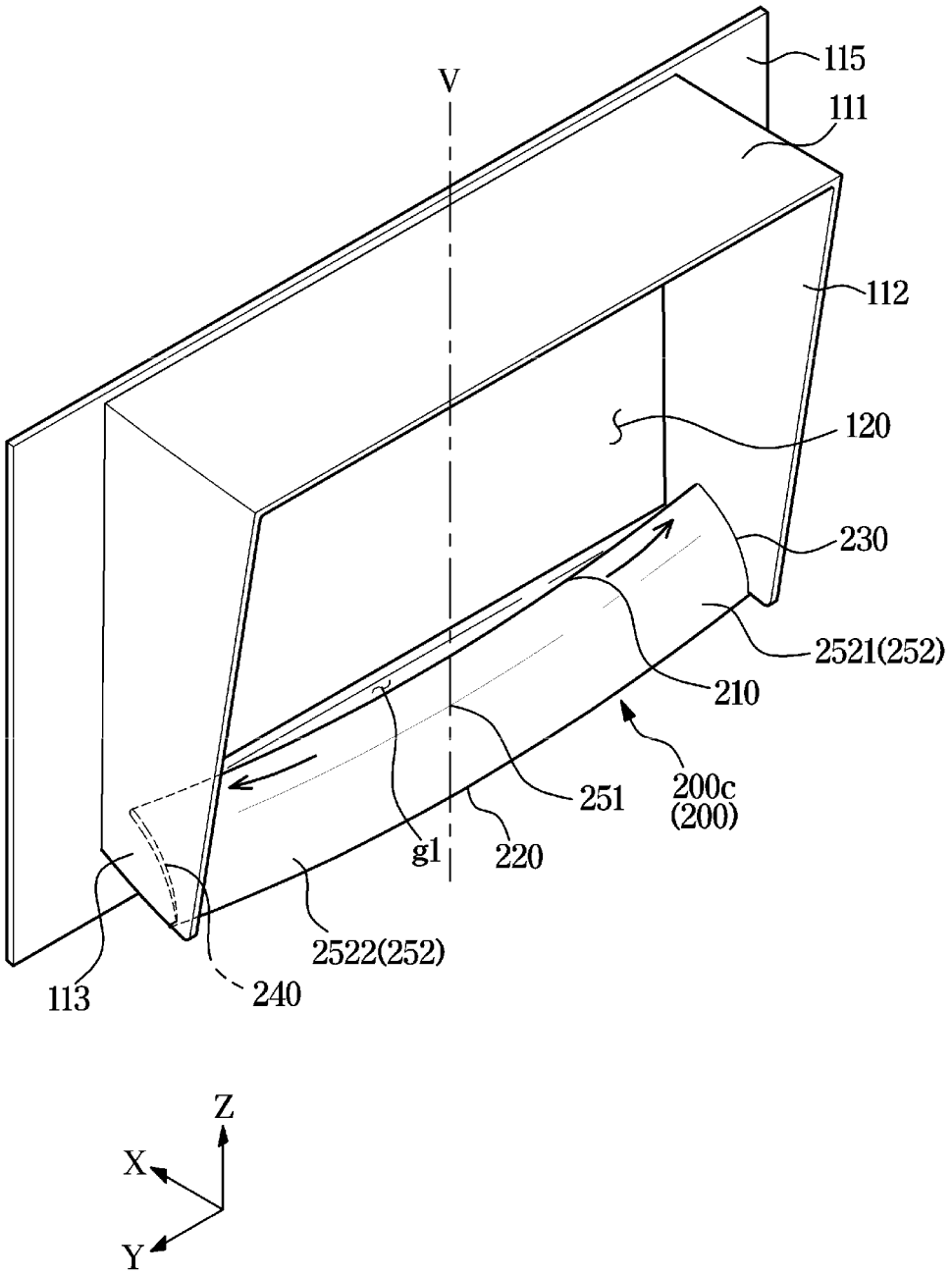
FIG. 15 is a perspective view showing an example of a guide device according to an embodiment of the disclosure.

Referring to FIG. 15, an air guide 200*c* may include an inclined portion 252 inclined upward toward an outer side in the lateral direction. For example, the air guide 200*c* may include a concave shape. The inclined portion 252 may include a shape curved upward toward an outer side in the lateral direction (see arrows of FIG. 15).

For example, the air guide 200*c* may include a center portion 251 and the inclined portion 252 inclined upward from the center portion 251 with respect to a center vertical line V. The inclined portion 252 may include a first inclined portion 2521 inclined upward in the left direction (—Y direction) and a second inclined portion 2522 inclined upward in the right direction (+Y direction). However, this is only an example, and the inclined portion 2522 may have various shapes.

Compared to the air guide 200*a* described above, the air guide 200*c* may collect air discharged from an outlet opening 52. For example, in a case in which a heat exchanger 20 is relatively smaller than a fan assembly 30 or a size of a second space S2 in which the heat exchanger 20 is positioned is relatively smaller than a size of a first space S1 in which the fan assembly 30 is positioned, the above-described example of the air guide 200*c* may be provided in the air conditioner 1 to improve a blowing force of the fan assembly 30.

Figure 16:
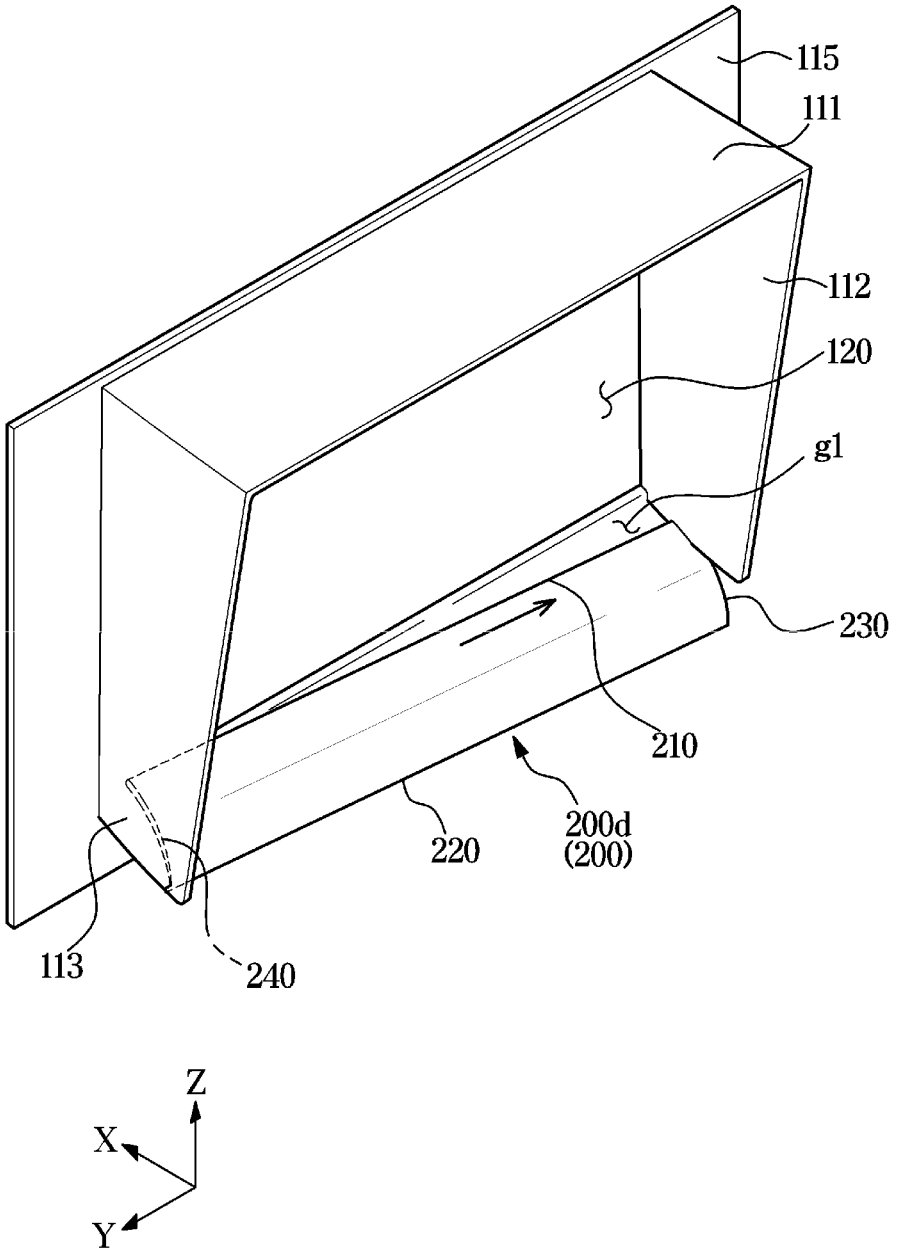
FIG. 16 is a perspective view showing an example of a guide device according to an embodiment of the disclosure.
Figure 17:
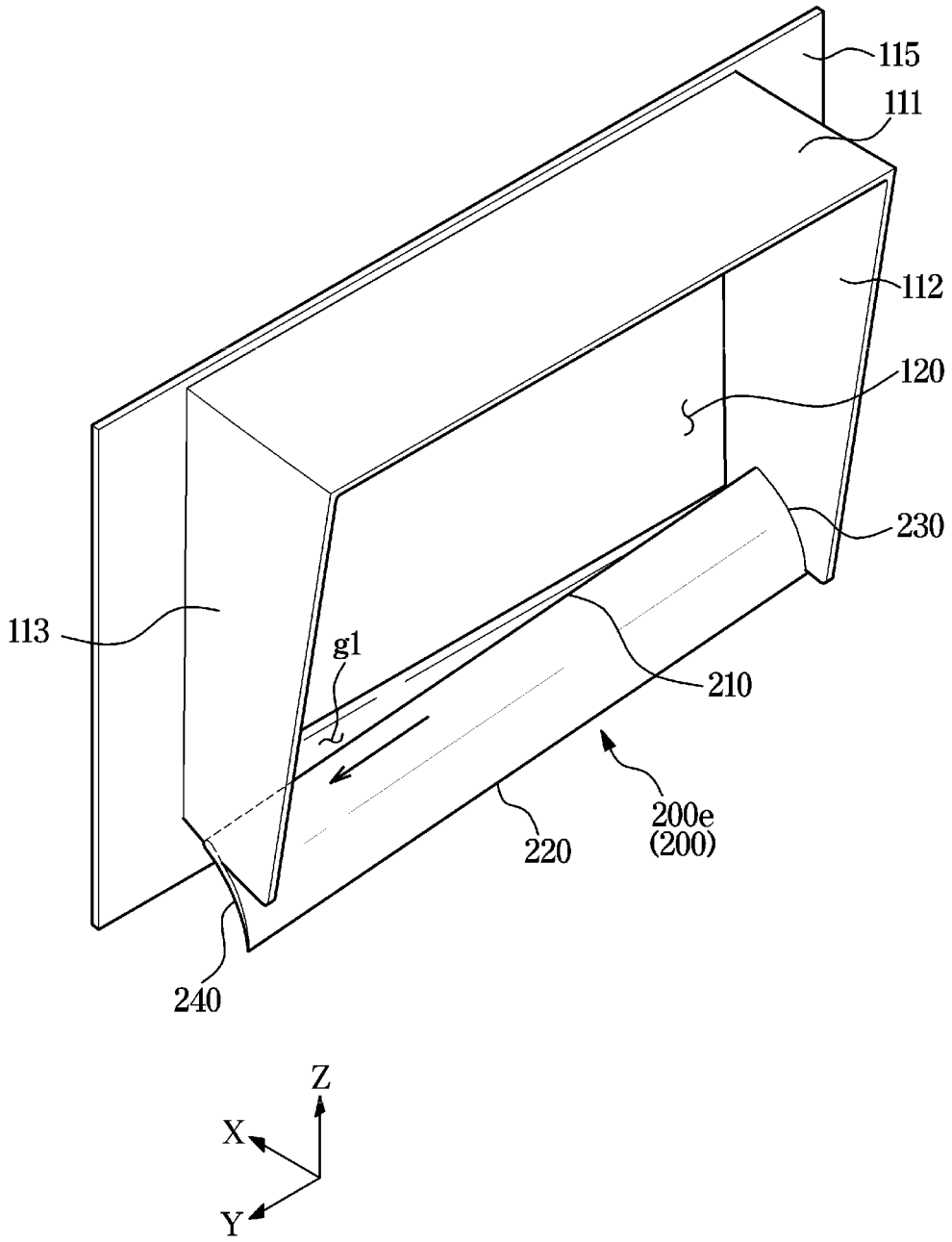
FIG. 17 is a perspective view showing an example of a guide device according to an embodiment of the disclosure.

Referring to FIGS. 16 and 17, air guides 200*d* and 200*e* may be positioned such that one sides in the lateral direction are lower than the other sides being opposite to the one sides.

Therefore, the air guides 200*d* and 200*e* may induce air to flow to the one sides positioned at a relatively lower location. The air conditioner 1 may include the air guides 200*d* and 200*e* to guide air to a preset direction. For example, a user may position the air guides 200*d* and 200*e* appropriately by considering an installation environment of the air conditioner 1, internal components of the air conditioner 1, a specification of a connection duct, etc.

For example, referring to FIG. 16, the air guide 200*d* may be inclined downward in the left direction (see an arrow of FIG. 16). A third side portion 230 of the air guide 200*d* may be positioned at a lower location than a fourth side portion 240. Therefore, air discharged through an outlet opening 52 may be induced to flow in the left direction by the air guide 200*d*.

For example, referring to FIG. 17, the air guide 200*e* may be inclined downward in the right direction (see an arrow of FIG. 17). A fourth side portion 240 of the air guide 200*e* may be positioned at a lower location than a third side portion 230. Therefore, air discharged through an outlet opening 52 may be induced to flow in the right direction by the air guide 200*e*.

Figure 18:
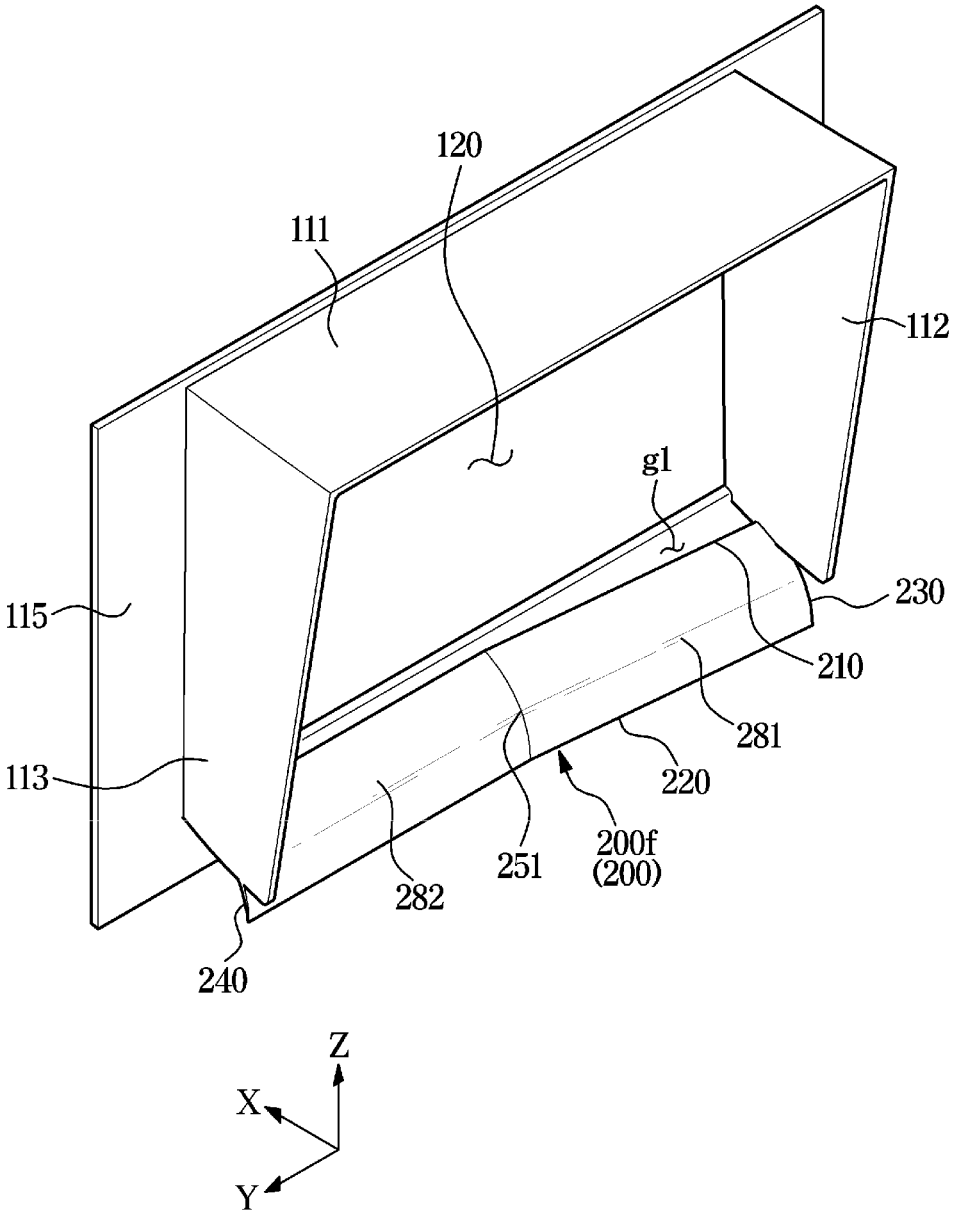
FIG. 18 is a perspective view showing an example of a guide device according to an embodiment of the disclosure.

Referring to FIG. 18, compared to the air guide 200*d* described above, a portion of an air guide 200*f* may be inclined downward in the left direction. The air guide 200*f* may induce air discharged through an outlet opening 52 to flow in the left direction.

For example, the air guide 200*f* may include a left body 281 extending toward the left direction from a center portion 251. The left body 281 may be inclined downward toward an outer side in the lateral direction from the center portion 251, although not limited thereto. However, the left body 281 may be inclined downward in the left direction from a certain point, not the center portion 251.

Figure 19:
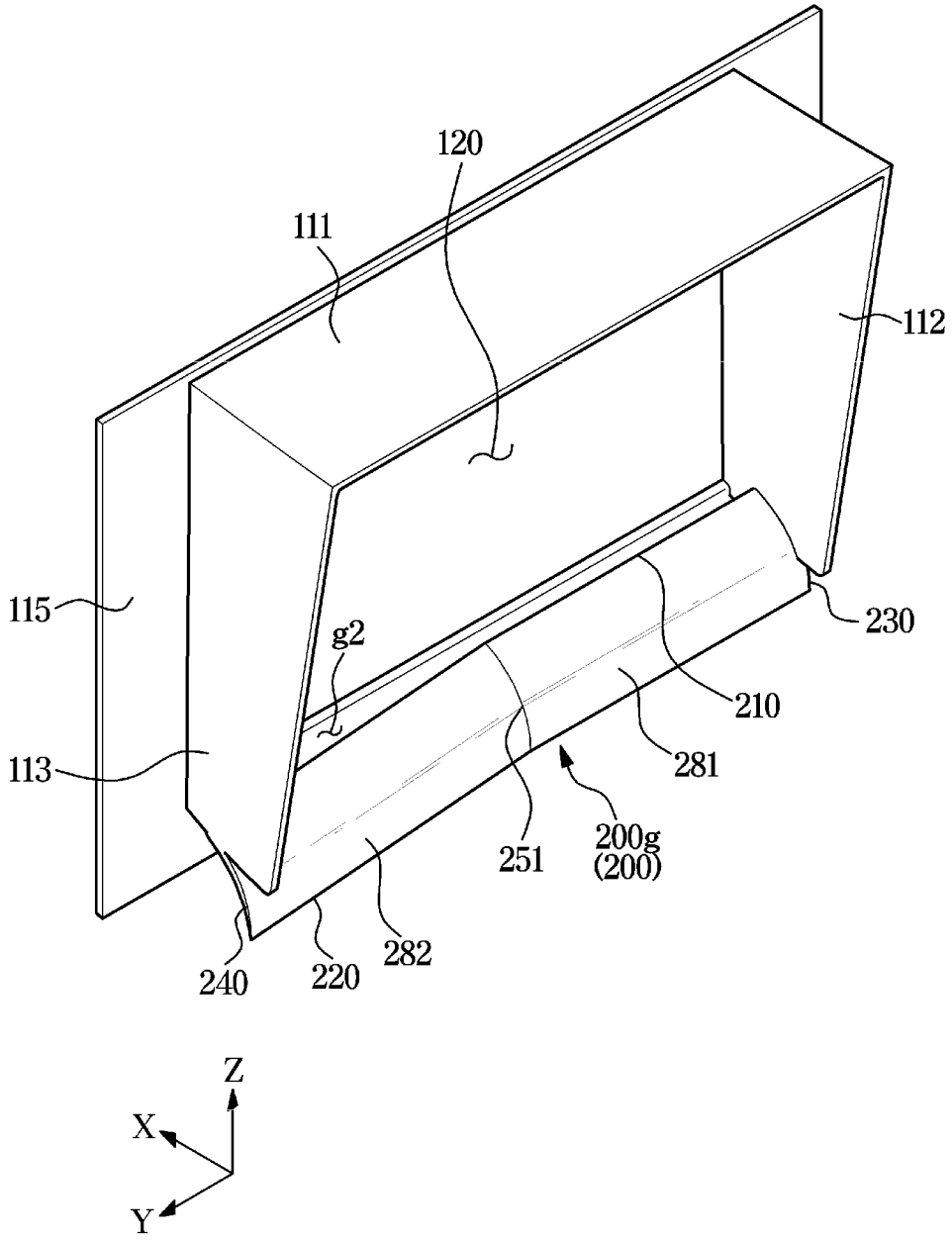
FIG. 19 is a perspective view showing an example of a guide device according to an embodiment of the disclosure.

Referring to FIG. 19, compared to the air guide 200*e* described above, a portion of an air guide 200*g* may be inclined downward in the right direction. The air guide 200*g* may induce air discharged through an outlet opening 52 to flow in the right direction.

For example, the air guide 200*g* may include a right body 282 extending toward the right direction from a center portion 251. The right body 282 may be inclined downward toward an outer side in the lateral direction from the center portion 251, although not limited thereto. However, the right body 282 may be inclined downward in the left direction from a certain point, not the center portion 251.

Figure 20:
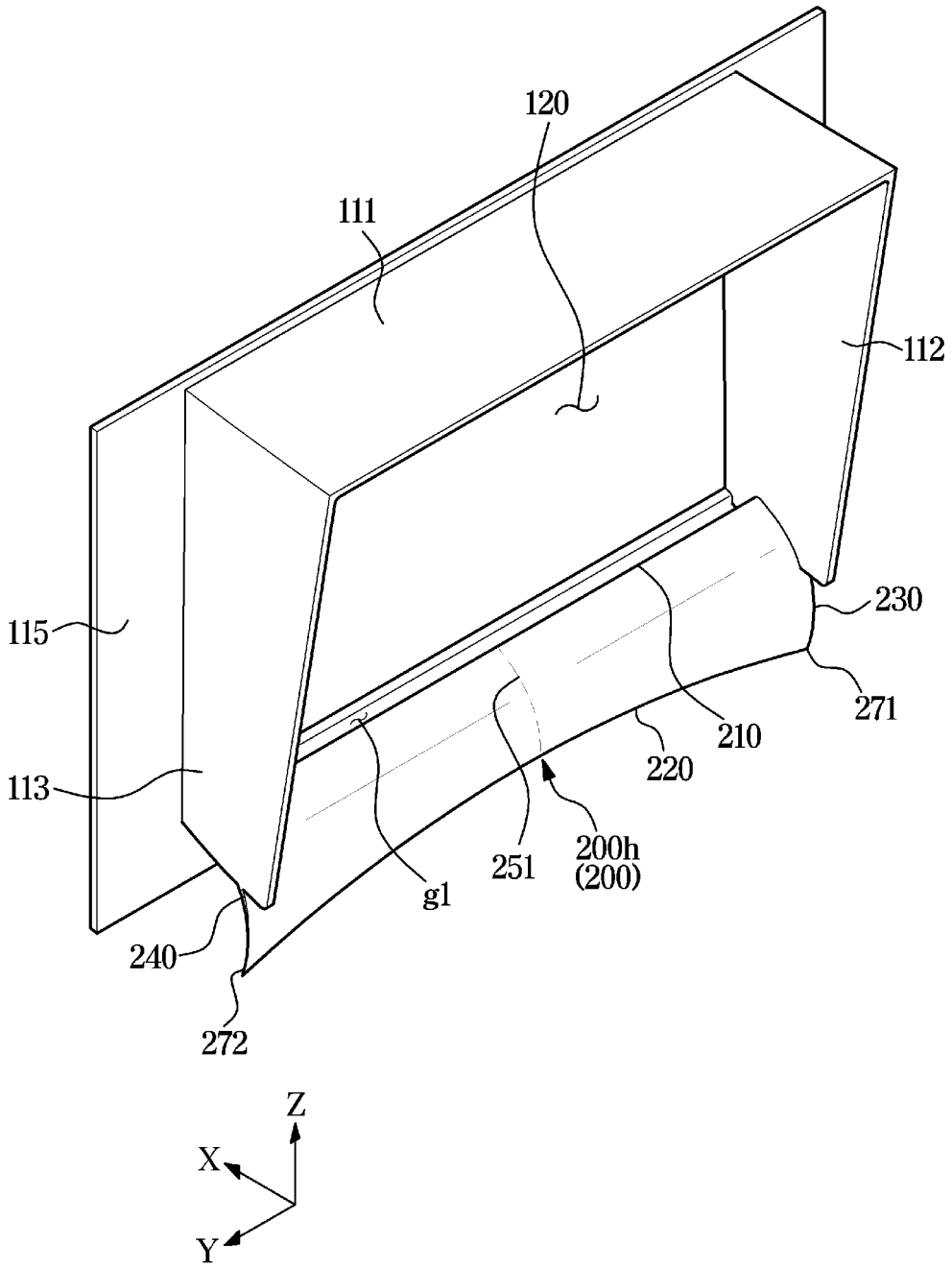
FIG. 20 is a perspective view showing an example of a guide device according to an embodiment of the disclosure.

Referring to FIG. 20, compared to the air guide 200*b* described above, left and right ends of an air guide 200*h* may be expanded. For example, a first corner portion 271 between a third side portion 230 and a second side portion 220 and a second corner portion 272 between a fourth side portion 240 and a second side portion 220 may protrude to a lower location than the center portion 251. Therefore, the air guide 200*h* may guide air discharged through the outlet opening 52 to flow to the first corner portion 271 and the second corner portion 272.

Referring to FIGS. 21 to 29, air guides 200*i*, 200*j*, and 200*k* may include a three-dimensional shape. The air guides 200*i*, 200*j*, and 200*k* may include a twist shape.

Figure 21:
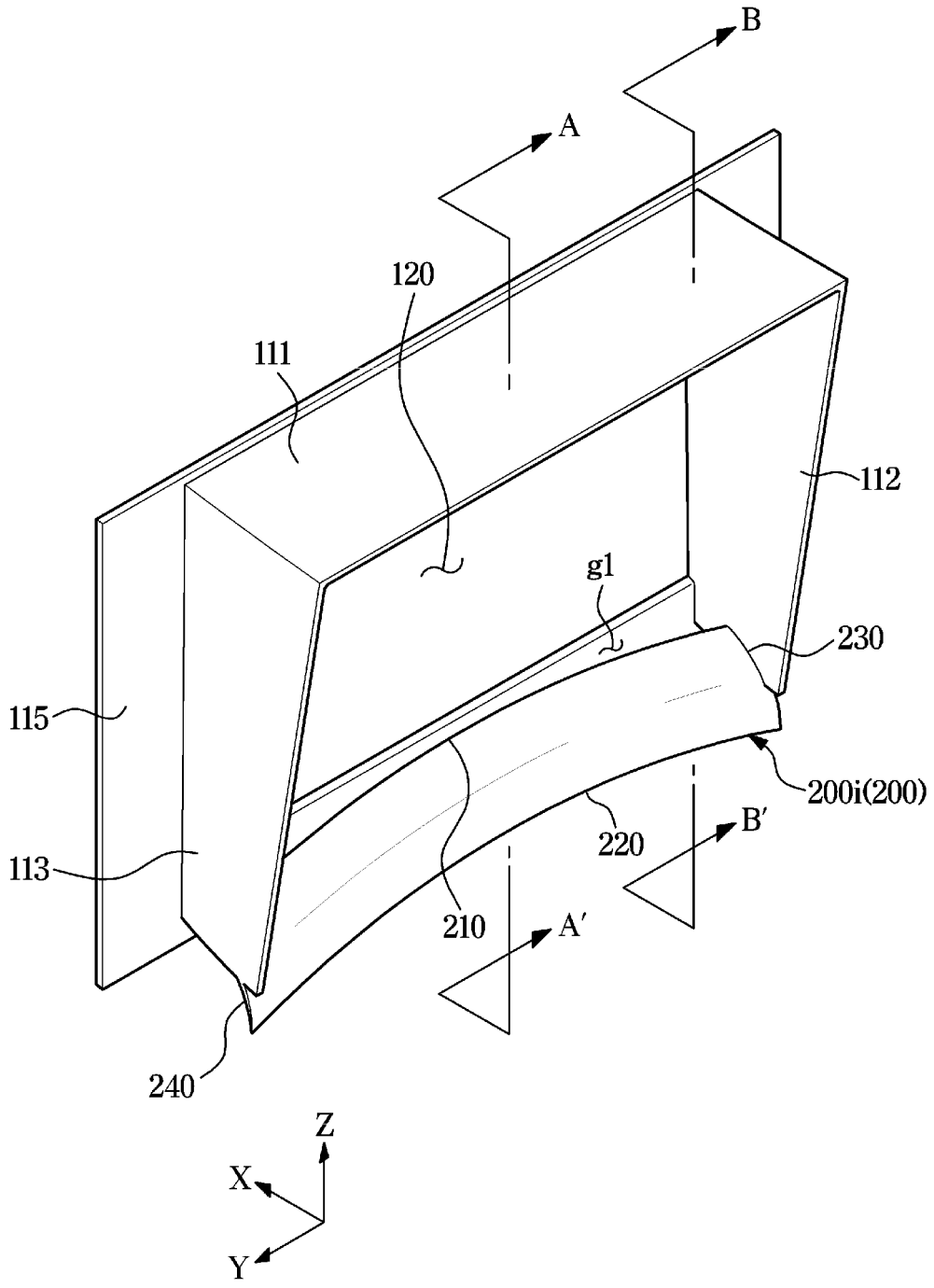
FIG. 21 is a perspective view showing an example of a guide device according to an embodiment of the disclosure.

Referring to FIG. 21, the air guide 200*i* may include a shape inclined downward toward an outer side in the lateral direction. The air guide 200*i* may include a shape curved downward toward the outer side in the lateral direction. The air guide 200*i* may include a convex shape. For example, the air guide 200*i* may include a shape that is symmetrical with respect to a center portion in the lateral direction.

Figure 22:
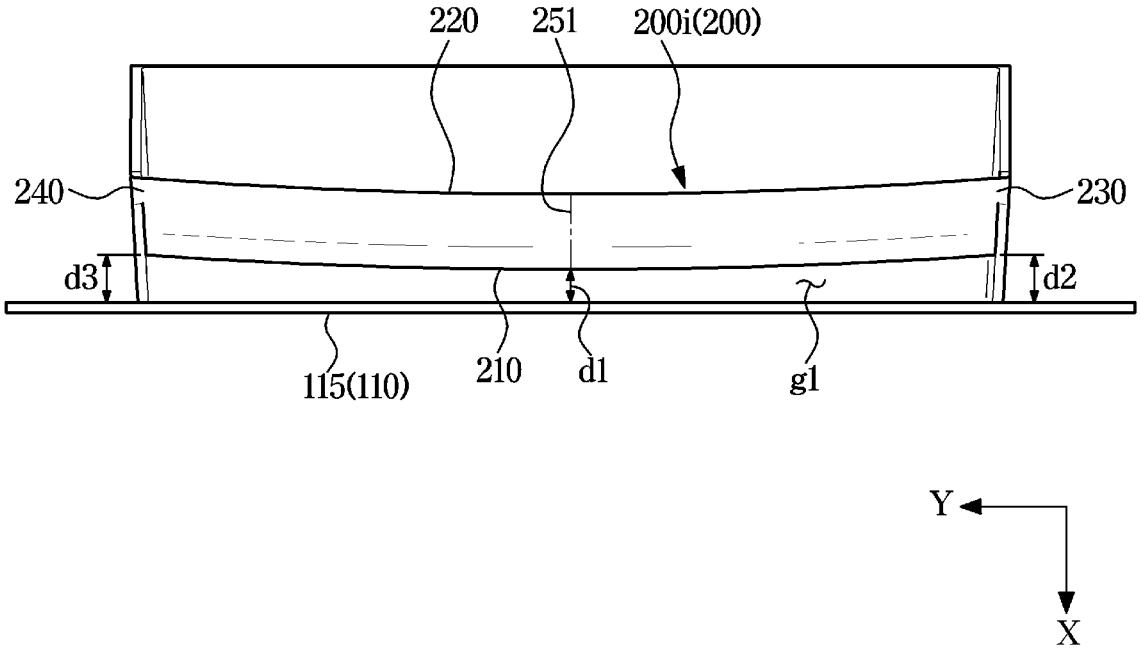
FIG. 22 is a bottom view of the guide device shown in FIG. 21.

Referring to FIG. 22, a size of a first gap g1 may change. For example, a first side portion 210 may be bent along the lateral direction. The first side portion 210 may be curved along the lateral direction.

The air guide 200*i* may form the first gap g1 to smoothly guide air along the lateral direction. For example, a length d2 of the first gap g1 being adjacent to a third side portion 230 may be greater than a length of the first gap g1 at a center portion. A length d3 of the first gap g1 being adjacent to a fourth side portion 240 may be greater than the length d1 of the first gap g1 at the center portion. Therefore, air discharged through the outlet opening 52 may be induced to flow to the first gap g1 formed with a relatively great size. For example, a flow rate of air passing through the first gap g1 having the relatively great size may be greater than a flow rate of air passing through the first gap g1 (for example, the first gap g1 having the length d1) having a relatively small size. That is, air discharged through the outlet opening 52 may be diffused in left and right directions while passing through the first gap g1 formed by the air guide 200*i*.

Figure 23:
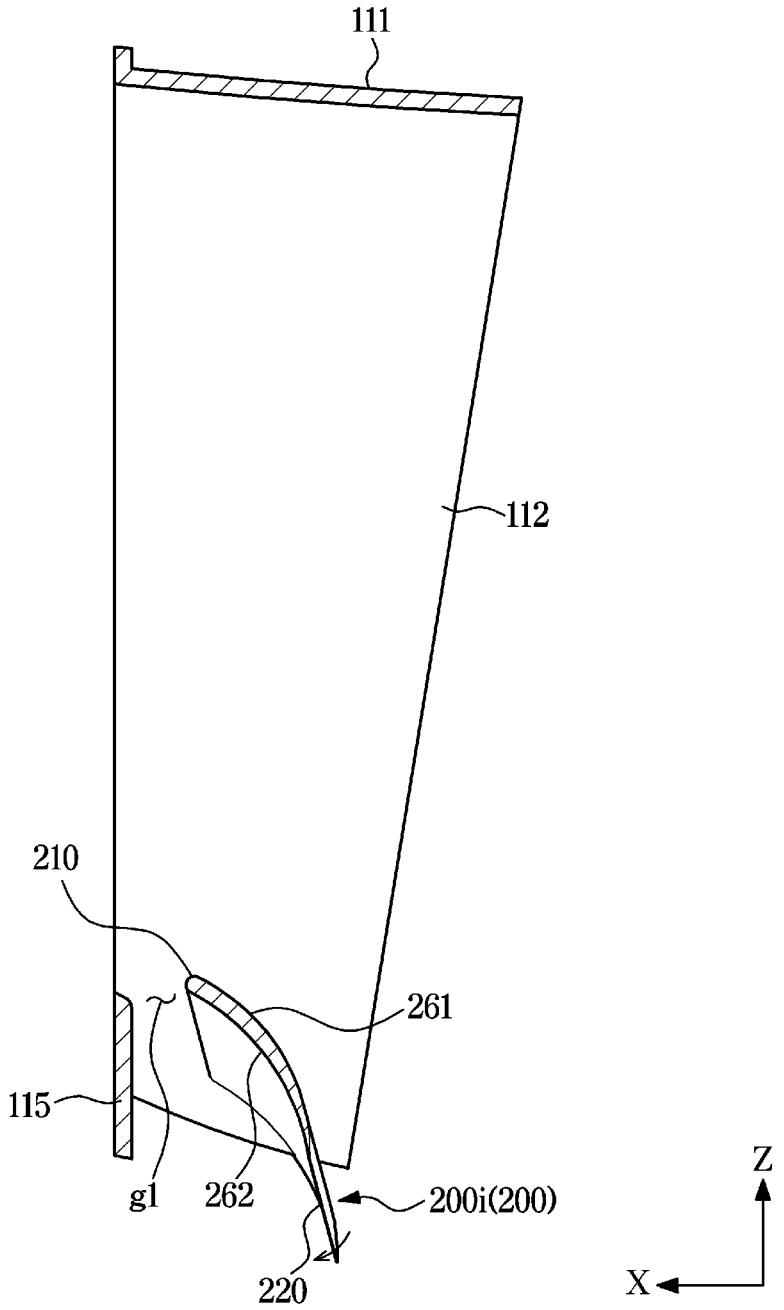
FIG. 23 is a cross-sectional view taken along line A-A' denoted in FIG. 21.
Figure 24:
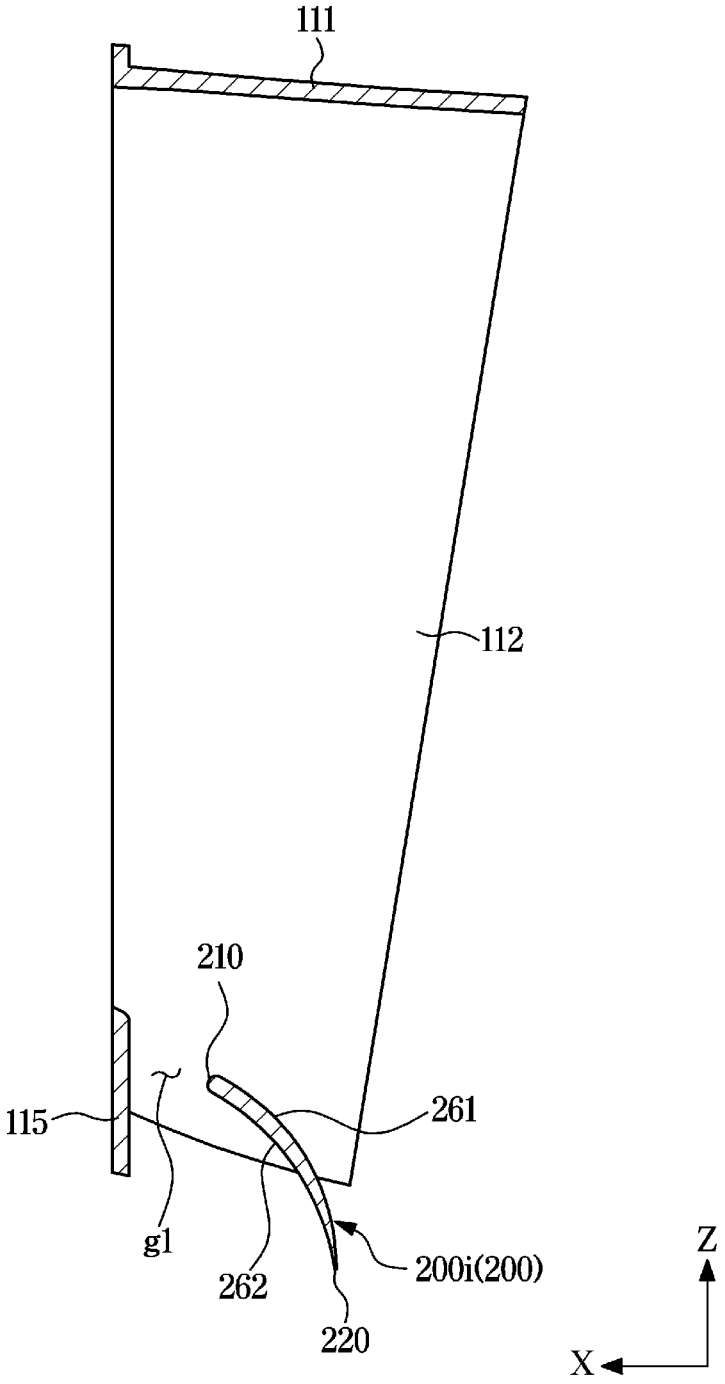
FIG. 24 is a cross-sectional view taken along line B-B' denoted in FIG. 21.

Referring to FIGS. 23 and 24, a cross section of the air guide 200*i* may change. For example, a shape of the air guide 200*i* may change along the lateral direction.

For example, a shape (see FIG. 23) of the air guide 200*i*, taken along line A-A' of FIG. 21 may be different from a shape (see FIG. 24) of the air guide 200*i*, taken along line B-B' of FIG. 21.

For example, a curvature of a first guide surface 261 shown in FIG. 23 may be different from a curvature of the first guide surface 261 shown in FIG. 24. A curvature of a second guide surface 262 shown in FIG. 23 may be different from a curvature of the second guide surface 262 shown in FIG. 24.

For example, referring to FIG. 23, a second side portion 220 may be bent toward an inner side in the lateral direction (see an arrow of FIG. 23). The second side portion 220 may include a shape twisted toward the inner side in the lateral direction.

Figure 25:
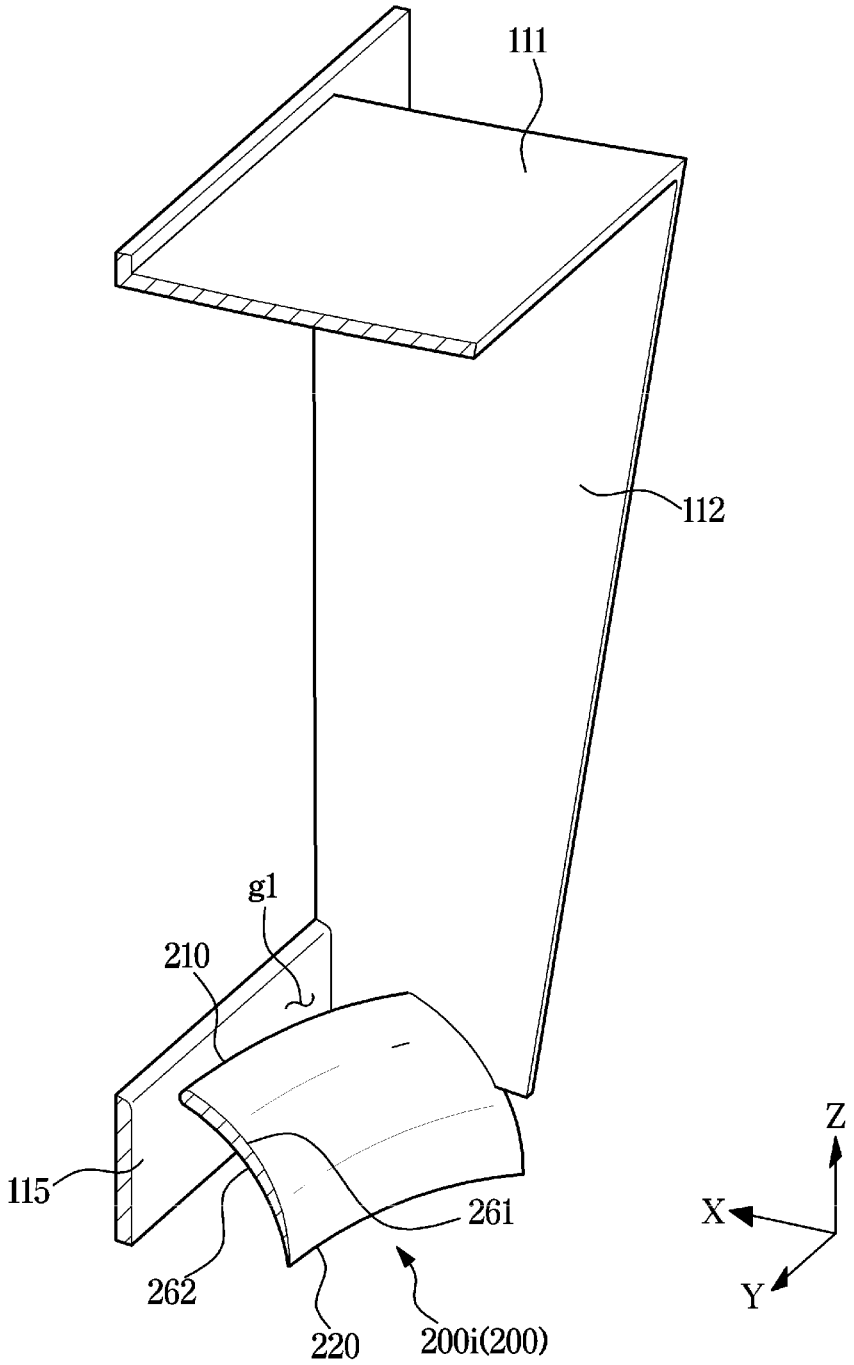
FIG. 25 is a cutout perspective view of the guide device shown in FIG. 21.

For example, referring to FIG. 25, a first side portion 210 may be closer to a support frame 115 at a position being closer to a center portion in lateral direction of the air guide 200*i*. That is, the first side portion 210 may be bent to be more adjacent to the outlet opening 52 at a position being closer to the center portion in the lateral direction. A second side portion 220 may be closer to the support frame 115 at a position being closer to the center portion in lateral direction of the air guide 200*i*. That is, the second side portion 220 may be bent to be more adjacent to the outlet opening 52 at a position being closer to the center portion in the lateral direction. Accordingly, the size of the first gap g1 may change along the lateral direction. However, unlike FIG. 25, the first side portion 210 may be more distant from the support frame 115 at a position being closer to the center portion in lateral direction of the air guide 200*i*. That is, the first side portion 210 may be bent to be more distant from the outlet opening 52 at a position being closer to the center portion in the lateral direction. A second side portion 220 may be more distant from the support frame 115 at a position being closer to the center portion in lateral direction of the air guide 200*i*. That is, the second side portion 210 may be bent to be more distant from the outlet opening 52 at a position being closer to the center portion in the lateral direction. Or, the first side portion 210 may be bent to be closer to the outlet opening 52 at a position being closer to the center portion in lateral direction of the air guide 200*i*, and the second side portion 220 may be bent to be more distant from the outlet opening 52 at a position being closer to the center portion in lateral direction of the air guide 200*i*. Or, the first side portion 210 may be bent to be more distant from the outlet opening 52 at a position being closer to the center portion in lateral direction of the air guide 200*i*, and the second side portion 220 may be bent to be closer to the outlet opening 52 at a position being closer to the center portion in lateral direction of the air guide 200*i*.

Figure 26:
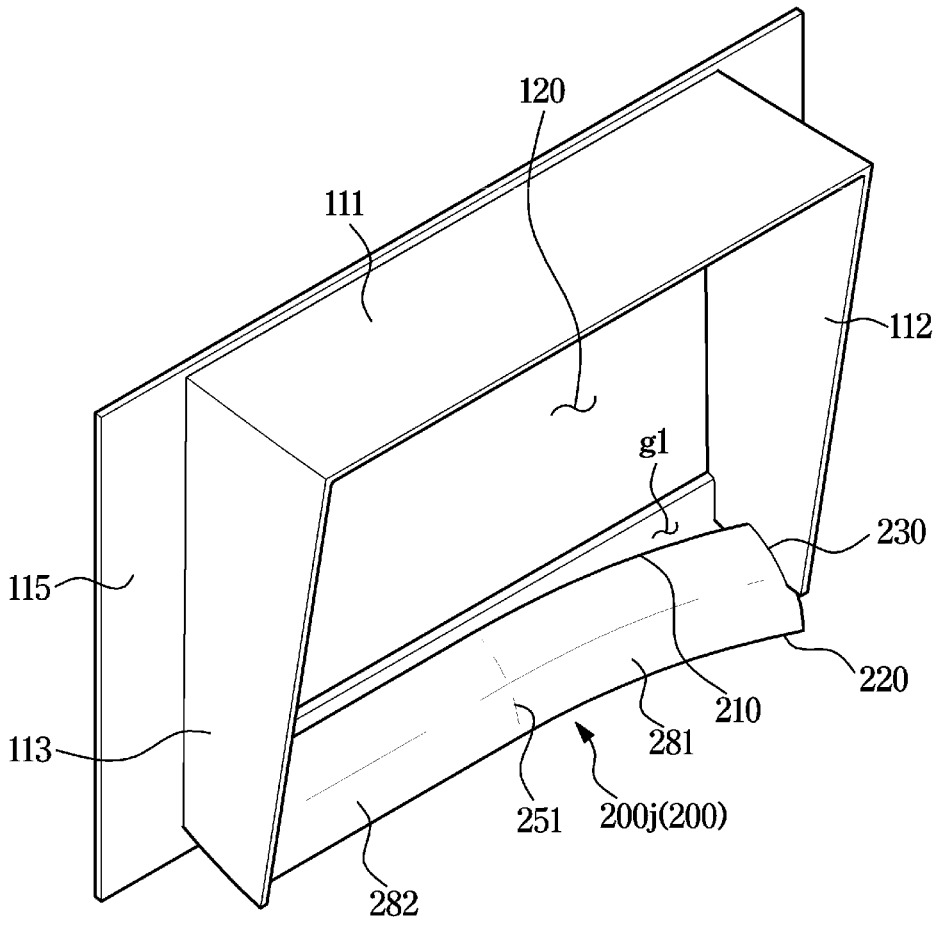
FIG. 26 is a perspective view showing an example of a guide device according to an embodiment of the disclosure.

Referring to FIG. 26, the air guide 200*j* may include a shape inclined downward toward the left direction. The air guide 200*j* may include a shape curved downward toward the left direction. A portion of the air guide 200*j* may include a curved shape. For example, the air guide 200*j* may include a shape that is asymmetrical with respect to the center portion in the lateral direction.

Figure 27:
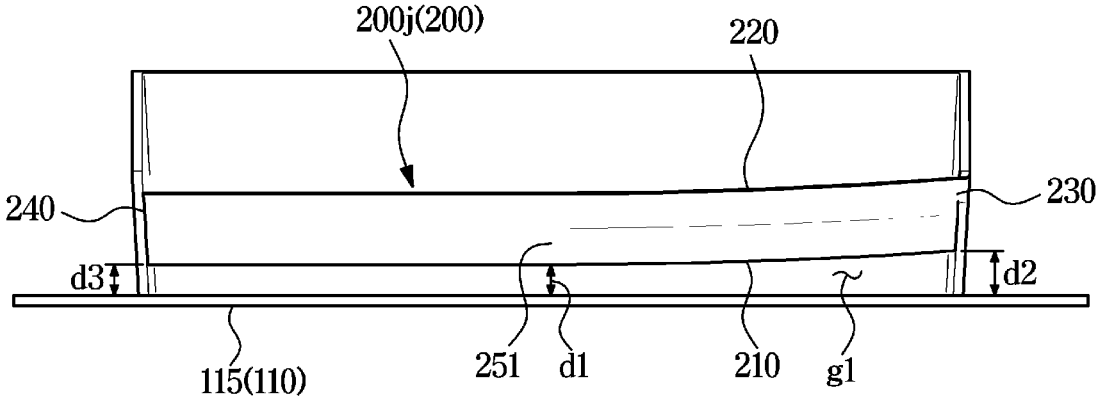
FIG. 27 is a bottom view of the guide device shown in FIG. 26.

Referring to FIG. 27, a size of a first gap g1 may change. For example, a length d2 of the first gap g1 being adjacent to a third side portion 230 may be greater than a length d1 of the first gap g1 at a center portion. The length d2 of the first gap g1 being adjacent to the third side portion 230 may be greater than a length d3 of the first gap g1 being adjacent to a fourth side portion 240. Therefore, air discharged through the outlet opening 52 may be induced to flow in the left direction.

Figure 28:
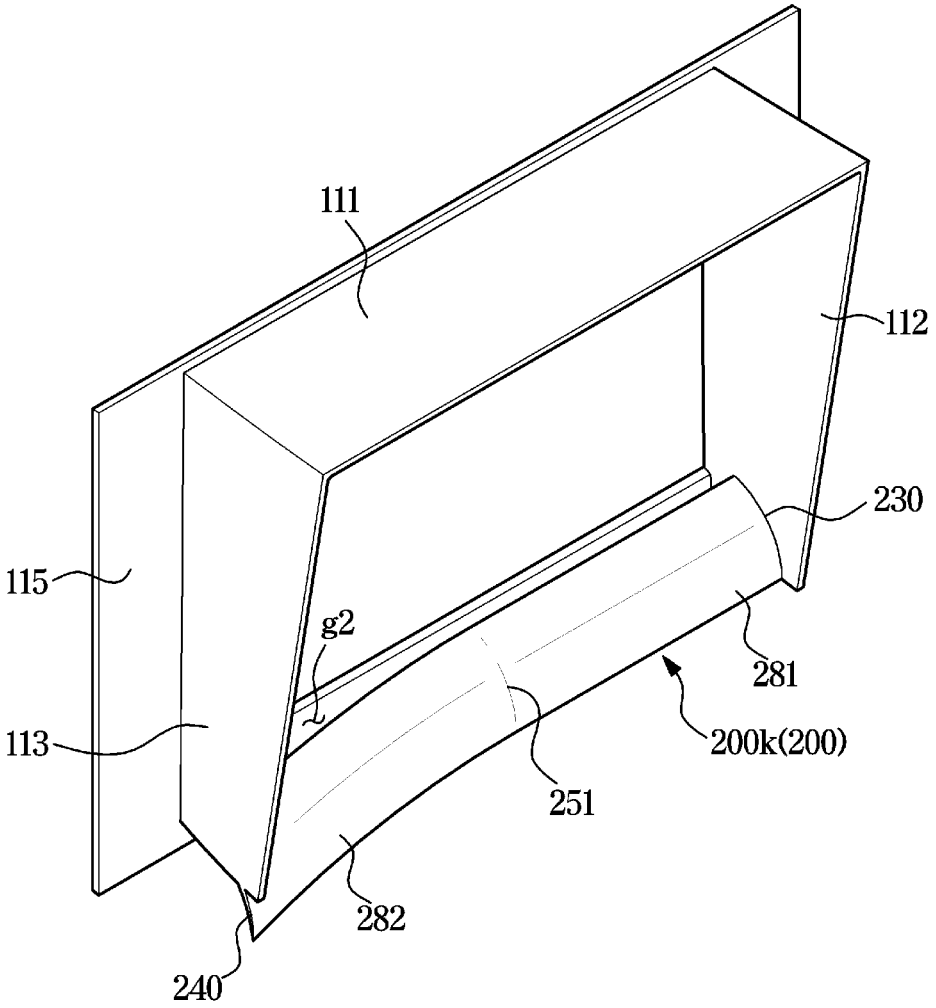
FIG. 28 is a perspective view showing an example of a guide device according to an embodiment of the disclosure.

Referring to FIG. 28, the air guide 200*k* may include a shape inclined downward toward the right direction. The air guide 200*k* may include a shape curved downward toward the right direction. A portion of the air guide 200*k* may include a curved shape. For example, the air guide 200*k* may include a shape that is asymmetrical with respect to the center portion in the lateral direction.

Figure 29:
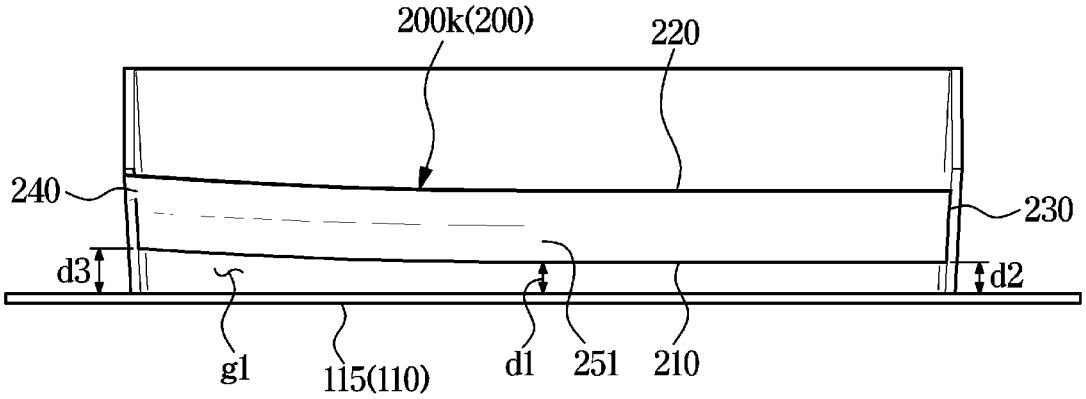
FIG. 29 is a bottom view of the guide device shown in FIG. 28.
Figure 30:
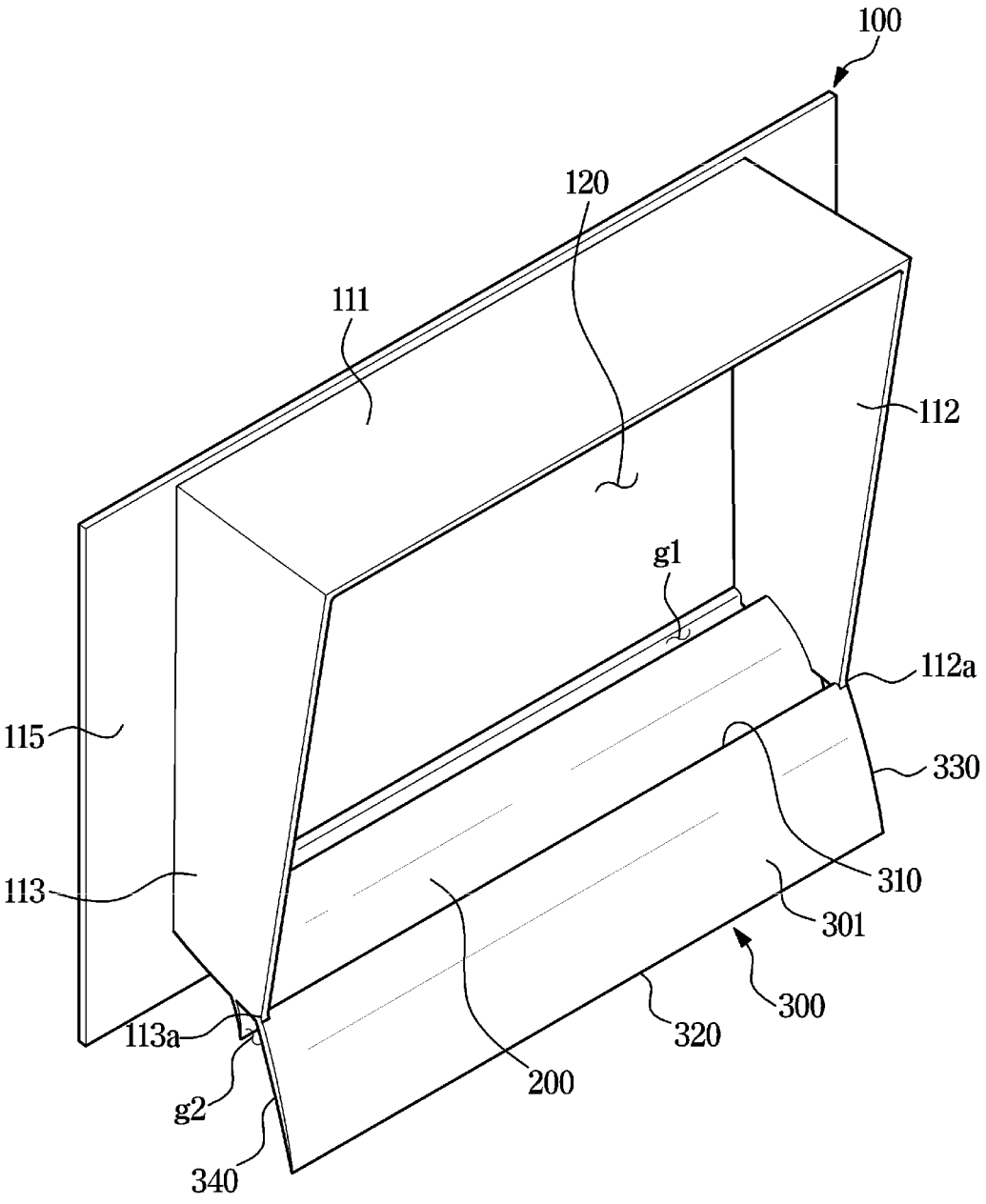
FIG. 30 is a perspective view showing an example of a guide device according to an embodiment of the disclosure.
Figure 31:
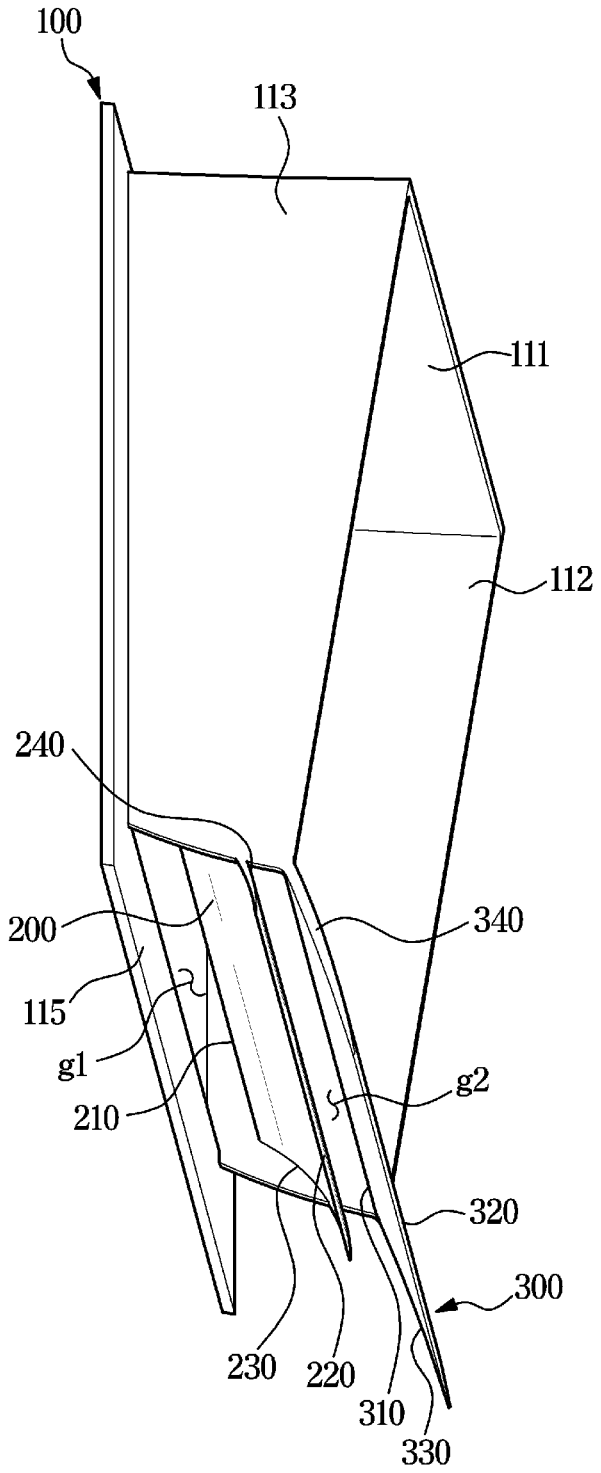
FIG. 31 is a bottom perspective view of the guide device shown in FIG. 30.
Figure 32:
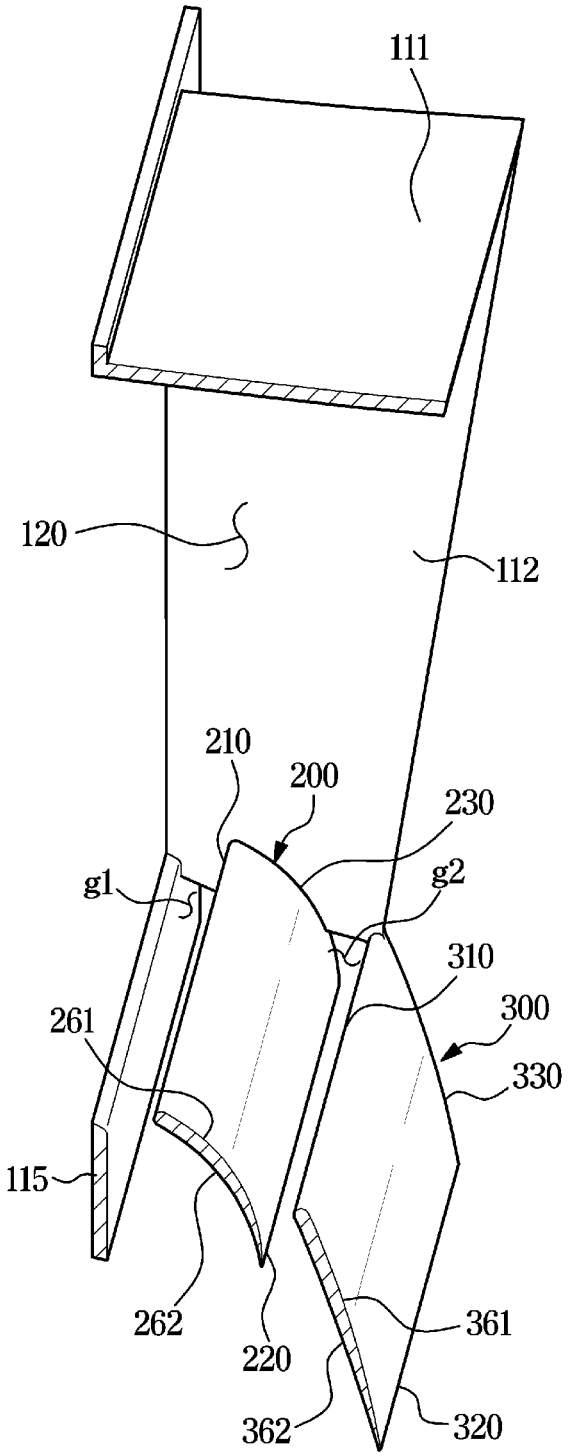
FIG. 32 is a cutout perspective view of the guide device shown in FIG. 30.
Figure 33:
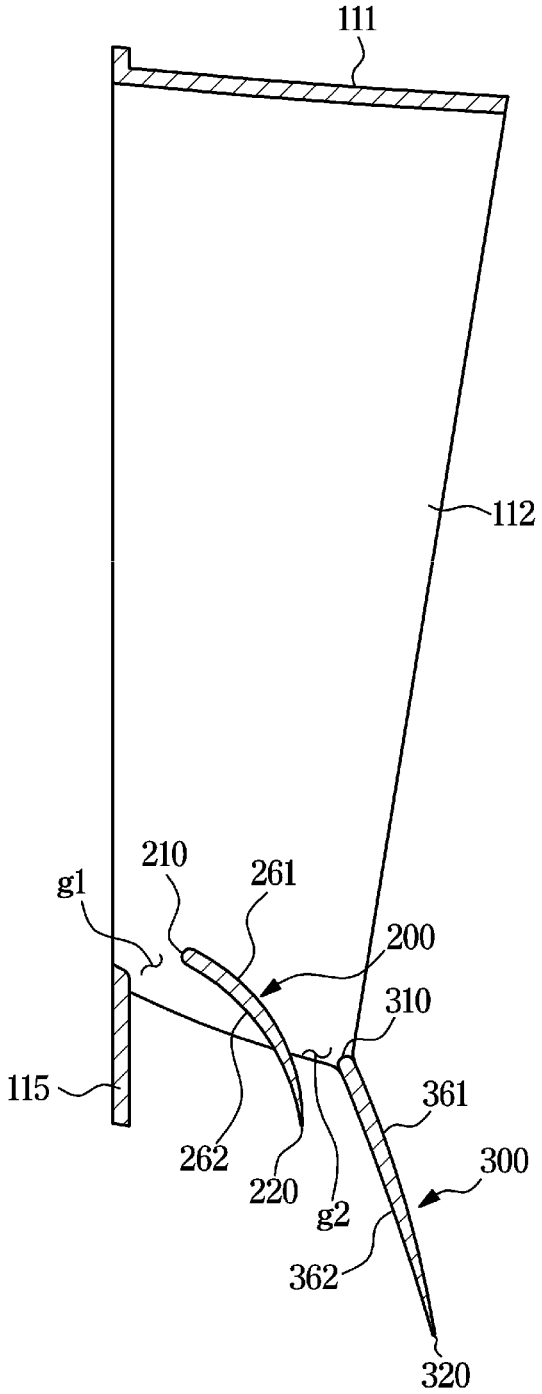
FIG. 33 is a cross-sectional view of the guide device shown in FIG. 30.

Referring to FIG. 29, a size of a first gap g1 may change. For example, a length d3 of the first gap g1 being adjacent to a fourth side portion 240 may be greater than a length d1 of the first gap g1 at the center portion. The length d3 of the first gap g1 being adjacent to the fourth side portion 240 may be greater than a length d2 of the first gap g1 being adjacent to the third side portion 230. Therefore, air discharged through the outlet opening 52 may be induced to flow in the right direction.

Referring to FIGS. 30 to 34, the air conditioner 1 may further include a second air guide 300. The above-described air guide 200 is also referred to as a first air guide 200.

In FIGS. 30 to 34, the first air guide 200 is shown to be the air guide 200*b*, although not limited thereto. The first air guide 200 may include various examples of the above-described air guide 200. For example, the first air guide 200 may be replaced with one of air guides 200*a* and 200*c* to 200*k*.

The second air guide 300 may be arranged with the first air guide 200 along a flow direction of air. The second air guide 300 may be positioned downstream of the first air guide 200 with respect to a flow of air. For example, the second air guide 300 may be more adjacent to the heat exchanger 20 than the first air guide 200.

The second air guide 300 may include a body 301 forming an outer appearance of the second air guide 300. The body 301 may be substantially in a shape of a panel.

For example, the body 301 of the second air guide 300 may extend in the lateral direction between a first side cover portion 112 and a second side cover portion 113 of a guide duct 100. For example, the body 301 may extend in the lateral direction between an end 112*a* of the first side cover portion 112 and an end 113*a* of the second side cover portion 113.

For example, the body 301 may include a first side portion 310 being adjacent to the outlet opening 52 along a flow direction of air. The body 301 may include a second side portion 320 that is distant from the outlet opening 52 along the flow direction of air. The second side portion 320 may be opposite to the first side portion 310. The first side portion 310 may be adjacent to the first air guide 200, and the second side portion 320 may be distant from the first air guide 200. The body 301 may include a third side portion 230 being adjacent to a left wall 15 of a housing 10 along the lateral direction. The body 301 may include a fourth side portion 240 being adjacent to a right wall 16 of the housing 10 along the lateral direction.

The second air guide 300 may guide air guided by the guide duct 100 substantially to the down direction (−Z direction). The second air guide 300 may induce air flowing along a second guide surface 261 of the first air guide 200 to flow downward.

The second air guide 300 may be spaced from the first air guide 200 in the flow direction of air to form a second gap g2. The second gap g2 may include a space which is formed between the first air guide 200 and the second air guide 300 and through which air flows. At least one part of air flowing along the first guide surface 261 of the first air guide 200 may pass through the second gap g2 and be induced downward.

As described above, generally, upon blowing inside an air conditioner, vortex may be generated. The vortex may deteriorate blowing performance of the air conditioner, and cause blowing noise. Also, air discharged from a fan may fail to arrive at some areas of a heat exchanger. Accordingly, heat-exchange performance of the heat exchanger may deteriorate. As a result, air-conditioning ability of the air conditioner may deteriorate.

The second air guide 300 may guide air downward by forming the second gap g2. For example, the second air guide 300 may guide a flow of air such that air passed through the second gap g2 is directed toward a lower area of a heat exchanger 20. Accordingly, by preventing a flow of air from being concentrated onto some areas of the heat exchanger 20, a flow rate distribution of the heat exchanger 20 may be improved. Also, by preventing or reducing generation of vortex, blowing performance of the air conditioner 1 may be improved and blowing noise may be reduced.

The second air guide 300 may protrude to a lower location than the first air guide 200. The second air guide 300 may include a shape extending downward to smoothly guide air downward.

The second air guide 300 may include a first guide surface 361 and a second guide surface 362.

The first guide surface 361 may be positioned toward the heat exchanger 20. The first guide surface 361 may guide air flowing toward the heat exchanger 20 by the guide duct 100. The first guide surface 361 may guide a main air current passing through the guide duct 100.

For example, the first guide surface 361 may be inclined downward toward the heat exchanger 20. The first guide surface 361 may be curved toward the heat exchanger 20. The first guide surface 361 may include a curved surface. The first guide surface 361 may include a curved shape.

For example, air discharged from the outlet opening 52 and moving through the guide duct 100 may flow while being in close contact with the first guide surface 361, by the Coanda effect.

The second guide surface 362 may be opposite to the first guide surface 361. The second guide surface 362 may guide at least one part of air flowing over the first guide surface 261 of the first air guide 200. The second guide surface 362 may guide an auxiliary air current diverging from the main air current.

For example, air discharged from the outlet opening 52 and passed through the second gap g2 may flow while being in close contact with the second guide surface 362, by the Coanda effect.

For example, the second guide surface 362 may be inclined downward toward the heat exchanger 20. The second guide surface 362 may be curved toward the heat exchanger 20. The second guide surface 362 may include a curved surface.

The second guide surface 362 may include a curved shape.

Referring to FIGS. 31 to 34, the second air guide 300 may have a cross section of a streamlined shape.

For example, the first side portion 310 may include a round shape, and the second side portion 320 may include a sharp shape. The second air guide 300 may be reduced in thickness from the first side portion 310 toward the second side portion 320. Thereby, the second air guide 300 may reduce flow loss of air moving from the outlet opening 52 toward the heat exchanger 20. The second air guide 300 may reduce flow loss of air flowing over the first guide surface 361 and the second guide surface 362.

The second air guide 300 may also have various shapes like the first air guide 200. For example, the second air guide 300 may include an inclined portion (not shown) inclined downward toward an outer side in the lateral direction to diffuse air to the lateral direction. The second air guide 300 may include a convex shape. The second air guide 300 may include an inclined portion (not shown) inclined upward toward the outer side in the lateral direction to collect air for an improvement of blowing ability. The second air guide 300 may include a concave shape. The second air guide 300 may include a shape of which at least one portion is inclined downward or upward to guide air to a preset direction. The second air guide 300 may include a three-dimensional shape.

Figure 34:
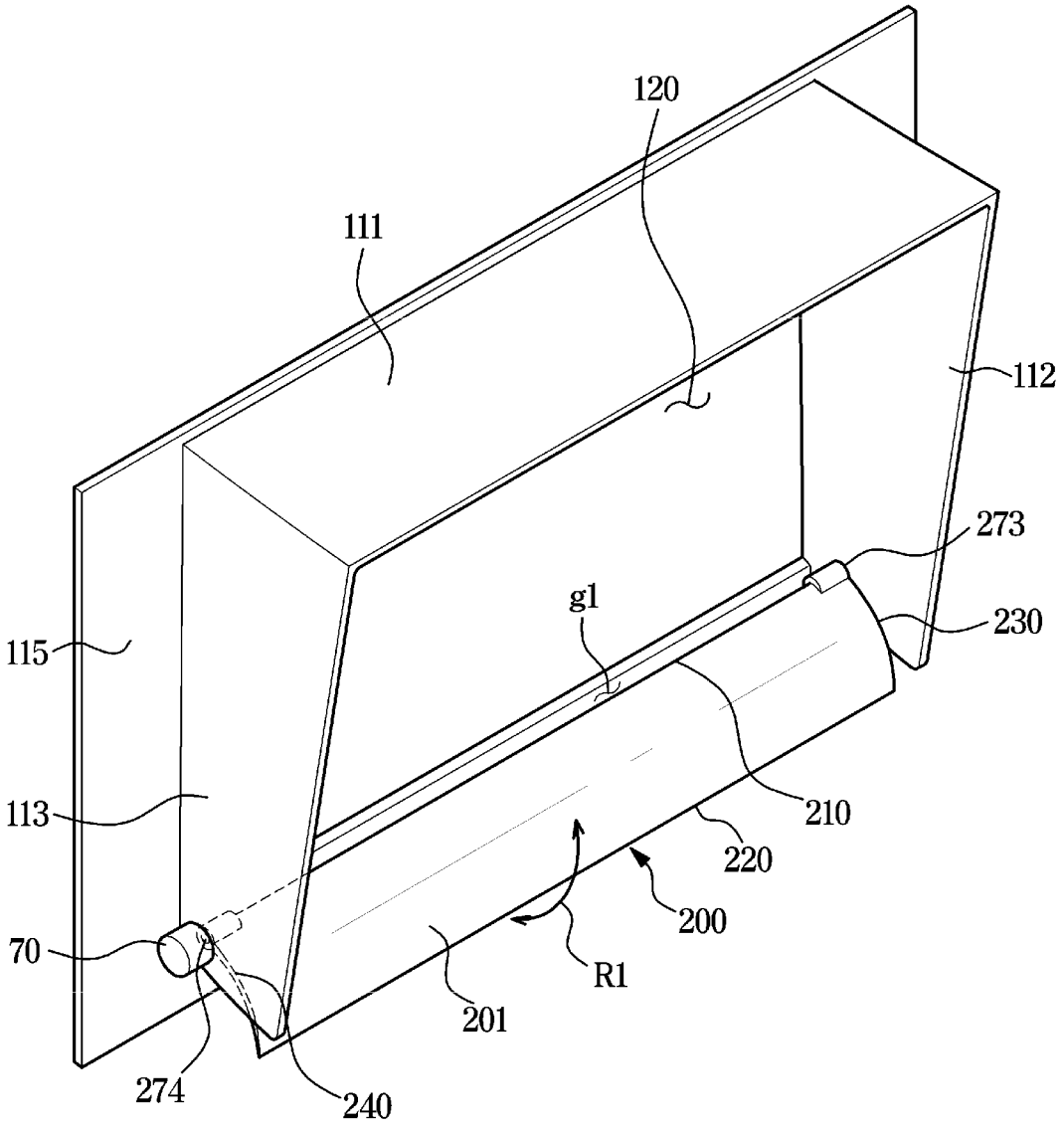
FIG. 34 is a perspective view showing an example of a guide device according to an embodiment of the disclosure.
Figure 35:
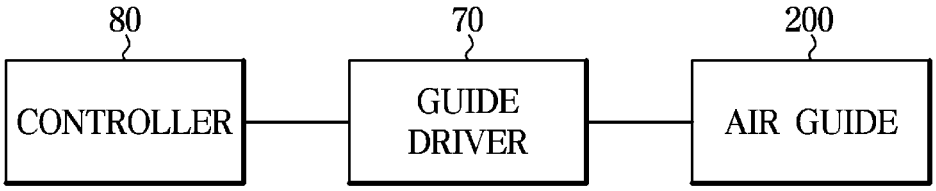
FIG. 35 is a control block diagram of an air conditioner according to an embodiment of the disclosure.

FIG. 34 is a perspective view showing an example of a guide device according to an embodiment of the disclosure. FIG. 35 is a control block diagram of an air conditioner according to an embodiment of the disclosure.

Referring to FIG. 34, an air guide 200 may be rotatable with respect to a guide duct 100 to adjust a flow direction of air discharged through an outlet opening 52. For example, the air guide 200 may rotate with respect to the lateral direction (see R1 of FIG. 34). The air guide 200 may change a rotation angle according to duct work.

The air conditioner 1 may further include a guide driver 70 for rotating the air guide 200. For example, the guide driver 70 may be controlled manually or automatically. For example, the guide driver 70 may include at least one of a lever or a motor.

For example, the guide driver 70 may be positioned at a third corner portion 273 and a fourth corner portion 274 of the air guide 200. However, this is only an example, and the guide driver 70 may be positioned at any location at which the guide driver 70 rotates the air guide 200.

Referring to FIG. 35, the air conditioner 1 may further include a controller 80.

The controller 80 may change a rotation angle of the air guide 200 with respect to the outlet opening 52 based on duct work. The controller 80 may control the guide driver 70 to change a rotation angle of the air guide 200.

Generally, duct work may depend on an installation environment of an air conditioner, and a flow pattern of air may depend on the duct work.

For example, at low duct work, flow resistance may be low, and accordingly, air discharged from the outlet opening 52 may have high straightness. That is, because high straightness of air discharged from the outlet opening 52 further worsens a phenomenon in which a flow of air is concentrated onto some areas of the heat exchanger 20, the air guide 200 may be positioned maximally toward the down direction to prevent the phenomenon. For example, the air guide 200 may be positioned such that an angle between the support frame 115 and the second guide surface 262 is relatively small.

For example, at high duct work, flow resistance may be substantial, and accordingly, air discharged from the outlet opening 52 may have low straightness. That is, air discharged from the outlet opening 52 may tend to be diffused due to the low straightness. Accordingly, the air guide 200 may be positioned more gently than at low duct work. For example, the air guide 200 may be positioned such that an angle between the support frame 115 and the second guide surface 262 is relatively great.

For example, at high duct work, the controller 80 may control the guide driver 70 such that the air guide 200 is steeply inclined with respect to a flow direction of air. At low duct work, the controller 80 may control the guide driver 70 such that the air guide 200 is gently inclined with respect to a flow direction of air.

The air guide 200 is also referred to as a lower guide. The first gap g1 is also referred to as a lower gap. The first air guide 200 is referred to as a first lower guide. The first gap g1 is also referred to as a first lower gap. The second air guide 300 is referred to as a second lower guide. The second gap g2 is also referred to as a second lower gap.

FIGS. 36 to 51 show various embodiments of side air guides. The same components as those described above may be assigned the same reference numerals, and overlapping descriptions thereof will be omitted.

Referring to FIGS. 36 to 51, the air conditioner 1 may include a side air guide 400. The side air guide 400 may extend in the up-down direction to correspond to left and right side ends 522 and 523 of an outlet opening 52.

For example, the side air guide 400 may include a first side air guide 400*a* and a second side air guide 400*b*. The first side air guide 400*a* may correspond to the left side end 522 of the outlet opening 52. The second side air guide 400*b* may correspond to the right side end 523 of the outlet opening 52. The first side air guide 400*a* may be opposite to the second side air guide 400*b*.

The air conditioner 1 may include at least one of the first side air guide 400*a* or the second side air guide 400*b*. That is, the air conditioner 1 may include both the first side air guide 400*a* and the second side air guide 400*b*, only the first side air guide 400*a*, or only the second side air guide 400*b*.

The side air guide 400 may include a body 401 forming an outer appearance of the side air guide 400. The body 401 may be substantially in a shape of a panel.

For example, the body 401 may include a first side portion 210 being adjacent to the outlet opening 52 along a flow direction of air. The body 401 may include a second side portion 220 being distant from the outlet opening 52 along the flow direction of air. The second side portion 220 may be opposite to the first side portion 210. The second side portion 220 may be positioned downstream with respect to a flow of air. The body 401 may include a third side portion 430 being adjacent to a top plate 13 of a housing 10 along the up-down direction. The third side portion 430 may include an upper end of the body 401. The body 401 may include a fourth side portion 440 being adjacent to a bottom plate 14 of the housing 10 along the up-down direction. The fourth side portion 440 may include a lower end of the body 401.

The side air guide 400 may be spaced from the side ends 522 and 523 of the outlet opening 52 in the flow direction of air to form a side gap g3 through which air flows. The side air guide 400 may guide air to the lateral direction through the side gap g3. The side air guide 400 may diffuse air in the lateral direction through the side gap g3.

The first side air guide 400*a* may be spaced from the left side end 522 of the outlet opening 52 to form a side gap g3. The second side air guide 400*b* may be spaced from the right side end 523 of the outlet opening 52 to form a side gap g3.

For example, the side gaps g3 may include spaces formed between the side ends 522 and 523 of the outlet opening 52 and the side air guide 400. A blower including a guide duct 100, a side gap g3 may include a space formed between a support frame 115 and a side air guide 400.

The side air guide 400 may include a first guide surface 461 and a second guide surface 462.

The first guide surface 461 may be positioned toward an inner space of the outlet opening 52. The second guide surface 462 may be opposite to the first guide surface 461. The second guide surface 462 may be positioned toward an outer space from the outlet opening 52.

The second guide surface 462 may guide air passed through the side gap g3. The second guide surface 462 may guide an auxiliary air current diverging from the main air current.

The first guide surface 461 may be curved outward in the lateral direction. The first guide surface 461 may include a curved surface. The first guide surface 461 may include a curved shape.

The second guide surface 462 may be curved outward in the lateral direction. The second guide surface 462 may include a curved surface. The second guide surface 462 may include a curved shape.

For example, air discharged from the outlet opening 52 and flowing inside the guide duct 100 may flow while being in close contact with the second guide surface 461, by the Coanda effect.

For example, air discharged from the outlet opening 52 and passed through the side gap g3 may flow while being in close contact with the second guide surface 462, by the Coanda effect.

The side air guide 400 may have a cross section of a streamlined shape.

For example, the first side portion 410 may include a round shape, and the second side portion 420 may include a sharp shape. The side air guide 400 may be reduced in thickness from the first side portion 210 toward the second side portion 220. Therefore, the side air guide 400 may reduce flow loss of air moving from the outlet opening 52 toward the heat exchanger 20. The side air guide 400 may reduce flow loss of air flowing over the first guide surface 461 and the second guide surface 462.

Figure 36:
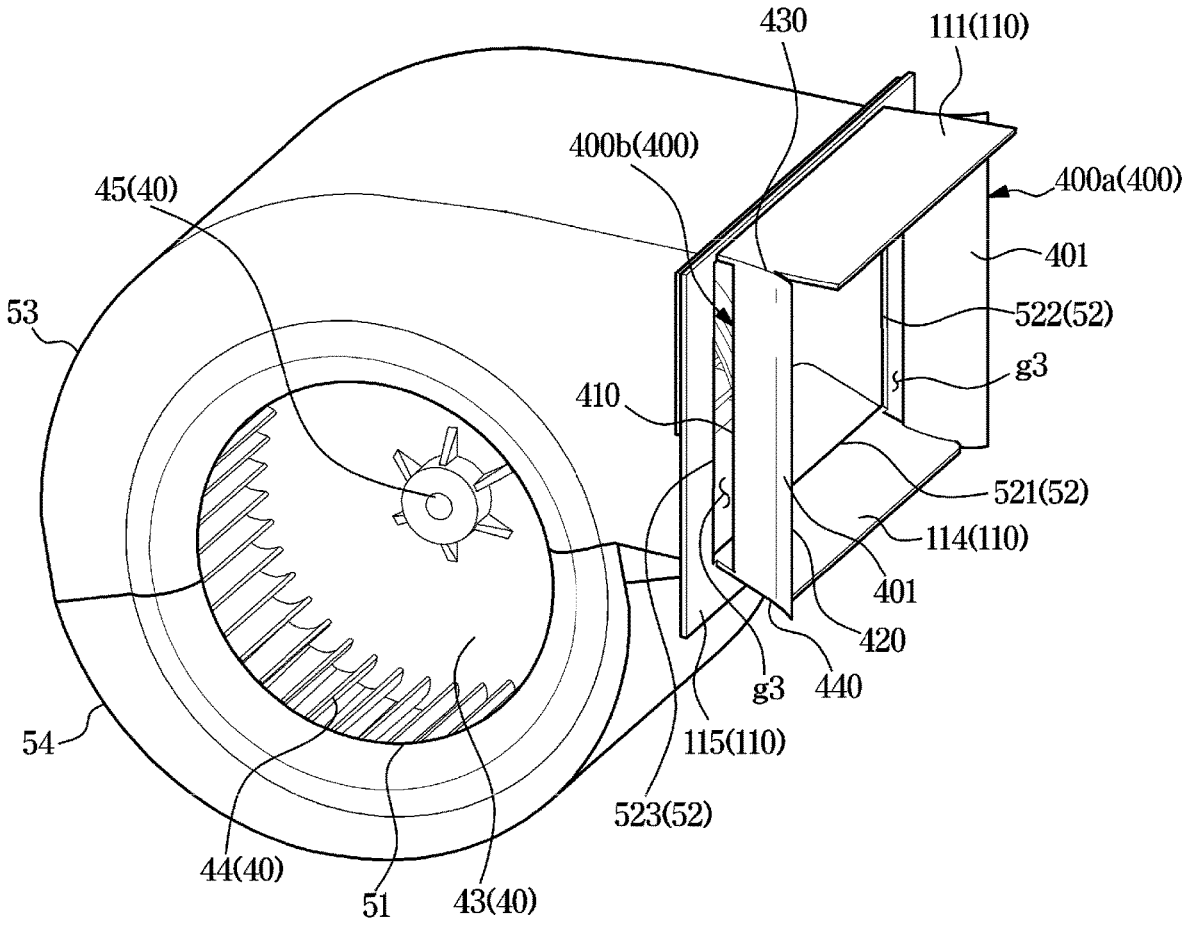
FIG. 36 is a perspective view showing an example of a blower according to an embodiment of the disclosure.
Figure 37:
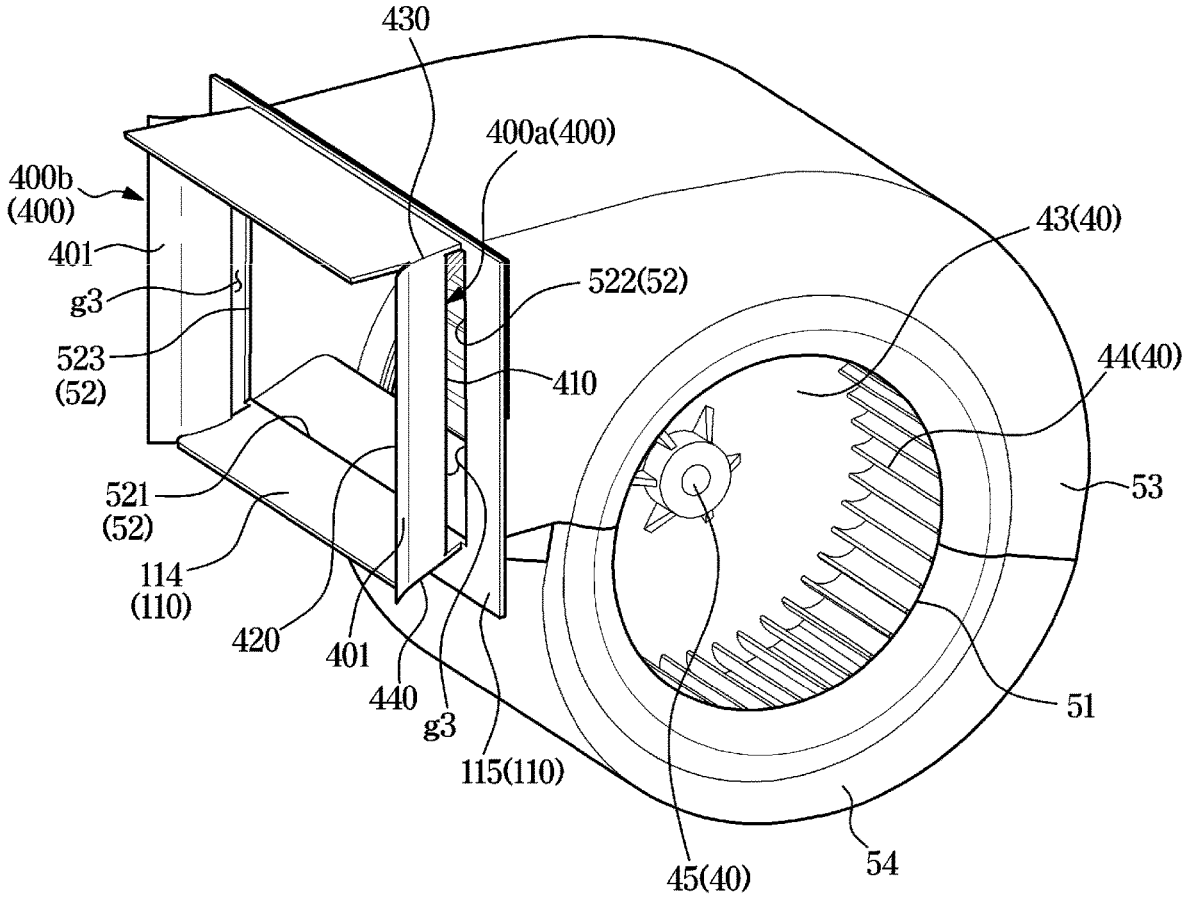
FIG. 37 is a perspective view of the blower shown in FIG. 36, seen in another direction.
Figure 40:
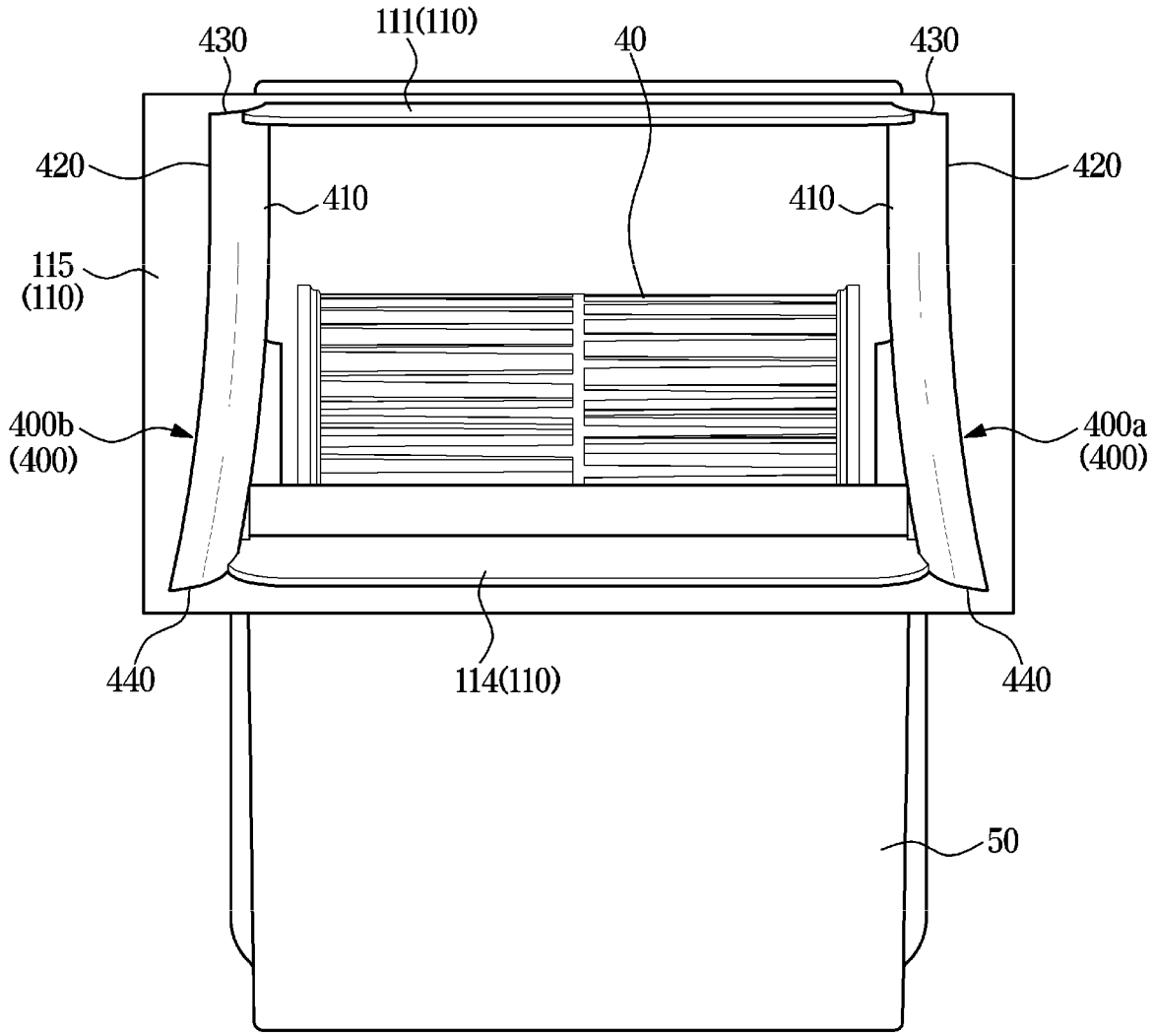
FIG. 40 is a side view of an example of a blower according to an embodiment of the disclosure, seen in the X direction.
Figure 41:
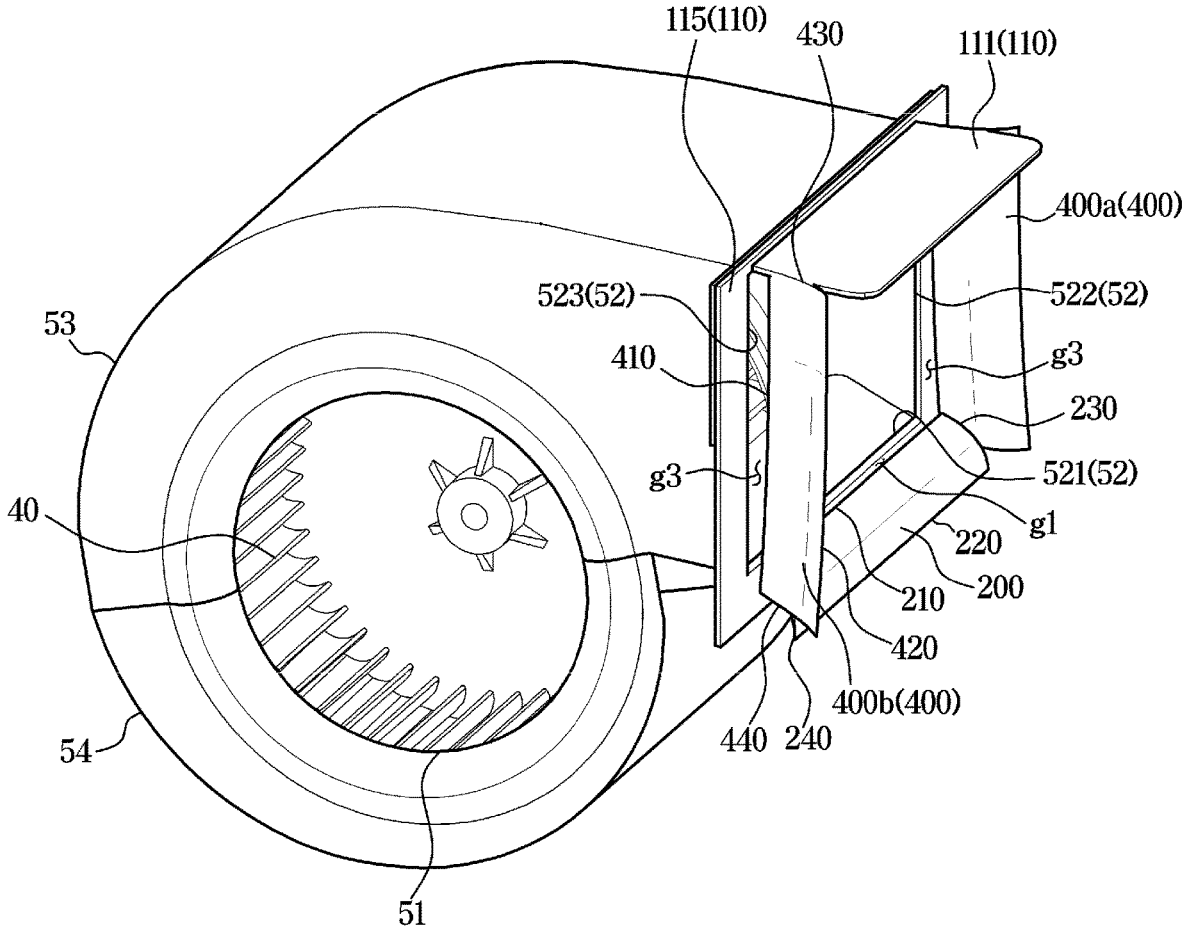
FIG. 41 is a perspective view showing an example of a blower according to an embodiment of the disclosure.
Figure 42:
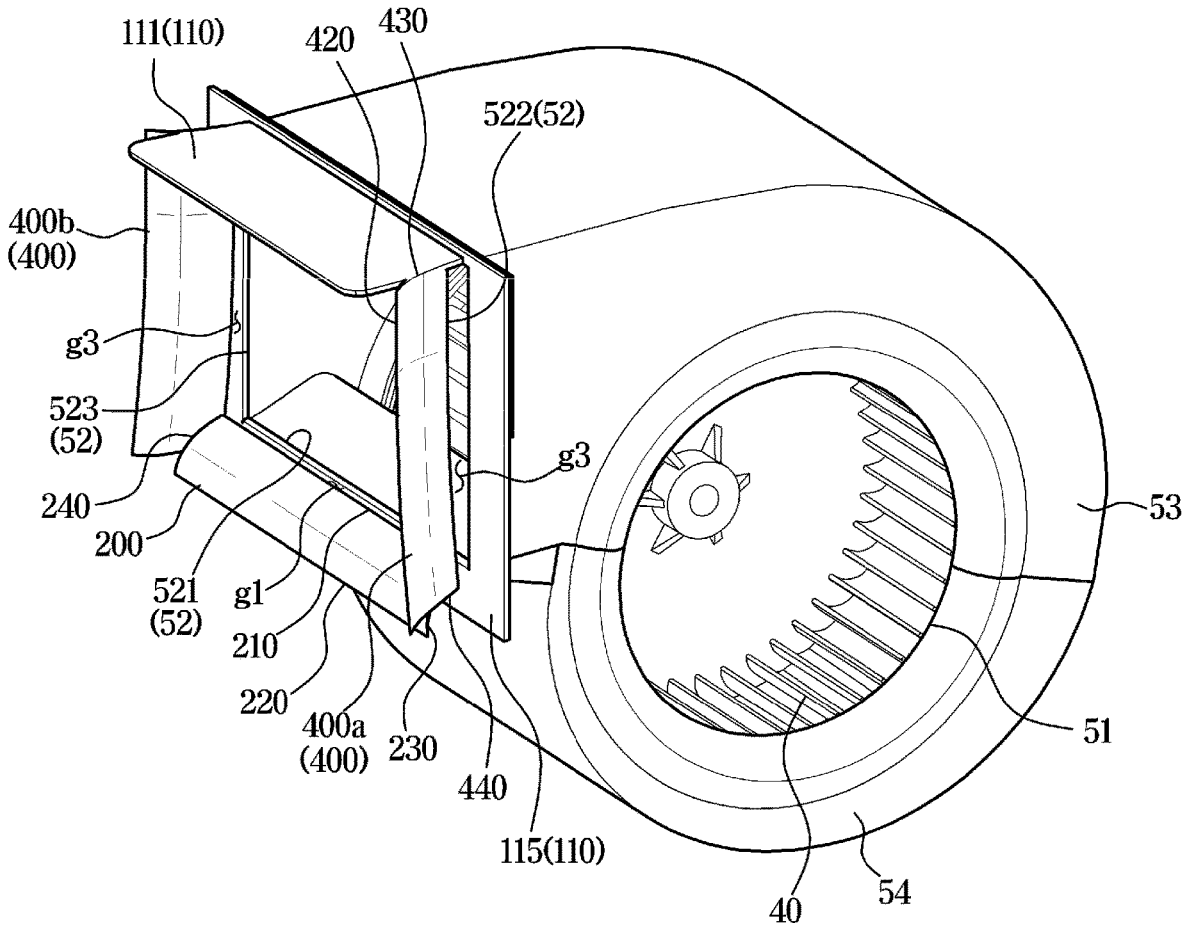
FIG. 42 is a perspective view of the blower shown in FIG. 41, seen in another direction.
Figure 43:
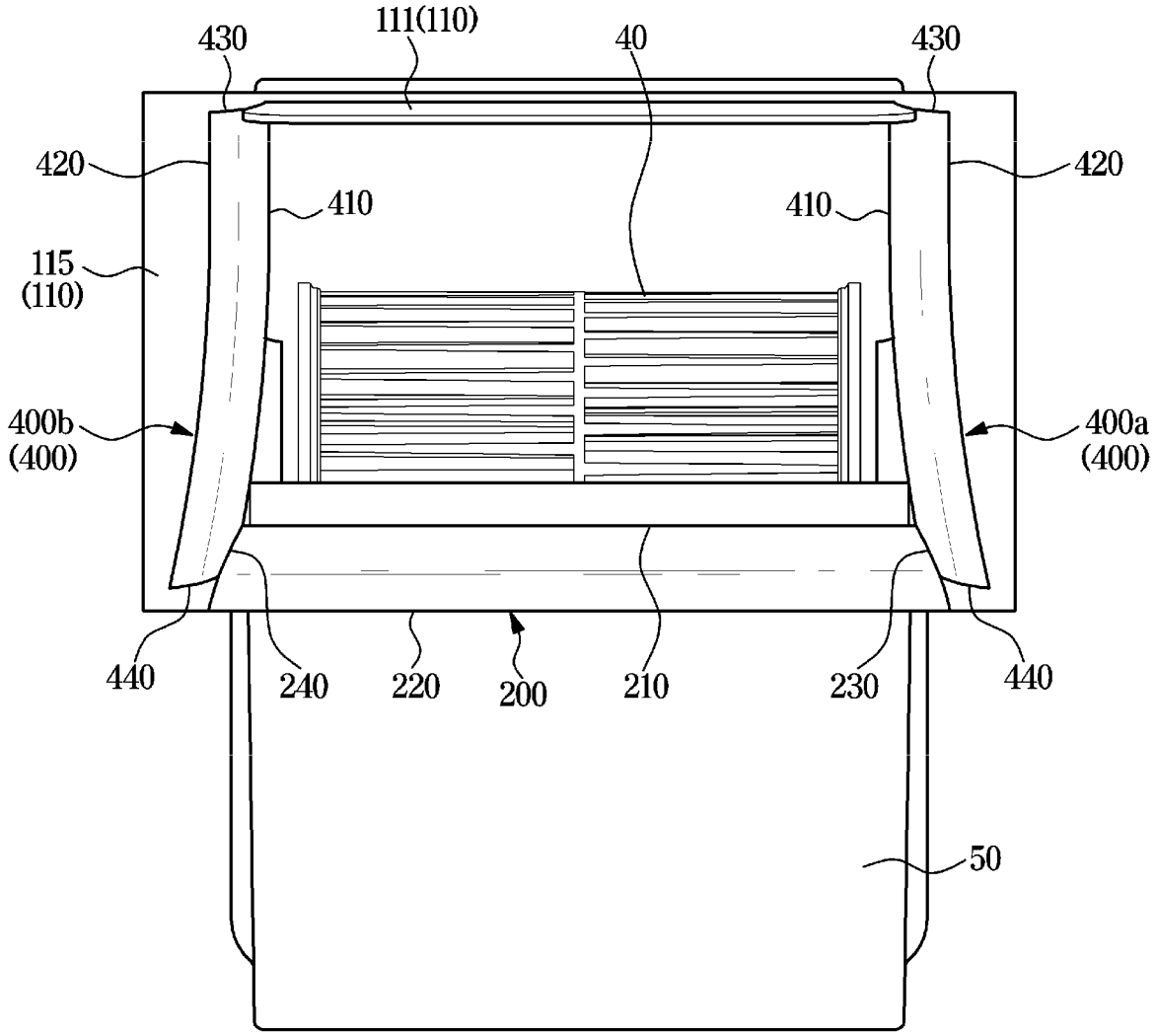
FIG. 43 is a side view of the blower shown in FIG. 41, seen in the X direction.
Figure 44:
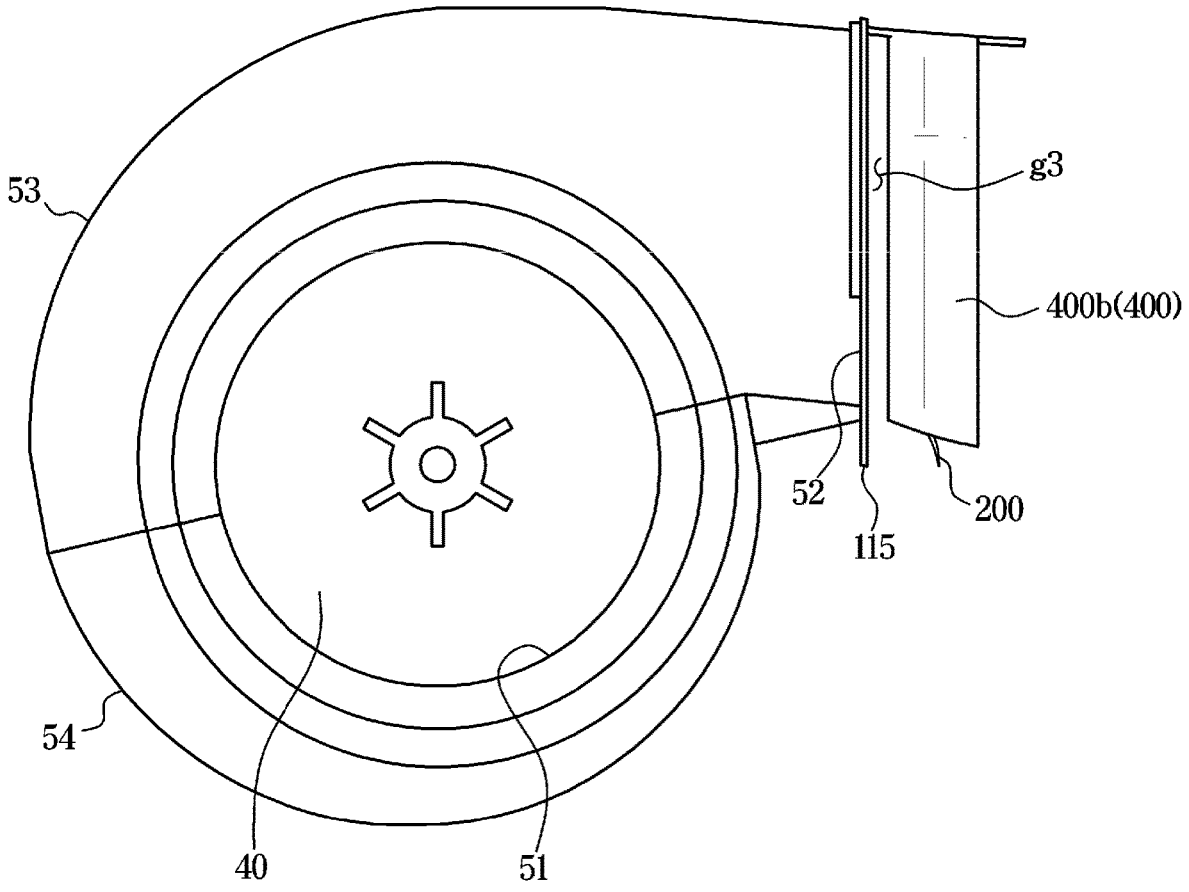
FIG. 44 is a side view of the blower shown in FIG. 41.
Figure 45:
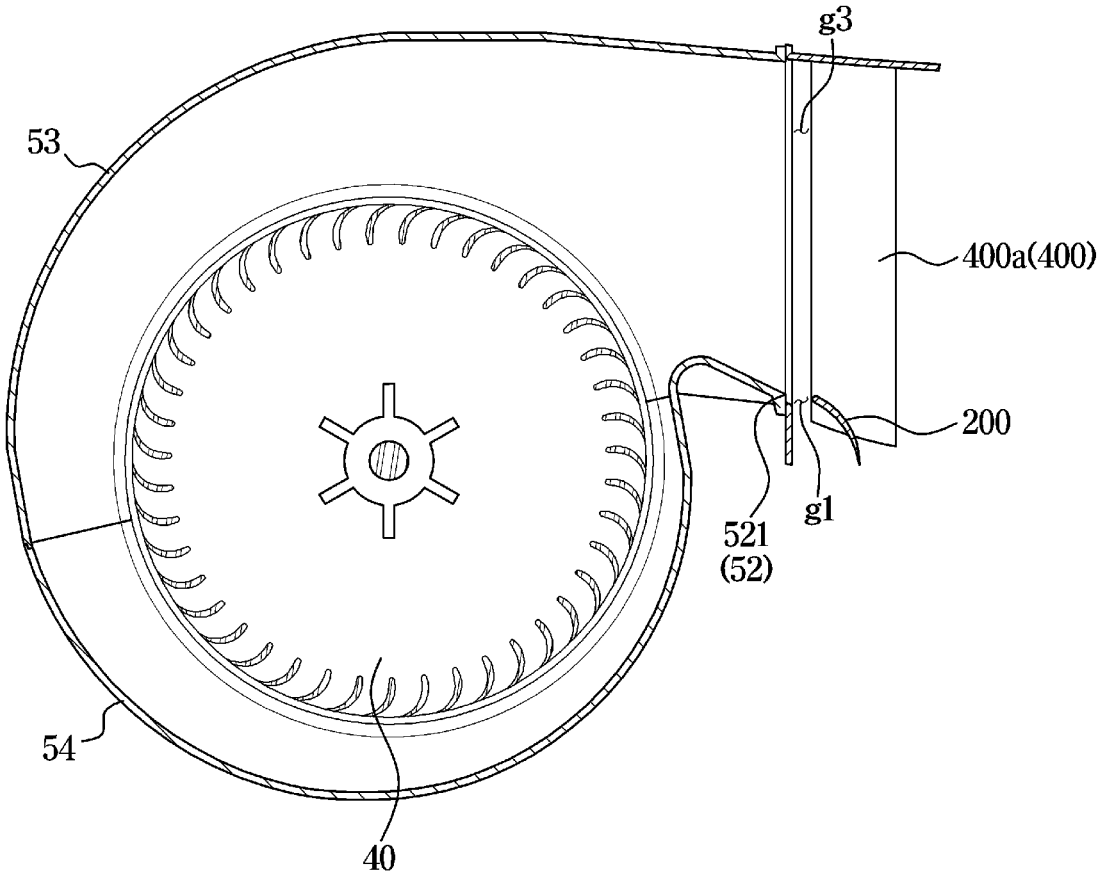
FIG. 45 is a cross-sectional view of the blower shown in FIG. 41.
Figure 46:
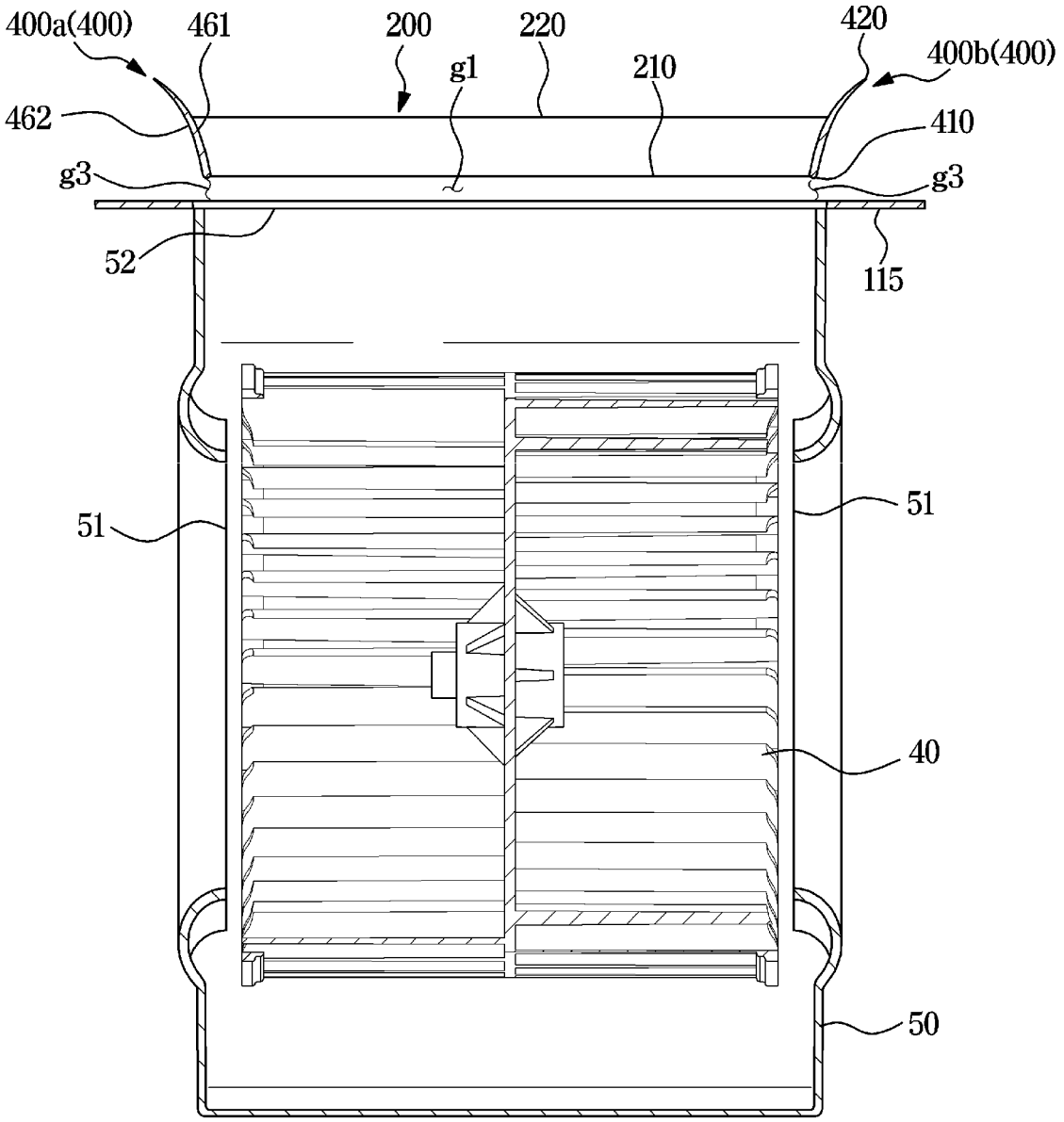
FIG. 46 is a cross-sectional view of the blower shown in FIG. 41, taken along the X-Y plane.
Figure 47:
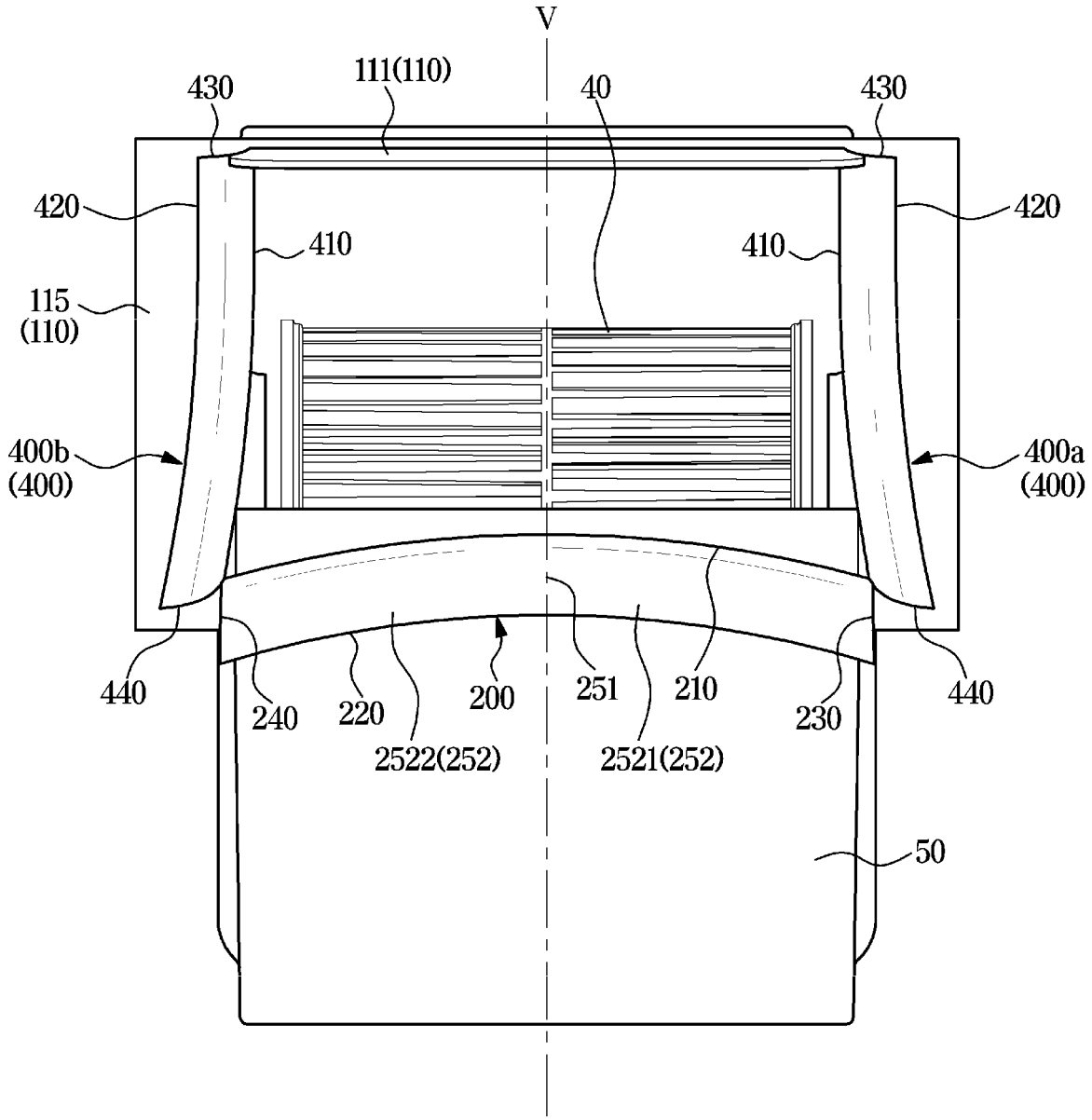
FIG. 47 is a side view of an example of a blower according to an embodiment of the disclosure, seen in the X direction.

Referring to FIGS. 36 and 40, the first side air guide 400*a* may be positioned to correspond to the left side end 522 of the outlet opening 52, and the second side air guide 400*b* may be positioned to correspond to the right side end 523 of the outlet opening 52. The guide duct 100 may include an upper cover portion 111 and a lower cover portion 114. The guide duct 100 may further include a support frame 115.

The first side air guide 400*a* may be spaced from the left side end 522 of the outlet opening 52 to form a side gap g3. The side gap g3 formed by the first side air guide 400*a* is referred to as a first side gap. The first side air guide 400*a* may guide air passed through the first side gap to the left direction.

The second side air guide 400*b* may be spaced from the right side end 523 of the outlet opening 52 to form a side gap g3. The side gap g3 formed by the second side air guide 400*b* is referred to as a second side gap. The second side air guide 400*b* may guide air passed through the first side gap to the right direction.

Figure 38:
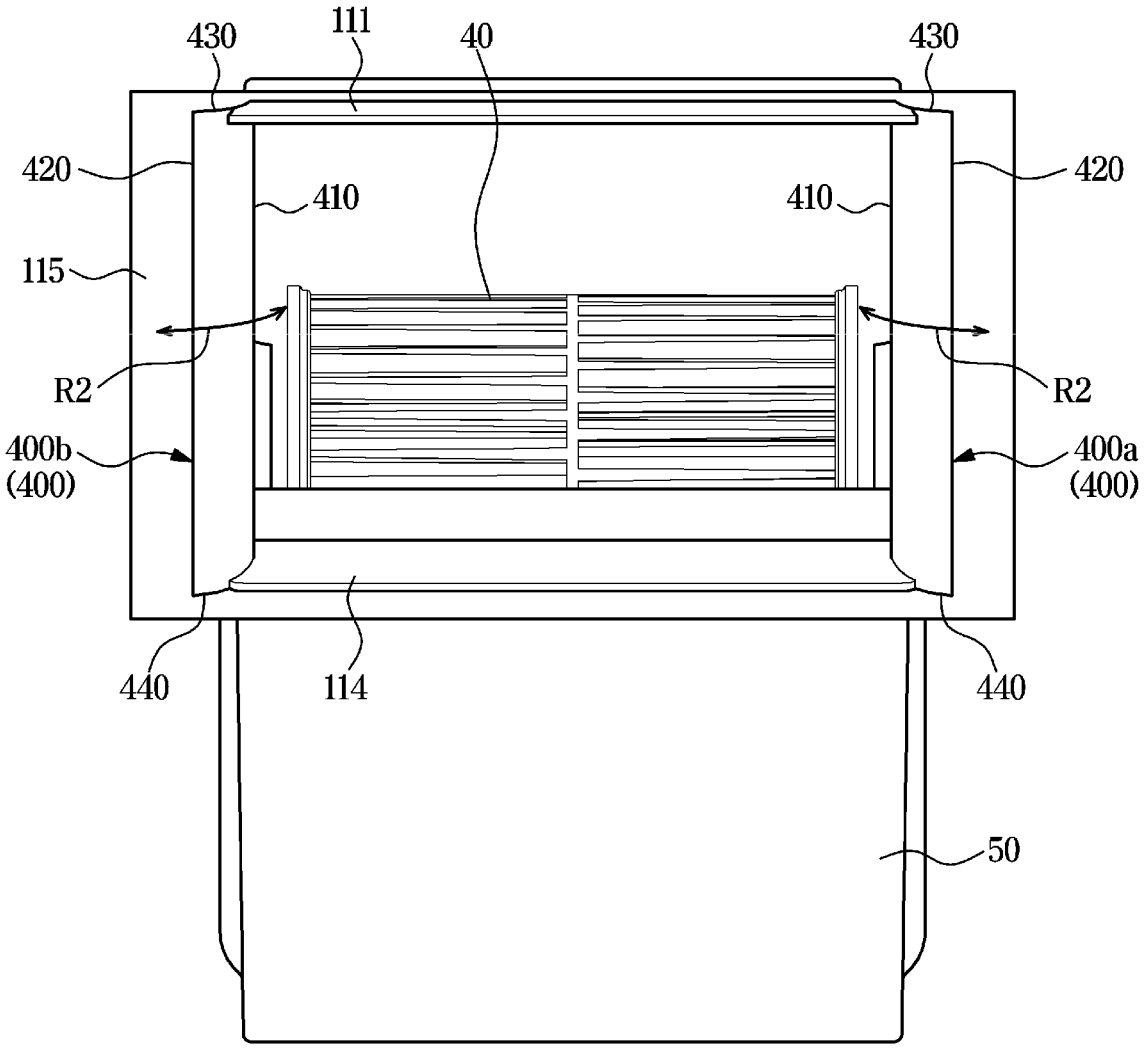
FIG. 38 is a side view of the blower shown in FIG. 36, seen in the X direction.
Figure 39:
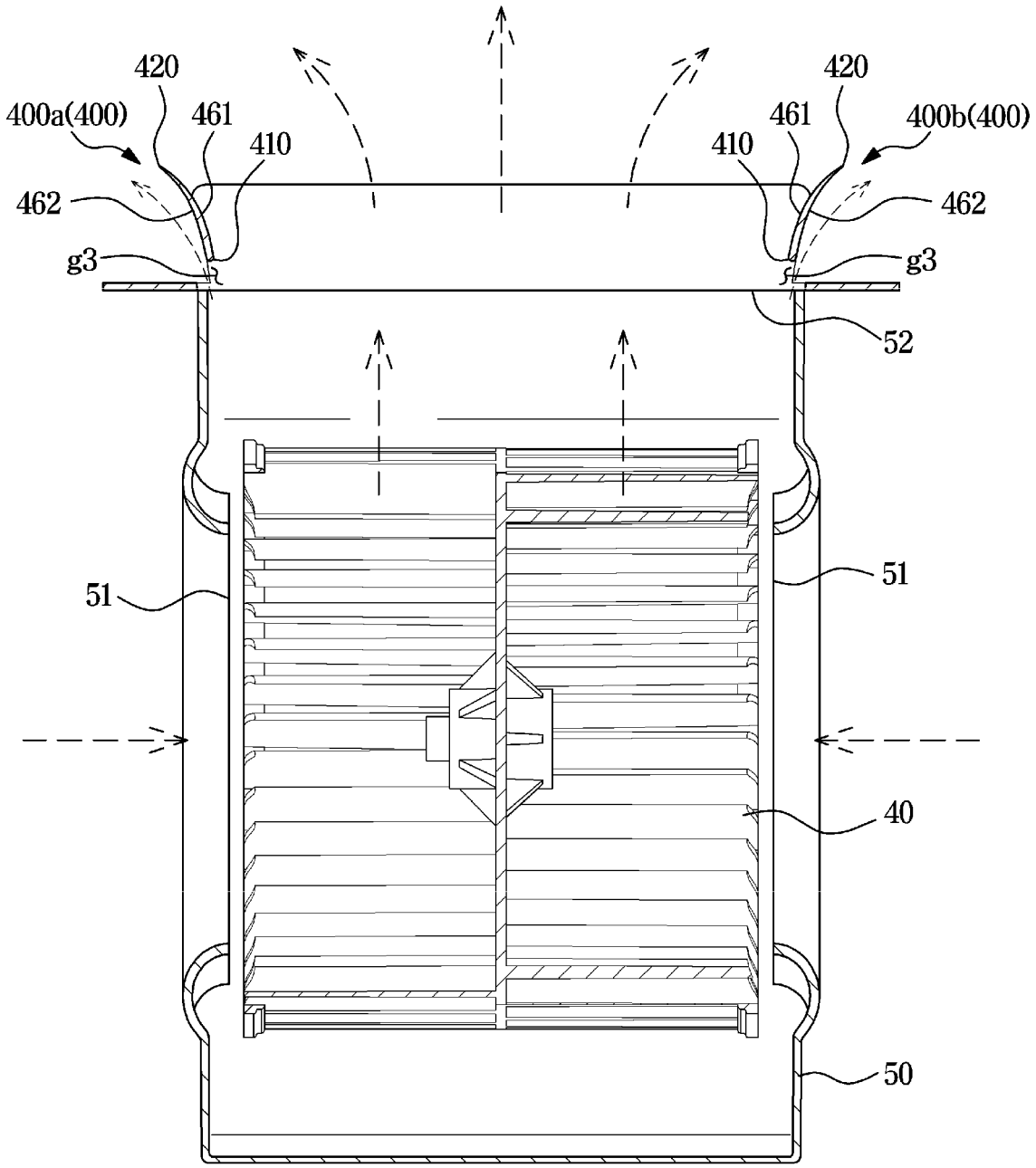
FIG. 39 is a cross-sectional view of the blower shown in FIG. 36, taken in the X-Y plane.

The first side air guide 400*a* and the second side air guide 400*b* may be rotatable (see R2 of FIG. 38). The first side air guide 400*a* may control a flow direction of air passed through the first side gap and guided. The second side air guide 400*b* may control a flow direction of air passed through the second side gap and guided. For example, a rotation angle of each of the first side air guide 400*a* and the second side air guide 400*b* may be adjusted manually or automatically.

Referring to FIG. 40, the first side air guide 400*a* may be curved along the up-down direction. For example, the first side air guide 400*a* may be curved outward in the lateral direction from the third side portion 430 to the fourth side portion 440. The first side air guide 400*a* may be bent to the left direction from the third side portion 430 to the fourth side portion 440.

Referring to FIG. 40, the second side air guide 400*b* may be curved along the up-down direction. For example, the second side air guide 400*b* may be curved outward in the lateral direction from the third side portion 430 to the fourth side portion 440. The second side air guide 400*b* may be bent to the right direction from the third side portion 430 to the fourth side portion 440.

Referring to FIGS. 41 to 47, a first side air guide 400*a* may be provided to correspond to a left side end 522 of an outlet opening 52, and a second side air guide 400*b* may be provided to correspond to a right side end 523 of the outlet opening 52. A guide duct 100 may include an upper cover portion 111. The guide duct 100 may further include a support frame 115.

Also, a lower air guide 200 may be positioned to correspond to a lower end portion 521 of the outlet opening 52.

The first side air guide 400*a* may guide air passed through a first side gap to the left direction. A second side air guide 400*b* may guide air passed through a second side gap to the right direction. The lower air guide 200 may guide air passed through the first gap g1 to the down direction. Therefore, air discharged through the outlet opening 52 may be smoothly diffused by the side air guides 400*a* and 400*b* and the lower air guide 200.

Figure 48:
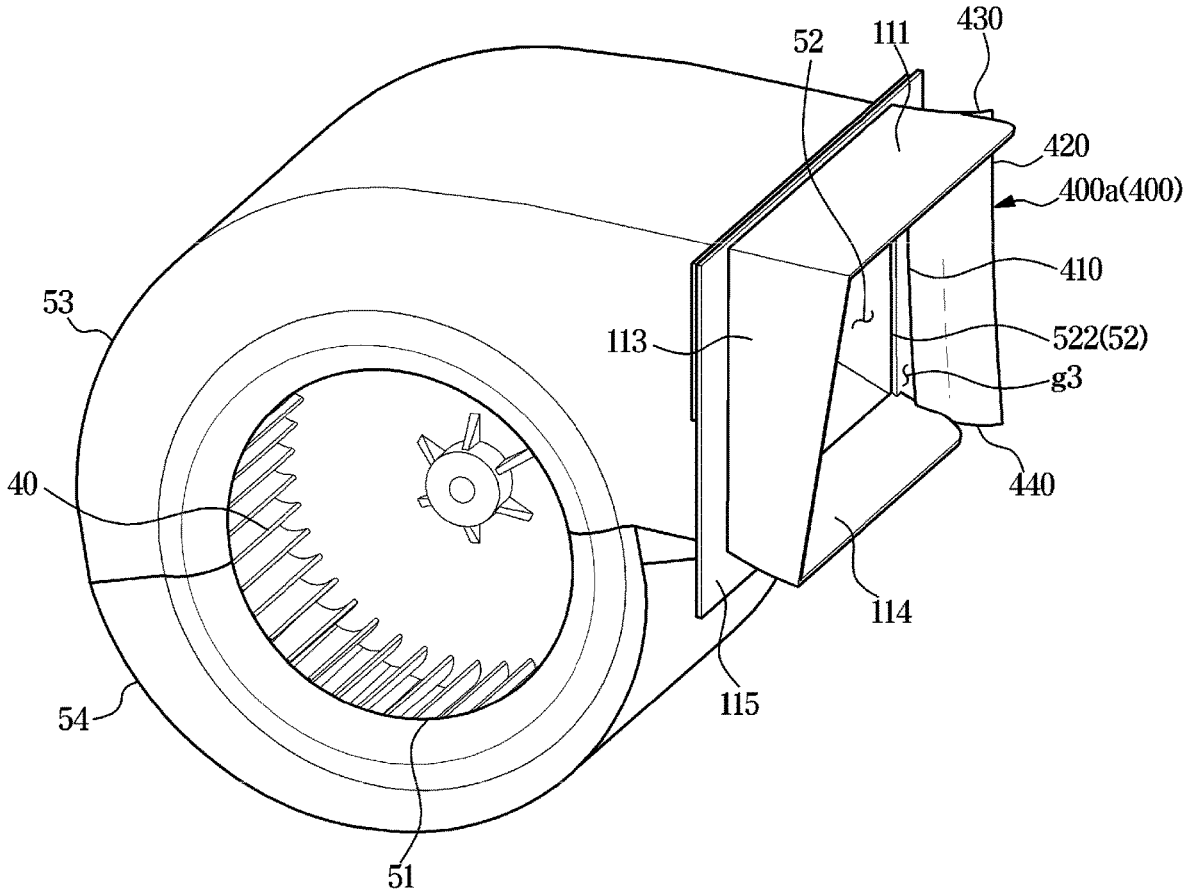
FIG. 48 is a perspective view showing an example of a blower according to an embodiment of the disclosure.
Figure 49:
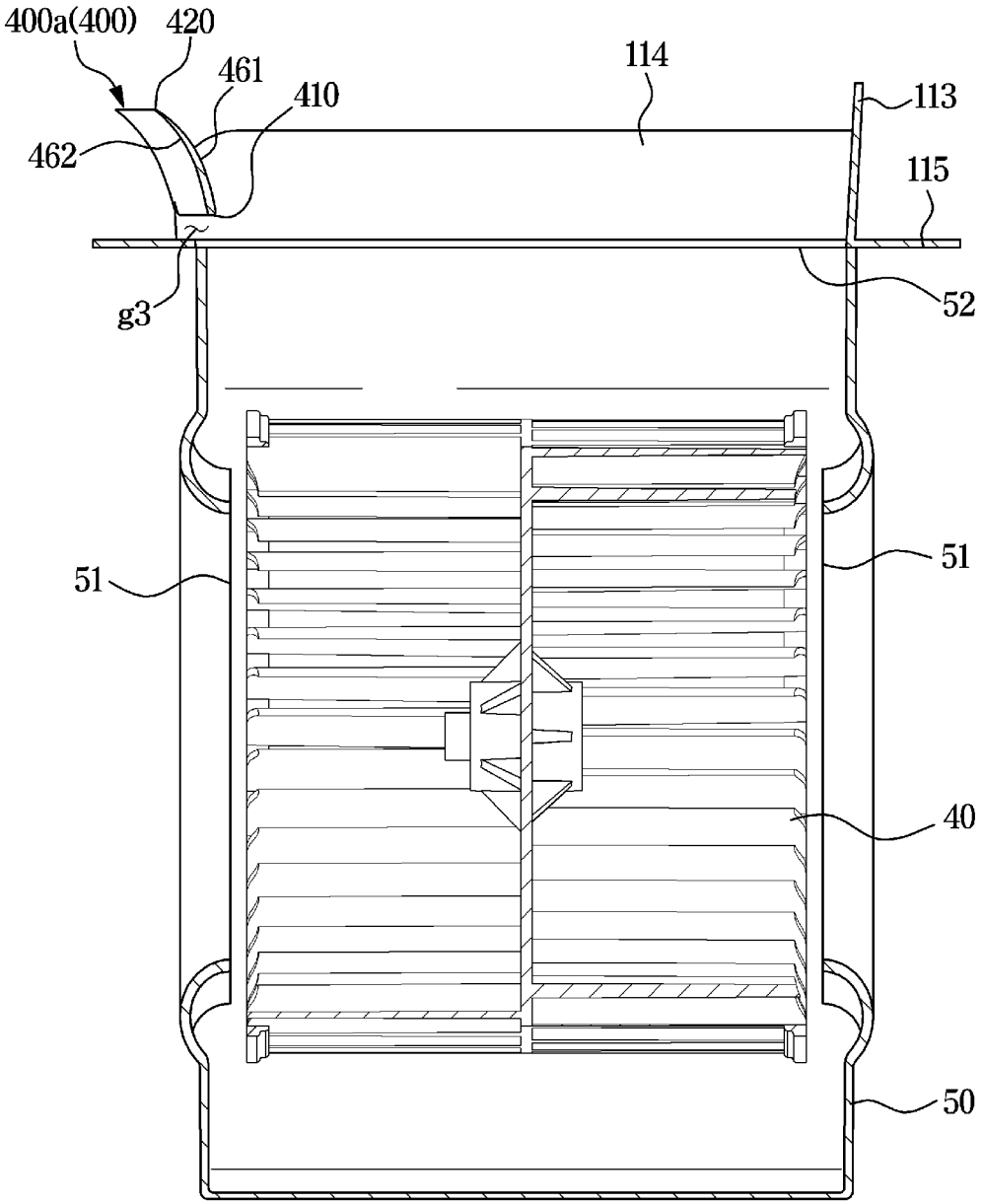
FIG. 49 is a cross-sectional view of the blower shown in FIG. 48, taken along the X-Y plane.

Referring to FIGS. 48 and 49, a first side air guide 400*a* may be positioned to correspond to a left side end 522 of an outlet opening 52. A guide duct 100 may include an upper cover portion 111, a second side cover portion 113, and a lower cover portion 114. The guide duct 100 may further include a support frame 115.

The first side air guide 400*a* may guide air passed through a first side gap to the left direction. Air discharged through the outlet opening 52 may be induced to flow in the left direction by the first side air guide 400*a*.

Figure 50:
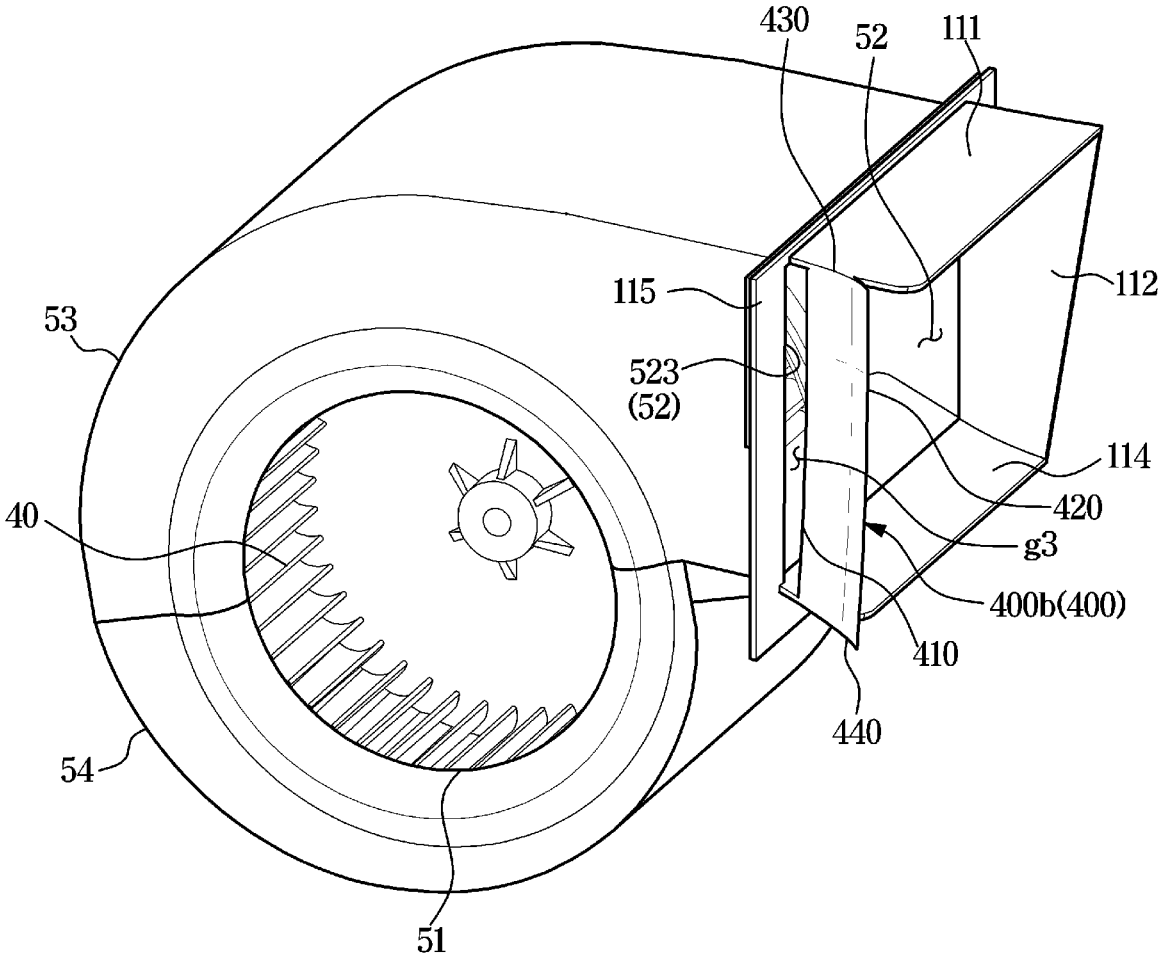
FIG. 50 is a perspective view showing an example of a blower according to an embodiment of the disclosure.
Figure 51:
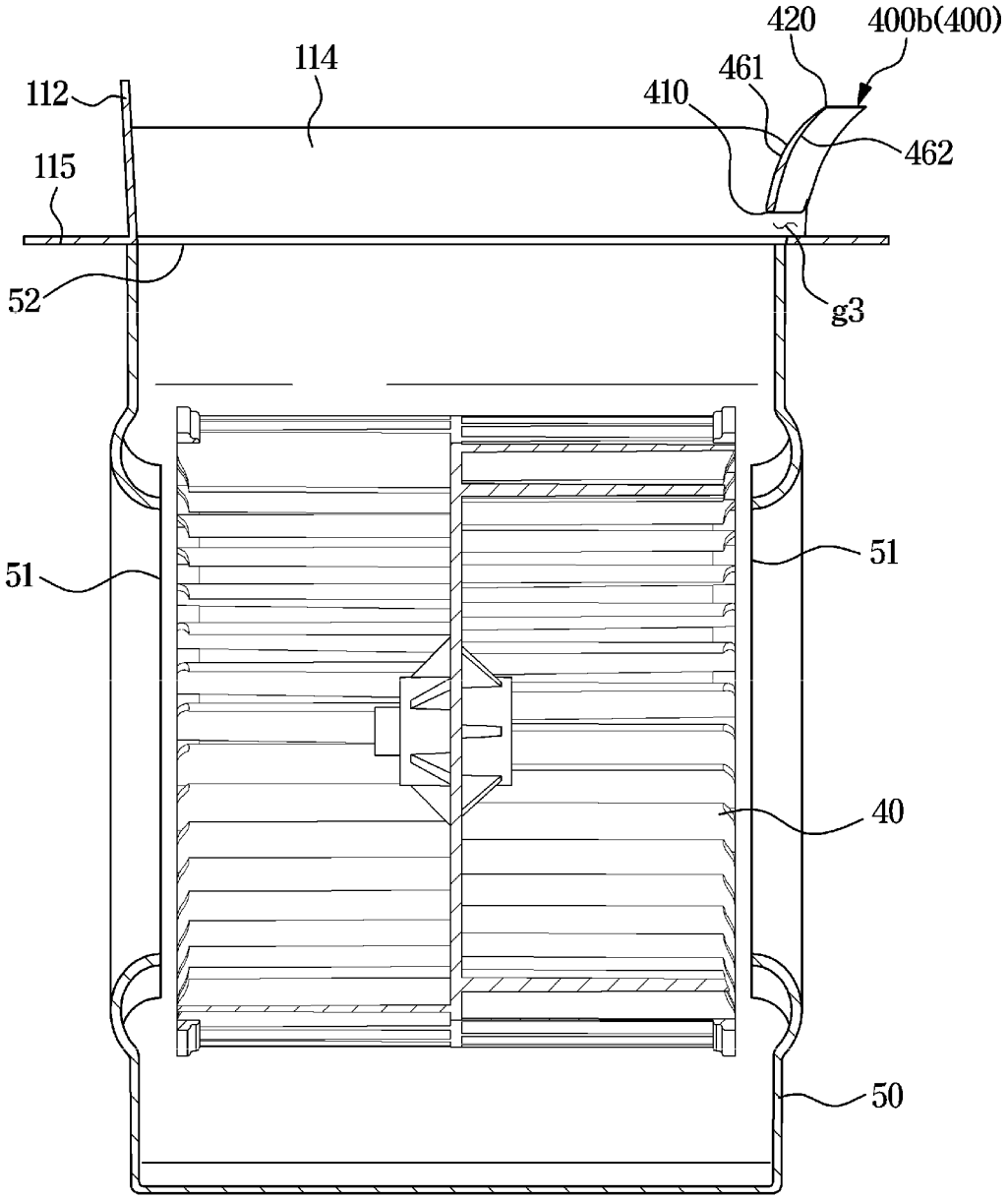
FIG. 51 is a cross-sectional view of the blower shown in FIG. 50, taken along the X-Y plane.

Referring to FIGS. 50 and 51, a second side air guide 400*b* may be positioned to correspond to a right side end 523 of an outlet opening 52. A guide duct 100 may include an upper cover portion 111, a first side cover portion 112, and a lower cover portion 114. The guide duct 100 may further include a support frame 115.

The second side air guide 400*b* may guide air passed through a second side gap to the right direction. Air discharged through the outlet opening 52 may be induced to flow in the right direction by the second air guide 400*b*.

Figure 52:
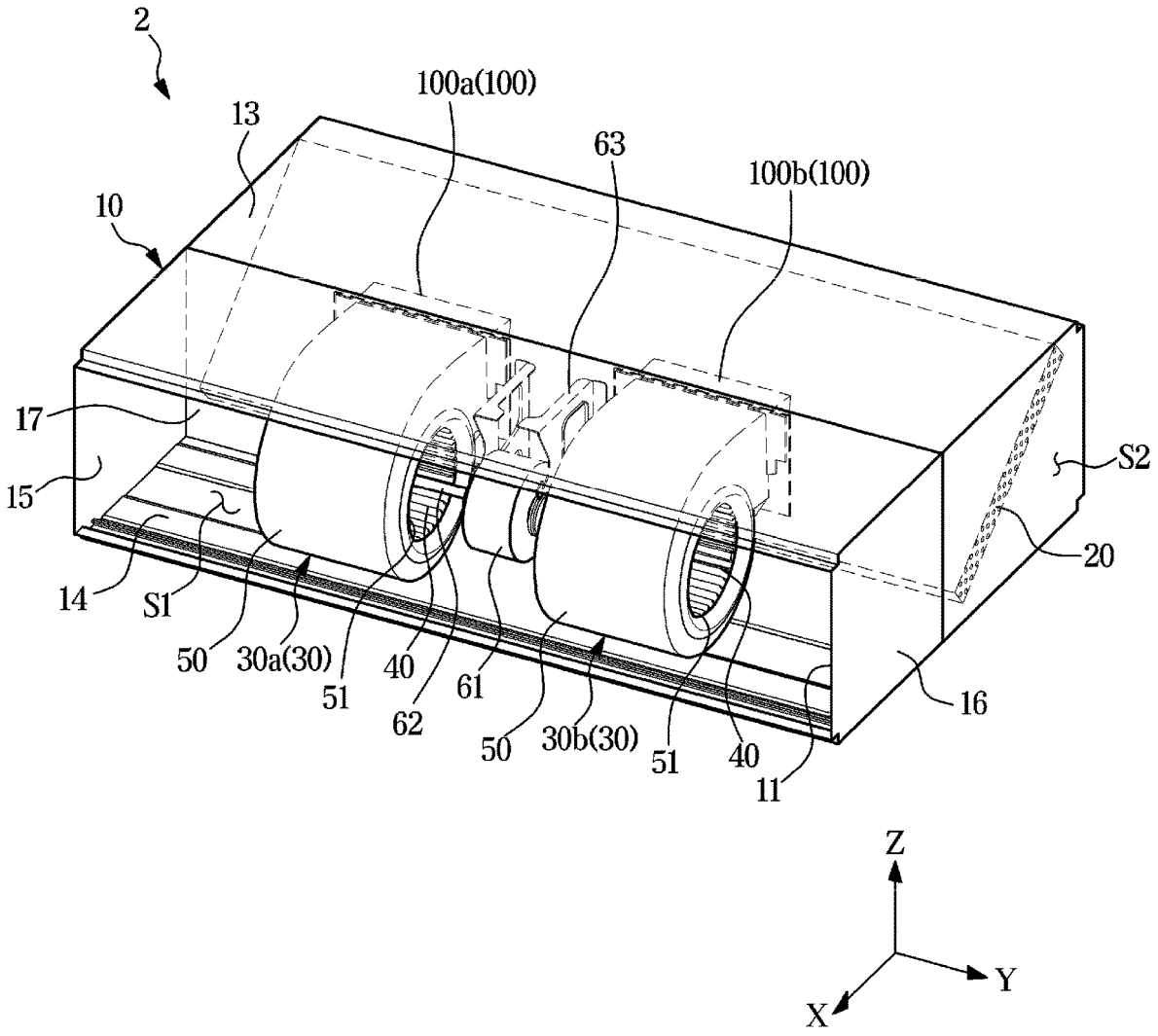
FIG. 52 is a perspective view showing an example of an air conditioner according to an embodiment of the disclosure.

FIG. 52 is a perspective view showing an example of an air conditioner according to an embodiment of the disclosure. FIGS. 53 to 56 are side views showing various embodiments of an air conditioner according to an embodiment of the disclosure.

An air conditioner 2 may include the same components as those of the air conditioner 1 described above, except for a plurality of fan assemblies 30 and air guides corresponding to the plurality of fan assemblies 30. The same components as those described above may be assigned the same reference numerals, and overlapping descriptions thereof will be omitted.

The air conditioner 2 may include the plurality of fan assemblies 30. For example, the air conditioner 2 may include a first fan assembly 30*a* and a second fan assembly 30*b*. The first fan assembly 30*a* may be adjacent to a left wall 15 of a housing 10, and the second fan assembly 30*b* may be adjacent to a right wall 16 of the housing 10.

Figure 53:
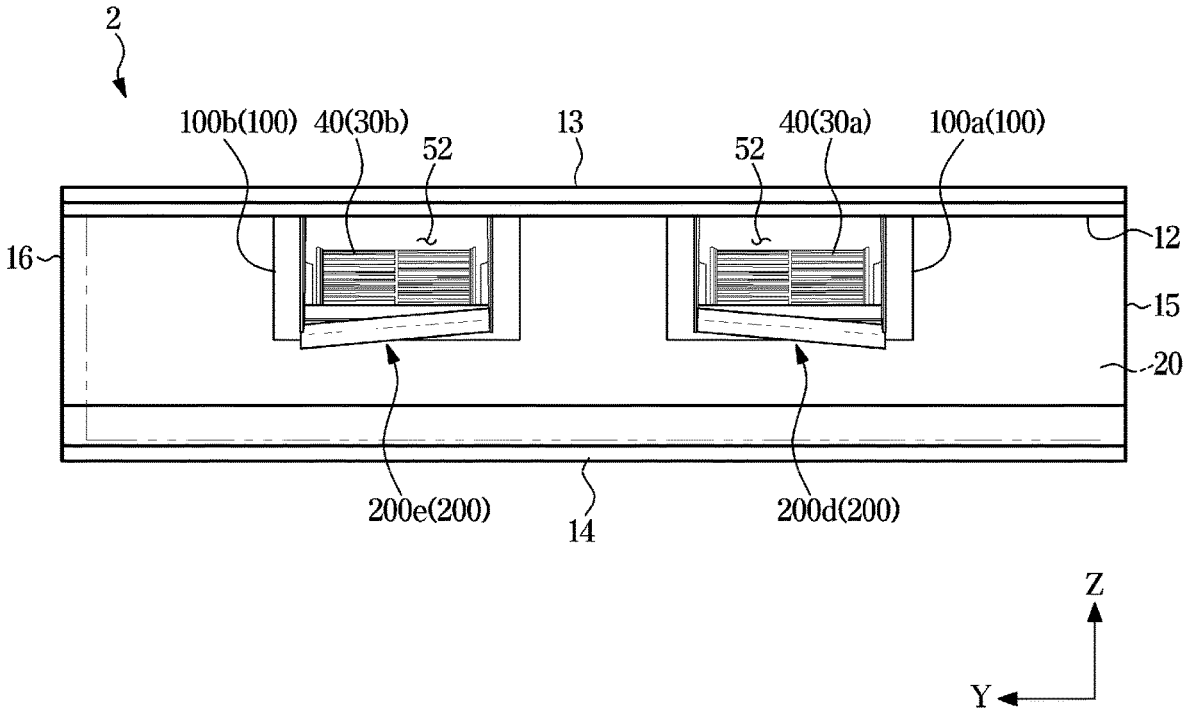
FIG. 53 is a side view of an example of an air conditioner according to an embodiment of the disclosure, seen in the X direction.

Referring to FIG. 53, the air conditioner 2 may include an air guide 200*d* corresponding to the first fan assembly 30*a*, and an air guide 200*e* corresponding to the second fan assembly 30*b*.

The air guide 200*d* may include a shape inclined downward in the left direction (−Y direction). The air guide 200*d* may include a shape inclined downward toward the left wall 15. For example, the air guide 200*d* may be replaced with an air guide 200*f* or an air guide 200*j*.

The air guide 200*d* may guide air discharged from the first fan assembly 30*a* to the left direction. The air guide 200*d* may guide air passed through a first gap g1 formed by the air guide 200*d* to the left direction. The air guide 200*d* may induce air passed through the first gap g1 formed by the air guide 200*d* to flow in the left direction.

The air guide 200*e* may include a shape inclined downward in the right direction (+Y direction). The air guide 200*e* may include a shape inclined downward toward the right wall 16. For example, the air guide 200*e* may be replaced with an air guide 200*g* or an air guide 200*k*.

The air guide 200*e* may guide air discharged from the second fan assembly 30*b* to the right direction. The air guide 200*e* may guide air passed through a first gap g1 formed by the air guide 200*e* to the right direction. The air guide 200*e* may induce air passed through the first gap g1 formed by the air guide 200*e* to flow in the right direction.

For example, in a case in which a size of a second space S2 in which a heat exchanger 20 is positioned is relatively greater than a size of a first space S1 in which a fan assembly 30 is positioned, air discharged from the fan assembly 30 may be concentrated onto some areas of the heat exchanger 20. For example, air discharged from the fan assembly 30 may flow only toward a center area of the heat exchanger 20 without flowing toward both side end areas of the heat exchanger 20. In this case, heat-exchange performance of the heat exchanger 20 may deteriorate.

According to an example of the air conditioner 2, the air guide 200*d* may guide air to the left direction, and the air guide 200*e* may guide air to the right direction. Therefore, air discharged from the fan assembly 30 may be diffused to pass through the entire area of the heat exchanger 20. As a result, heat-exchange performance of the heat exchanger 20 may be improved.

Figure 54:
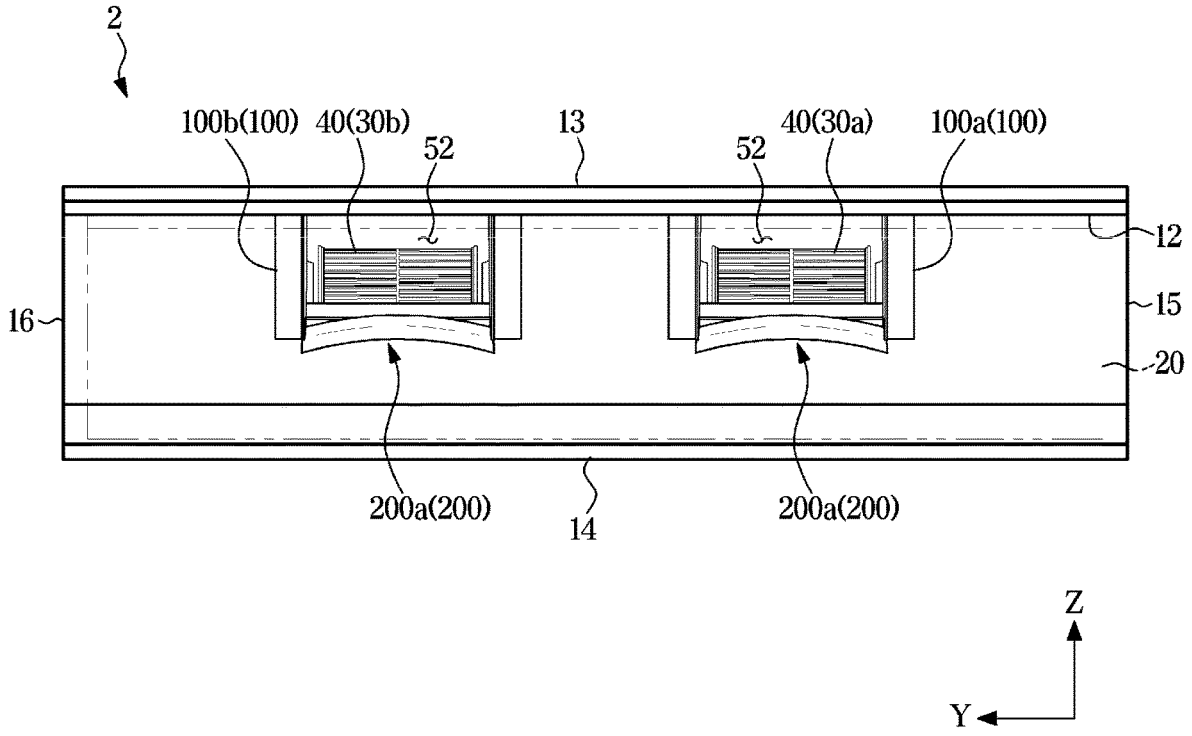
FIG. 54 is a side view of an air conditioner according to an embodiment of the disclosure, seen in the X direction.

Referring to FIG. 54, the air conditioner 2 may include an air guide 200*a* corresponding to a first fan assembly 30*a*, and an air guide 200*a* corresponding to a second fan assembly 30*b*.

Each of the air guide 200*a* corresponding to the first fan assembly 30*a* and the air guide 200*a* corresponding to the second fan assembly 30*b* may include a shape inclined downward toward outer sides in the lateral direction. Each of the air guide 200*a* corresponding to the first fan assembly 30*a* and the air guide 200*a* corresponding to the second fan assembly 30*b* may guide air to the left-right direction. Therefore, air discharged from the fan assembly 30 may be diffused to pass through the entire area of the heat exchanger 20.

Figure 55:
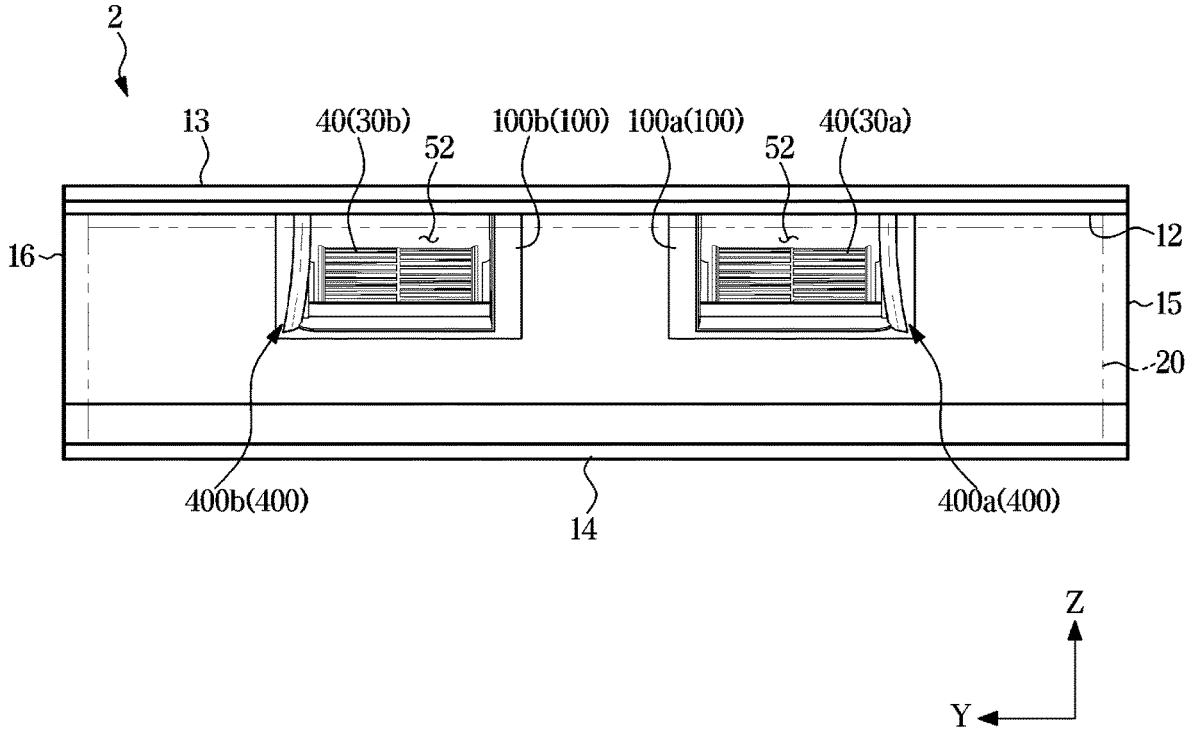
FIG. 55 is a side view of an example of an air conditioner according to an embodiment of the disclosure, seen in the X direction.

Referring to FIG. 55, the air conditioner 2 may include a first side air guide 400*a* corresponding to a first fan assembly 30*a*, and a second side air guide 400*b* corresponding to a second fan assembly 30*b*.

The first side air guide 400*a* may guide air to the left direction, and the second side air guide 400*b* may guide air to the right direction. Therefore, air discharged from the fan assembly 30 may be diffused to pass through the entire area of the heat exchanger 20.

Figure 56:
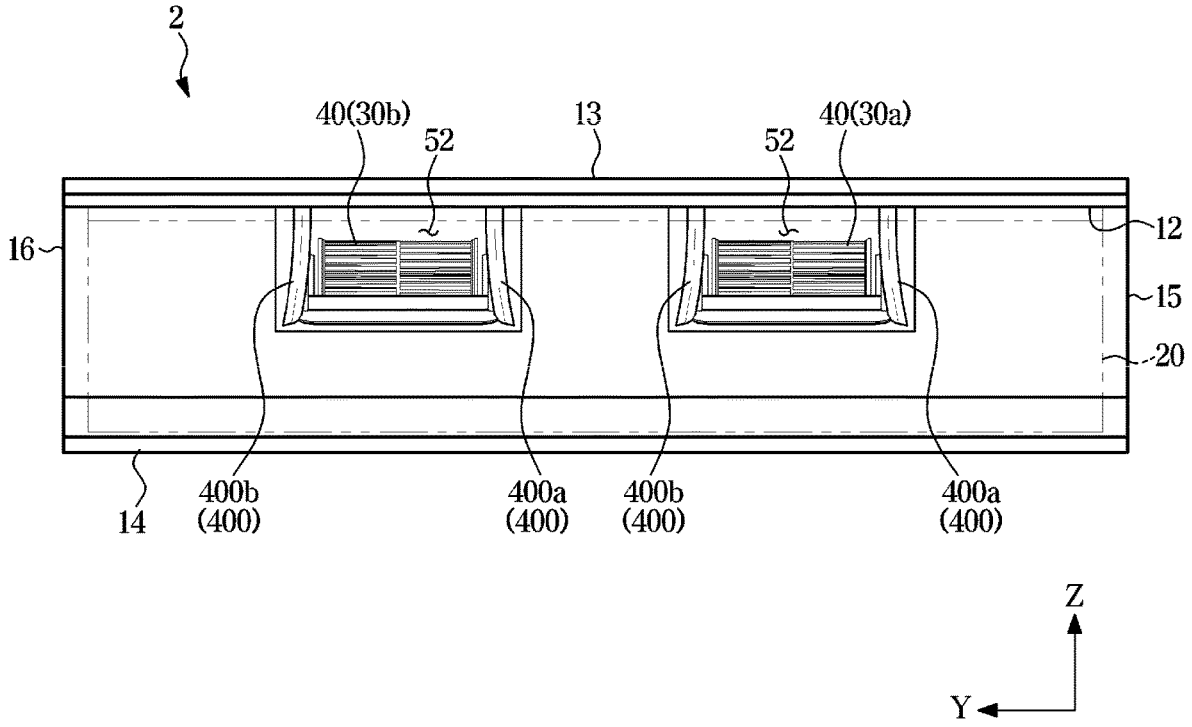
FIG. 56 is a side view of an example of an air conditioner according to an embodiment of the disclosure, seen in the X direction.

Referring to FIG. 56, the air conditioner 2 may include a first side air guide 400*a* corresponding to a first fan assembly 30*a*, and a second side air guide 400*b* corresponding to the first fan assembly 30*a*. The air conditioner 2 may include a first side air guide 400*a* corresponding to a second fan assembly 30*b*, and a second side air guide 400*b* corresponding to the second fan assembly 30*b*.

The side air guides 400 corresponding to the first fan assembly 30*a* and the side air guides 400 corresponding to the second fan assembly 30*b* may guide air to the left-right direction. Therefore, air discharged from the fan assembly 30 may be diffused to pass through the entire area of the heat exchanger 20.

Figure 57:
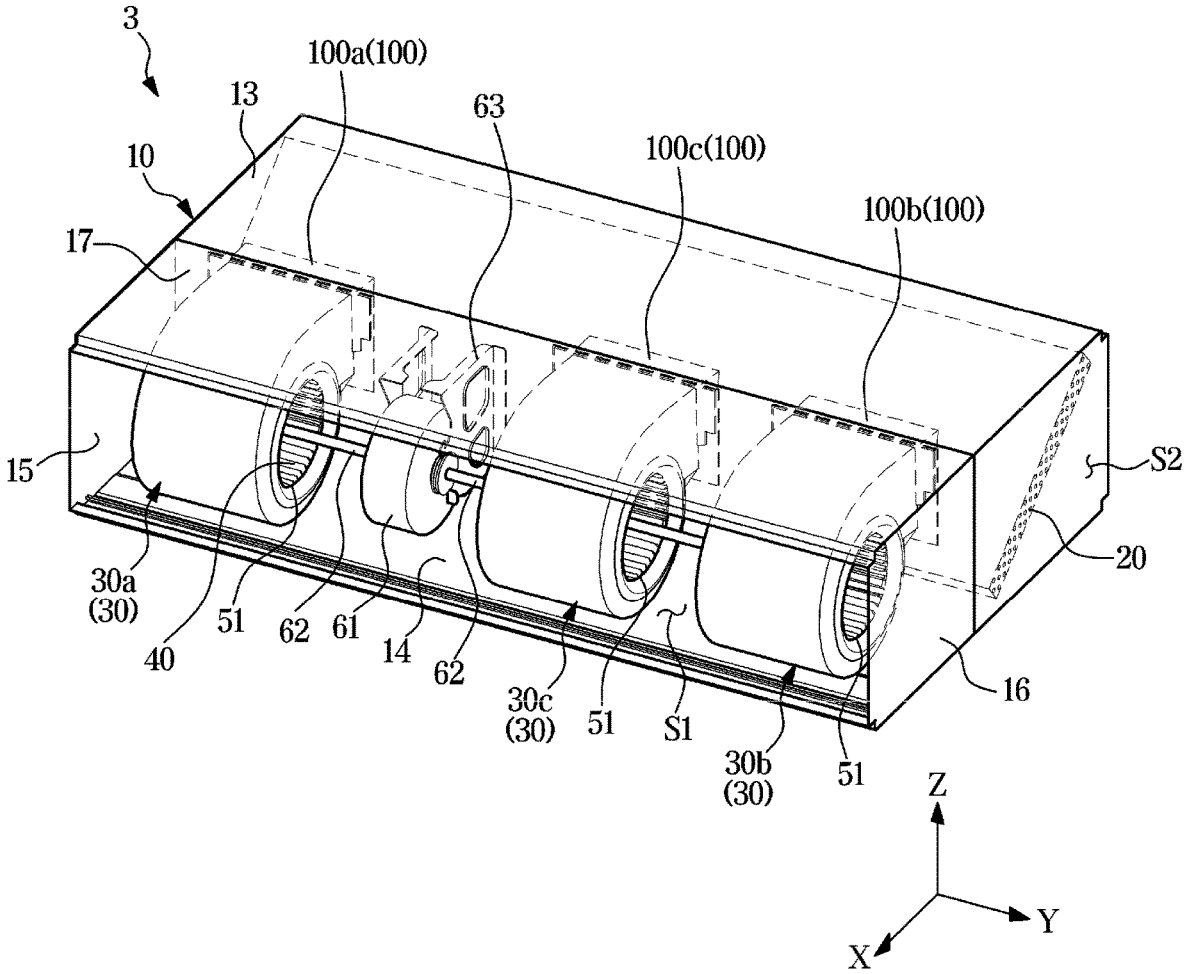
FIG. 57 is a perspective view showing an example of an air conditioner according to an embodiment of the disclosure.

Referring to FIG. 57, an air conditioner 3 may include a plurality of fan assemblies 30. For example, the air conditioner 3 may include a first fan assembly 30*a*, a second fan assembly 30*b*, and a third fan assembly 30*c*. The first fan assembly 30*a* may be adjacent to a left wall 15 of a housing 10. The second fan assembly 30*b* may be adjacent to a right wall 16 of the housing 10. The third fan assembly 30*c* may be positioned between the first fan assembly 30*a* and the second fan assembly 30*b*. A fan driver 60 may be positioned between the first fan assembly 30*a* and the second fan assembly 30*b*.

Figure 58:
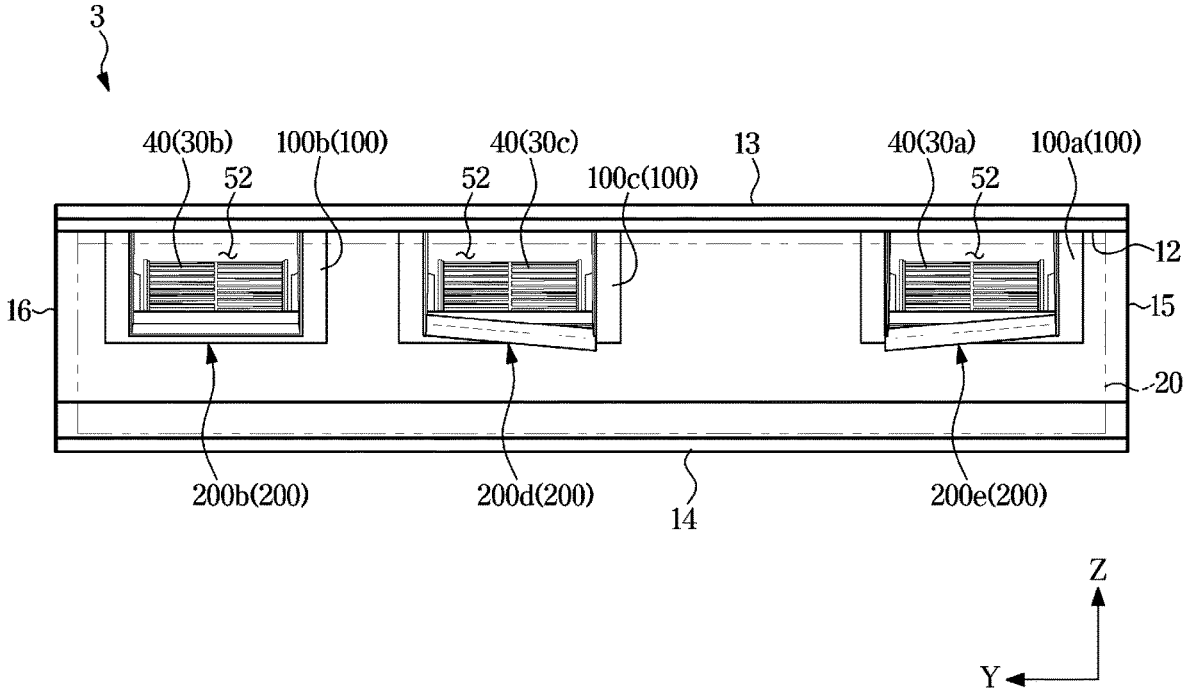
FIG. 58 is a side view of an example of an air conditioner according to an embodiment of the disclosure, seen in the X direction.

Referring to FIG. 58, the air conditioner 2 may include an air guide 200*e* corresponding to a first fan assembly 30*a*, and an air guide 200*d* corresponding to a third fan assembly 30*c*. For example, the air guide 200*d* may be replaced with an air guide 200*f* or an air guide 200*j*. For example, the air guide 200*d* may be replaced with an air guide 200*f* or an air guide 200*j*. For example, the air guide 200*e* may be replaced with an air guide 200*g* or an air guide 200*k*.

The air conditioner 2 may include an air guide 200*b* corresponding to a second fan assembly 30*a*. However, the air guide 200*b* may have various shapes. For example, the air guide 200*b* may be replaced with an air guide 200*a*.

The air guide 200*e* may guide air discharged from the first fan assembly 30*a* to the right direction. The air guide 200*e* may guide air passed through the first gap g1 formed by the air guide 200*e* to the right direction. The air guide 200*e* may induce air passed through the first gap g1 formed by the air guide 200*e* to flow in the right direction.

The air guide 200*d* may guide air discharged from the third fan assembly 30*c* to the left direction. The air guide 200*d* may guide air passed through the first gap g1 formed by the air guide 200*d* to the left direction. The air guide 200*d* may induce air passed through the first gap g1 formed by the air guide 200*d* to flow in the left direction.

For example, in an air conditioner including a plurality of fan assemblies, one(s) of spaces between neighboring fan assemblies among the plurality of fan assemblies may be wide. For example, in a case in which a fan driver (for example, a motor) is positioned between the plurality of fan assemblies, a space between the plurality of fan assemblies may be wide. In this case, air may fail to arrive at an area of a heat exchanger, corresponding to the wide space between the plurality of fan assemblies. That is, no air may pass through some areas of the heat exchanger, which leads to deterioration of heat-exchange performance of the heat exchanger.

According to an example of the air conditioner 3, the air guide 200*e* may guide air to the right direction, and the air guide 200*d* may guide air to the left direction. Therefore, air discharged from the fan assemblies 30*a* and 30*c* may be guided to between the first fan assembly 30*a* and the second fan assembly 30*b*.

Figure 59:
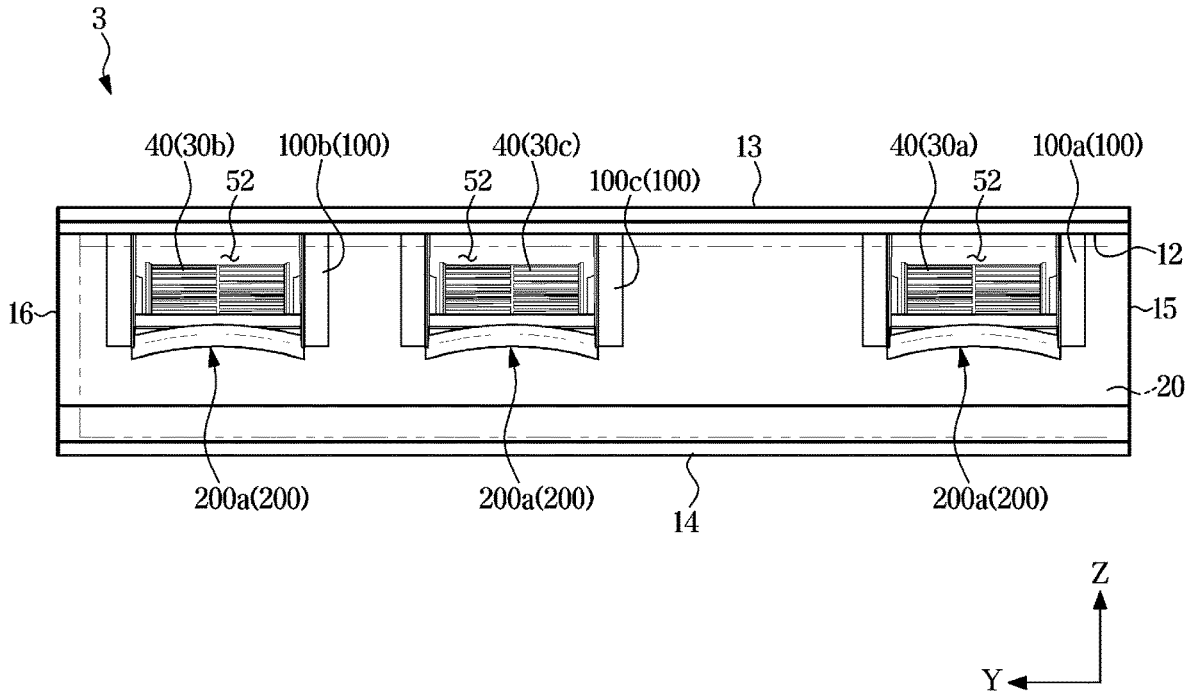
FIG. 59 is a side view of an example of an air conditioner according to an embodiment of the disclosure, seen in the X direction.

Referring to FIG. 59, the air conditioner 3 may include an air guide 200*a* corresponding to a first fan assembly 30*a*, an air guide 200*a* corresponding to a second fan assembly 30*b*, and an air guide 200*a* corresponding to a third fan assembly 30*c*.

Each of the plurality of air guides 200*a* may include a shape inclined downward toward an outer side in the lateral direction. Each of the plurality of air guides 200*a* may guide air to the left-right direction.

Figure 60:
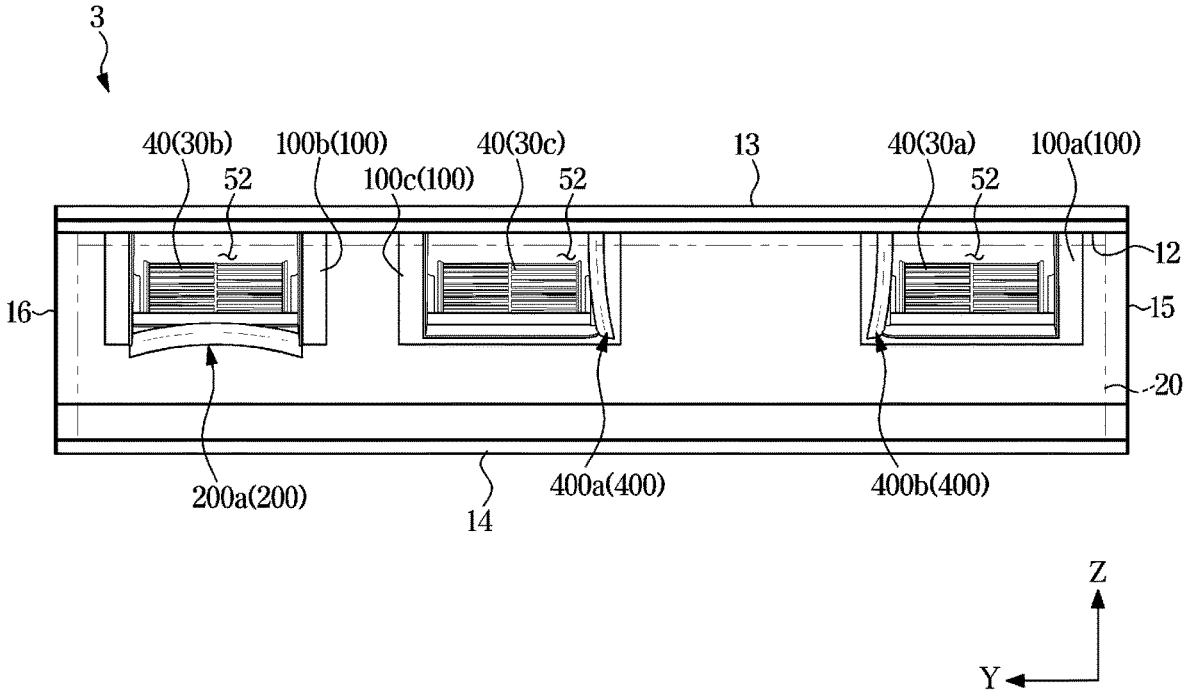
FIG. 60 is a side view of an example of an air conditioner according to an embodiment of the disclosure, seen in the X direction.

Referring to FIG. 60, the air conditioner 3 may include a second side air guide 400*b* corresponding to a first fan assembly 30*a*, and a first side air guide 400*a* corresponding to a second fan assembly 30*b*.

The air conditioner 3 may include an air guide 200*a* corresponding to a third fan assembly 30*c*. However, the air guide 200*a* may have various shapes. For example, the air guide 200*a* may be replaced with an air guide 200*b*.

According to an example of the air conditioner 3, a second side air guide 400*b* may guide air to the right direction, and a first side air guide 400*a* may guide air to the left direction. Therefore, air discharged from fan assemblies 30*a* and 30*c* may be guided to between the first fan assembly 30*a* and the second fan assembly 30*b*.

Figure 61:
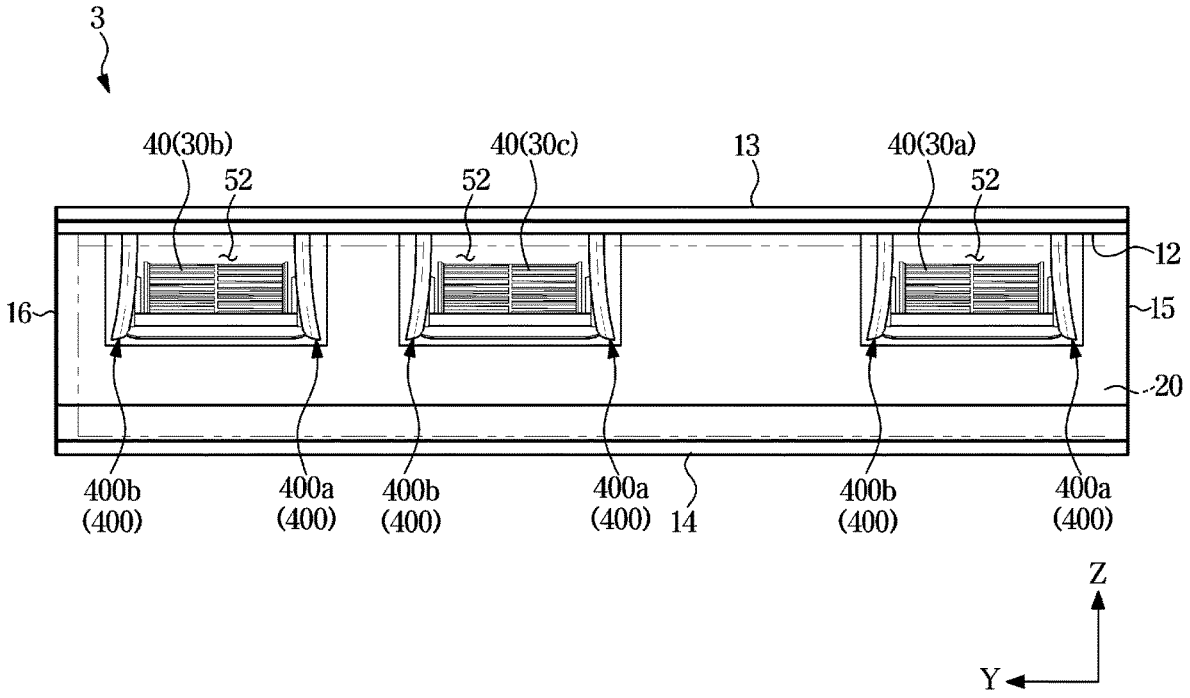
FIG. 61 is a side view of an example of an air conditioner according to an embodiment of the disclosure, seen in the X direction.

Referring to FIG. 61, the air conditioner 3 may include a first side air guide 400*a* corresponding to a first fan assembly 30*a*, and a second side air guide 400*b* corresponding to the first fan assembly 30*a*. The air conditioner 3 may include a first side air guide 400*a* corresponding to a second fan assembly 30*b* and the second side air guide 400*b* corresponding to the second fan assembly 30*b*. The air conditioner 3 may include a first side air guide 400*a* corresponding to a third fan assembly 30*c* and a second side air guide 400*b* corresponding to the third fan assembly 30*c*.

Each of the plurality of side air guides 400 may guide air to the left-right direction.

Figure 62:
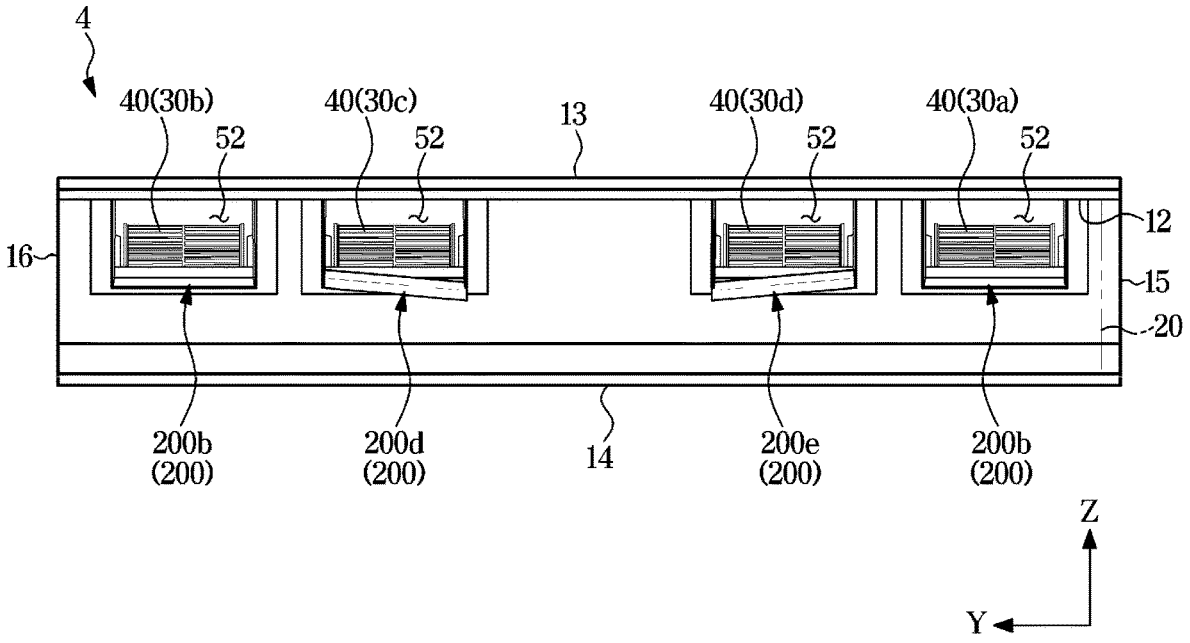
FIG. 62 is a side view of an example of an air conditioner according to an embodiment of the disclosure, seen in the X direction.

Referring to FIG. 62, an air conditioner 4 may include a plurality of fan assemblies 30. For example, the air conditioner 4 may include a first fan assembly 30*a*, a second fan assembly 30*b*, a third fan assembly 30*c*, and a fourth fan assembly 30*d*. The first fan assembly 30*a* may be adjacent to a left wall 15 of a housing 10. The second fan assembly

30*b* may be adjacent to a right wall 16 of the housing 10. The third fan assembly 30*c* and the fourth fan assembly 30*d* may be positioned between the first fan assembly 30*a* and the second fan assembly 30*b*. The third fan assembly 30*c* may be adjacent to the second fan assembly 30*b*. The fourth fan assembly 30*d* may be adjacent to the first fan assembly 30*a*. For example, a space between the third fan assembly 30*c* and the fourth fan assembly 30*d* may be wide. For example, a fan driver may be positioned between the first fan assembly 30*c* and the fourth fan assembly 30*d*.

Referring to FIG. 62, the air conditioner 4 may include an air guide 200*d* corresponding to the third fan assembly 30*c* and an air guide 200*e* corresponding to the fourth fan assembly 30*d*. For example, the air guide 200*d* may be replaced with an air guide 200*f* or an air guide 200*j*. For example, the air guide 200*e* may be replaced with an air guide 200*g* or an air guide 200*k*.

The air conditioner 4 may include an air guide 200*b* corresponding to the first fan assembly 30*a*. The air conditioner 4 may include an air guide 200*b* corresponding to the second fan assembly 30*b*. However, the air guide 200*b* may have various shapes. For example, the air guide 200*b* may be replaced with an air guide 200*a*.

The air guide 200*d* may guide air discharged from the third fan assembly 30*c* to the left direction. The air guide 200*e* may guide air discharged from the fourth fan assembly 30*d* to the right direction. Therefore, air discharged from the fan assemblies 30*c* and 30*d* may be guided to between the third fan assembly 30*c* and the fourth fan assembly 30*d*.

Figure 63:
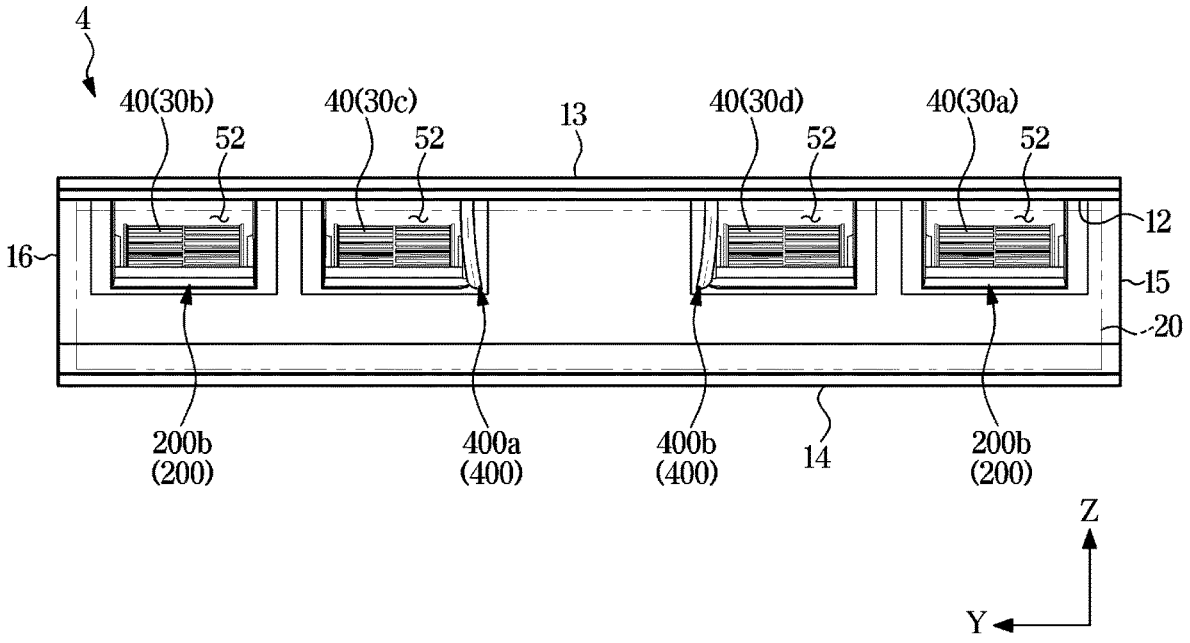
FIG. 63 is a side view of an example of an air conditioner according to an embodiment of the disclosure, seen in the X direction.

Referring to FIG. 63, the air conditioner 4 may include a first side air guide 400*a* corresponding to a third fan assembly 30*c* and a second side air guide 200*b* corresponding to a fourth fan assembly 30*d*.

The air conditioner 4 may include an air guide 200*b* corresponding to a first fan assembly 30*a* and an air guide 200*b* corresponding to a second fan assembly 30*b*. However, the air guide 200*b* may have various shapes. For example, the air guide 200*b* may be replaced with an air guide 200*a*.

The first side air guide 400*a* may guide air discharged from the third fan assembly 30*c* to the left direction. The second side air guide 400*b* may guide air discharged from the fourth fan assembly 30*d* to the right direction. Therefore, air discharged from the third and fourth fan assemblies 30*c* and 30*d* may be guided to between the third fan assembly 30*c* and the fourth fan assembly 30*d*.

According to an aspect of the disclosure, the air conditioner may effectively diffuse an air flow of the fan.

According to an aspect of the disclosure, the air conditioner may improve heat-exchange performance of the heat exchanger by improving a flow rate distribution of the heat exchanger.

According to an aspect of the disclosure, the air conditioner may prevent or reduce generation of vortex inside the housing.

So far, specific embodiments have been shown and described. However, the disclosure is not limited to the above-described embodiments, and various modifications can be made by those skilled in the art without departing from the gist of the technical idea of the disclosure defined by the claims below.

What is claimed is:

1. An air conditioner comprising:

a heat exchanger;

a fan;

a fan case in which the fan is accommodated, and including an inlet opening through which air sucked by the fan enters the fan and an outlet opening through which the air that entered the fan is blown by the fan to be discharged from the fan case; and an air guide spaced from a lower end portion of the outlet opening in a flow direction of the air blown through the outlet opening to form a gap between the lower end portion of the outlet opening and the air guide through which a portion of the air blown through the outlet opening flows in a down direction and is then guided by the air guide toward the heat exchanger, and including an inclined portion inclined downward from a lateral center of the outlet opening toward both lateral directions of the outlet opening to guide a portion of the air blown through the outlet opening that does not flow through the gap in the lateral directions to the heat exchanger.

2. The air conditioner of claim 1, further comprising:

a guide duct including the air guide and configured to guide the air blown through the outlet opening to the heat exchanger.

3. The air conditioner of claim 1, wherein the air guide includes:

a first guide surface to guide the portion of air blown through the outlet opening that does not flow through the gap toward the heat exchanger; and a second guide surface opposite to the first guide surface and configured to guide the portion of the air that flows through the gap toward the heat exchanger.

4. The air conditioner of claim 3, wherein the first guide surface and the second guide surface are curved so as to be inclined downward toward the heat exchanger.

5. The air conditioner of claim 2, wherein the air guide is rotatable with respect to the guide duct to control a flow direction of the air blown through the outlet opening.

6. The air conditioner of claim 5, further comprising:

a guide driver configured to rotate the air guide; and a controller configured to control the guide driver, and change a rotation angle of the air guide with respect to the outlet opening.

7. The air conditioner of claim 1, wherein a cross section of the air guide includes a streamlined shape.

8. The air conditioner of claim 1, wherein the air guide is a first air guide, the gap is a first gap, the air conditioner further includes a second air guide arranged with the first air guide along the flow direction of air blown through the outlet opening, and the second air guide is spaced from the first air guide in the flow direction of air blown through the outlet opening, to form a second gap between the first air guide and the second air guide through which a portion of the air guided by the inclined portion of the first air guide flows and is then guided by the second air guide toward the heat exchanger.

9. The air conditioner of claim 8, wherein the second air guide protrudes lower than the first air guide.

10. The air conditioner of claim 1, wherein the gap is a lower gap, the air conditioner further includes a side air guide extending in a vertical direction to correspond to a side end of the outlet opening, the side air guide is spaced from the side end of the outlet opening to form a side gap through which air flows, and the air guide is lower than the side air guide.

11. The air conditioner of claim 10, wherein the side air guide is curved outward from the side end of the outlet opening, and configured to guide air that flows through the side gap to a lateral direction of the outlet opening.

12. The air conditioner of claim 1, wherein one side of the air guide in a lateral direction of the air guide is lower than an other side of the air guide that is opposite to the one side such that the air guide induces air to flow to the one side.

13. The air conditioner of claim 2, further comprising:

a housing that includes:

a first space in which an inlet is formed and in which the fan and the fan case are positioned, a second space in which an outlet is formed and in which the heat exchanger is positioned, and a partition configured to partition the first space from the second space excluding an area corresponding to the outlet opening, wherein the guide duct is detachably installed on the partition to provide an airflow path to the outlet opening.

14. The air conditioner of claim 2, wherein the guide duct further includes:

an opening corresponding to the outlet opening;

an upper cover portion covering an upper area of the opening and protruding toward the heat exchanger;

a first side cover portion covering one side area of the opening and extending downward from a first side of the upper cover portion; and a second side cover portion being opposite to the first side cover portion, and covering an other side area of the opening and extending downward from a second side of the upper cover portion, wherein the air guide is positioned between the first side cover portion and the second side cover portion.

15. The air conditioner of claim 1, wherein the fan is configured to suck air in an axial direction and discharge air in a radial direction.

* * * * *